US007770334B2

(12) United States Patent
Mower et al.

(10) Patent No.: US 7,770,334 B2
(45) Date of Patent: Aug. 10, 2010

(54) DOOR ASSEMBLY FOR A MODULAR ENCLOSURE

(75) Inventors: Barry D. Mower, Layton, UT (US); Brent Steed, Syracuse, UT (US); Jay Calkin, Ogden, UT (US); Neil Watson, Layton, UT (US); Robert A. Astle, Farmington, UT (US); L. Curtis Strong, Clearfield, UT (US); Rich Howe, Pleasant View, UT (US); David C. Winter, Layton, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 886 days.

(21) Appl. No.: 11/091,620

(22) Filed: Mar. 28, 2005

(65) Prior Publication Data

US 2005/0210760 A1 Sep. 29, 2005

Related U.S. Application Data

(63) Continuation-in-part of application No. 10/890,601, filed on Jul. 14, 2004, now Pat. No. 7,210,277, and a continuation-in-part of application No. 29/202,299, filed on Mar. 29, 2004, now Pat. No. Des. 506,267, and a continuation-in-part of application No. 29/202,291, filed on Mar. 29, 2004, now Pat. No. Des. 506,266, and a continuation-in-part of application No. 29/202,267, filed on Mar. 29, 2004, now Pat. No. Des. 505,497, and a continuation-in-part of application No. 29/202,397, filed on Mar. 29, 2004, now abandoned, and a continuation-in-part of application No. 29/204,812, filed on May 3, 2004, now Pat. No. Des. 506,011, and a continuation-in-part of application No. 29/204,811, filed on May 3, 2004, now Pat. No. Des. 506,268.

(60) Provisional application No. 60/557,369, filed on Mar. 29, 2004, provisional application No. 60/586,387, filed on Jul. 8, 2004.

(51) Int. Cl.
*B66B 9/00* (2006.01)

(52) U.S. Cl. ..... 52/32; 52/782.1; 52/79.1; 52/79.6

(58) Field of Classification Search ..... 52/79.6, 52/79.12, 79.1, 782.1, 309.11; 280/47.34; 49/404

See application file for complete search history.

(56) References Cited

U.S. PATENT DOCUMENTS 383,353 A 5/1888 Baker (Continued)

FOREIGN PATENT DOCUMENTS

CA 2365055 3/2000

(Continued)

OTHER PUBLICATIONS

Keter North America; *Owner's Manual, Apex 4×6*; date created: May 15, 2004; date modified: May 15, 2004.

(Continued)

*Primary Examiner*—Basil Katcheves
(74) *Attorney, Agent, or Firm*—Workman Nydegger

(57) ABSTRACT

A modular enclosure, such as a shed, may include a door assembly. The door assembly may include a door constructed from blow-molded plastic and a hinge member receiving portion may be disposed on one side of the door. Advantageously, the hinge member receiving portion may be integrally formed with the door as part of a unitary, one-piece construction. A hinge member may be disposed within the hinge member receiving portion and the hinge member may pivotally connect the door to the shed. The door may include a reinforcement member, which is preferably constructed from metal and disposed proximate the second side of the door. If desired, the reinforcement member may be at least partially exposed on an outer surface of the door. In addition, the door assembly may include a flange that is sized and configured to prevent water from unintentionally entering the shed.

30 Claims, 36 Drawing Sheets

U.S. PATENT DOCUMENTS

| | | | |
|---|---|---|---|
| 1,300,439 | A | 4/1919 | Madison |
| 1,516,096 | A | 11/1924 | Hahn |
| 1,736,548 | A | 11/1929 | Pye |
| 1,828,193 | A | 10/1931 | Levin |
| 2,107,418 | A | 2/1938 | Keller |
| 2,304,145 | A | 12/1942 | Borchers |
| D139,766 | S | 12/1944 | Bruner |
| D142,945 | S | 11/1945 | Borchers |
| 2,388,297 | A | 11/1945 | Slaughter |
| 2,766,855 | A | 10/1956 | Johnson et al. |
| 2,816,329 | A | 12/1957 | Sogaro |
| 2,863,185 | A | 12/1958 | Riedi |
| 2,922,344 | A | 1/1960 | Meissner |
| 3,077,426 | A | 2/1963 | Johnston |
| 3,090,087 | A | 5/1963 | Miller |
| 3,173,383 | A | 3/1965 | Eggert |
| 3,194,596 | A | 7/1965 | Jakeway |
| 3,199,258 | A | 8/1965 | Jentoft et al. |
| 3,200,547 | A | 8/1965 | Johnson |
| D202,177 | S | 9/1965 | Blau et al. |
| 3,220,151 | A | 11/1965 | Goldman |
| 3,222,829 | A | 12/1965 | Bening |
| 3,234,700 | A | 2/1966 | Creveling |
| D204,088 | S | 3/1966 | Adler |
| 3,343,321 | A | 9/1967 | Axelsson |
| 3,344,564 | A | 10/1967 | Siegal |
| 3,401,494 | A | 9/1968 | Anderson |
| 3,423,891 | A | 1/1969 | Burris |
| 3,436,881 | A | 4/1969 | Schlecht |
| 3,438,312 | A | 4/1969 | Becker et al. |
| 3,488,905 | A | 1/1970 | Campbell |
| 3,521,414 | A | 7/1970 | Malissa |
| 3,543,456 | A | 12/1970 | Gregoire |
| 3,563,582 | A | 2/1971 | Shroyer |
| 3,566,554 | A | 3/1971 | Schaffer et al. |
| 3,597,858 | A | 8/1971 | Ogsbury |
| 3,700,213 | A | 10/1972 | Blease |
| 3,762,109 | A | 10/1973 | Cohen |
| 3,766,699 | A | 10/1973 | Dinkel |
| 3,778,949 | A | 12/1973 | Hellerich |
| 3,789,094 | A | 1/1974 | Hutchison |
| 3,839,837 | A | 10/1974 | Jaconelli |
| 3,865,679 | A | 2/1975 | Hale |
| 3,905,167 | A | 9/1975 | Watkins et al. |
| 3,908,326 | A | 9/1975 | Francis |
| 3,928,691 | A | 12/1975 | Knudson |
| 3,933,311 | A | 1/1976 | Lemelson |
| 3,935,357 | A | 1/1976 | Padovani |
| 3,969,862 | A | 7/1976 | Kuss |
| 3,984,961 | A | 10/1976 | Chieger et al. |
| 3,992,839 | A | 11/1976 | La Borde |
| 4,004,387 | A | 1/1977 | Ellingson |
| 4,008,548 | A | 2/1977 | Leclerc |
| 4,010,586 | A | 3/1977 | Brechbuhler |
| 4,023,317 | A | 5/1977 | Bettger et al. |
| 4,028,750 | A | 6/1977 | Gustafsson |
| 4,031,682 | A | 6/1977 | Renkert |
| 4,032,680 | A | 6/1977 | Allard |
| 4,045,937 | A | 9/1977 | Stucky |
| D246,082 | S | 10/1977 | Friedrich |
| 4,054,987 | A | 10/1977 | Forlenza |
| 4,110,951 | A | 9/1978 | Padrun |
| 4,128,369 | A | 12/1978 | Kemerer et al. |
| 4,175,883 | A | 11/1979 | Lemelson |
| 4,186,723 | A | 2/1980 | Coppola et al. |
| 4,201,019 | A | 5/1980 | Jones |
| 4,226,064 | A | 10/1980 | Kraayenhof |
| 4,236,361 | A | 12/1980 | Boden |
| 4,258,519 | A | 3/1981 | Hugens |
| 4,290,248 | A | 9/1981 | Kemerer et al. |
| 4,313,385 | A | 2/1982 | Fitzgerald |
| 4,348,442 | A | 9/1982 | Figge |
| 4,436,779 | A | 3/1984 | Menconi et al. |
| 4,470,405 | A | 9/1984 | Landstrom et al. |
| D278,395 | S | 4/1985 | Keeler |
| 4,557,091 | A | 12/1985 | Auer |
| 4,563,374 | A | 1/1986 | Treber et al. |
| 4,568,584 | A | 2/1986 | Holland |
| 4,609,192 | A | 9/1986 | Bratcher |
| 4,641,468 | A | 2/1987 | Slater |
| 4,662,515 | A | 5/1987 | Newby, Sr. |
| 4,674,250 | A | 6/1987 | Altizer |
| D293,981 | S | 2/1988 | Ball |
| 4,790,112 | A | 12/1988 | Wang |
| 4,792,082 | A | 12/1988 | Williamson |
| 4,805,357 | A | 2/1989 | Aleixo |
| 4,826,265 | A | 5/1989 | Hockenberry |
| 4,843,788 | A | 7/1989 | Gavin et al. |
| 4,862,653 | A | 9/1989 | Pomento |
| 4,903,445 | A | 2/1990 | Mankowski |
| 4,910,280 | A | 3/1990 | Robbins, III |
| 4,925,338 | A | 5/1990 | Kapusta |
| 4,930,286 | A | 6/1990 | Kotler |
| 4,972,634 | A | 11/1990 | Dresden |
| 4,984,406 | A | 1/1991 | Friesen |
| 4,998,023 | A | 3/1991 | Kitts |
| 5,036,634 | A | 8/1991 | Lessard et al. |
| 5,040,834 | A | 8/1991 | Kahl et al. |
| 5,106,915 | A | 4/1992 | Rock et al. |
| 5,125,697 | A | 6/1992 | Kahl et al. |
| 5,184,436 | A | 2/1993 | Sadler |
| 5,191,985 | A | 3/1993 | Licari |
| 5,219,085 | A | 6/1993 | Craft et al. |
| 5,255,803 | A | 10/1993 | Pavone et al. |
| 5,265,385 | A | 11/1993 | Smith et al. |
| 5,279,233 | A | 1/1994 | Cox |
| 5,293,720 | A | 3/1994 | Brice et al. |
| 5,293,725 | A | 3/1994 | Matticks et al. |
| 5,331,778 | A | 7/1994 | Mazpule et al. |
| 5,335,614 | A | 8/1994 | Klaus |
| 5,358,423 | A | 10/1994 | Burkhard et al. |
| 5,364,204 | A | 11/1994 | MacLeod |
| 5,405,670 | A | 4/1995 | Wetzel et al. |
| 5,411,782 | A | 5/1995 | Jarvis et al. |
| 5,437,573 | A * | 8/1995 | Rodriguezferre ..... 472/116 |
| 5,459,967 | A | 10/1995 | Bodtker |
| D364,468 | S | 11/1995 | Maple |
| 5,470,641 | A | 11/1995 | Shuert |
| D365,154 | S | 12/1995 | Maple |
| 5,528,997 | A | 6/1996 | Miller |
| 5,544,870 | A | 8/1996 | Kelley et al. |
| 5,555,681 | A | 9/1996 | Cawthon |
| D375,168 | S | 10/1996 | Hunt et al. |
| D375,169 | S | 10/1996 | Hunt et al. |
| 5,566,961 | A | 10/1996 | Snell et al. |
| 5,568,772 | A | 10/1996 | Carson |
| D376,622 | S | 12/1996 | Roberts |
| 5,596,843 | A | 1/1997 | Watson |
| 5,605,344 | A * | 2/1997 | Insalaco et al. ..... 280/47.34 |
| 5,609,327 | A | 3/1997 | Amidon |
| 5,626,331 | A | 5/1997 | Erwin |
| 5,640,816 | A | 6/1997 | Reiland et al. |
| 5,647,181 | A | 7/1997 | Hunts |
| 5,657,583 | A | 8/1997 | Tennant |
| 5,660,907 | A | 8/1997 | Skalka |
| 5,671,913 | A | 9/1997 | Vesper |
| D387,876 | S | 12/1997 | Maple |
| 5,694,730 | A | 12/1997 | Del Rincon et al. |
| 5,704,699 | A | 1/1998 | Pagelow et al. |
| 5,706,620 | A * | 1/1998 | De Zen ..... 52/220.2 |
| 5,713,806 | A | 2/1998 | Teitgen et al. |
| 5,715,854 | A | 2/1998 | Andrieux et al. |
| 5,724,774 | A | 3/1998 | Rooney |
| D393,724 | S | 4/1998 | Sagol |

5,743,426 A 4/1998 Mosley
5,755,341 A 5/1998 Spamer
5,761,867 A 6/1998 Carling
5,776,582 A 7/1998 Needham
5,778,604 A 7/1998 Snow
5,787,654 A 8/1998 Drost
5,789,057 A 8/1998 Naitou et al.
D397,562 S 9/1998 DePottey et al.
5,807,618 A 9/1998 Shiota et al.
D399,575 S 10/1998 Hunt
5,826,389 A 10/1998 Siler
D400,737 S 11/1998 DePottey et al.
D405,540 S 2/1999 Maple
5,868,630 A 2/1999 Saksun, Jr.
5,882,140 A 3/1999 Yoduck, Jr. et al.
5,890,338 A * 4/1999 Rodriguez-Ferre ..... 52/582.1
5,890,607 A 4/1999 Maglione
5,904,021 A 5/1999 Fisher
D411,625 S 6/1999 Fuller et al.
D411,629 S 6/1999 Mandell
5,911,932 A 6/1999 Dyksterhouse
5,915,724 A 6/1999 Daris et al.
5,935,510 A 8/1999 Hansen
5,944,377 A 8/1999 Vlahovic
5,950,378 A 9/1999 Council et al.
5,950,568 A 9/1999 Axelrod et al.
5,961,100 A 10/1999 Lechtenboehmer
5,970,663 A 10/1999 McDonough
D416,091 S 11/1999 Ohanesian
5,975,660 A * 11/1999 Tisbo et al. ..... 312/263
5,992,106 A 11/1999 Carling et al.
6,012,253 A 1/2000 Burns
6,044,598 A 4/2000 Elsasser et al.
6,060,144 A 5/2000 Kimura et al.
6,061,979 A 5/2000 Johannes
6,061,987 A 5/2000 King
6,068,308 A 5/2000 Molzer
6,098,354 A 8/2000 Skandis
6,101,768 A 8/2000 Springstead et al.
6,101,967 A 8/2000 Glass et al.
6,109,687 A 8/2000 Nye et al.
D431,869 S 10/2000 Hampel
6,129,605 A 10/2000 Cyrus et al.
6,148,583 A 11/2000 Hardy
D436,830 S 1/2001 Nesseth
D437,421 S 2/2001 Hampel
D437,942 S 2/2001 Hampel
6,185,878 B1 2/2001 Bullard, III et al.
6,189,270 B1 2/2001 Jeffers et al.
6,193,083 B1 2/2001 Wood
6,250,022 B1 6/2001 Paz et al.
6,257,559 B1 7/2001 Mouri
6,298,619 B1 10/2001 Davie
6,311,956 B1 11/2001 Erwin
6,332,554 B1 12/2001 McCarthy
D452,913 S 1/2002 Ohanesian
D455,501 S 4/2002 Greene
6,363,680 B1 4/2002 Erwin
6,374,756 B1 4/2002 Fieldwick et al.
6,385,942 B1 5/2002 Grossman
6,389,769 B1 * 5/2002 McKinney et al. ..... 52/309.9
6,397,537 B2 6/2002 Auer et al.
6,413,348 B2 7/2002 Stancu et al.
6,418,672 B1 7/2002 Hampel
6,443,521 B1 9/2002 Nye et al.
6,446,414 B1 9/2002 Bullard, III et al.
6,482,500 B1 11/2002 Diginosa
D468,026 S 12/2002 Tisbo et al.
D468,442 S 1/2003 Tisbo et al.
D468,833 S 1/2003 Tisbo et al.
D468,834 S 1/2003 Tisbo et al.
D469,188 S 1/2003 Tisbo et al.
6,524,518 B1 2/2003 Pelfrey
6,524,690 B1 2/2003 Dyksterhouse
6,539,680 B2 4/2003 Kunz et al.
6,562,414 B2 5/2003 Carling
D476,424 S 6/2003 Shanahan
6,571,529 B2 6/2003 Knudson et al.
6,581,337 B1 6/2003 Skov et al.
6,589,891 B1 7/2003 Rast
6,591,558 B1 7/2003 De Zen
6,604,328 B1 8/2003 Paddock
D479,882 S 9/2003 Tisbo et al.
D481,138 S 10/2003 Forster et al.
6,631,594 B2 10/2003 Whiting
6,631,821 B2 10/2003 Vourganas
6,637,728 B2 10/2003 Pettit et al.
6,646,022 B2 11/2003 Okazaki et al.
D484,339 S 12/2003 Greene
D484,612 S 12/2003 Greene
6,656,316 B1 12/2003 Dyksterhouse
6,666,152 B2 12/2003 Tsai
6,668,514 B2 12/2003 Skov et al.
6,670,419 B2 12/2003 Lau et al.
6,672,970 B2 1/2004 Barlow
6,675,545 B2 1/2004 Chen et al.
6,681,447 B2 1/2004 Houk, Jr. et al.
6,695,544 B2 2/2004 Knudson et al.
6,701,678 B1 3/2004 Skov et al.
6,702,128 B2 3/2004 Winig et al.
6,705,796 B2 3/2004 Lund
6,709,034 B2 3/2004 Michael
6,709,995 B1 3/2004 Dyksterhouse
6,719,360 B1 4/2004 Backs
6,726,864 B2 4/2004 Nasr et al.
6,752,278 B2 6/2004 Craft et al.
D492,793 S 7/2004 Moon et al.
D494,281 S 8/2004 Greene
D494,834 S 8/2004 Etlicher
6,776,300 B2 8/2004 Walsh et al.
6,782,624 B2 8/2004 Marsh et al.
6,782,672 B2 8/2004 Staats
D496,737 S 9/2004 Moon et al.
6,796,087 B1 9/2004 Greene
6,802,158 B1 10/2004 Greene
6,802,327 B2 10/2004 Koss
6,808,674 B1 10/2004 Skov et al.
6,821,049 B1 11/2004 Greene
6,823,639 B2 11/2004 Hampel
D500,604 S 1/2005 Ashby
6,866,081 B1 * 3/2005 Nordgard et al. ..... 160/371
6,868,703 B2 3/2005 Molzer
D505,497 S 5/2005 Astle et al.
6,892,497 B2 5/2005 Moon et al.
D506,011 S 6/2005 Astle et al.
D506,266 S 6/2005 Astle et al.
D506,267 S 6/2005 Astle et al.
D506,268 S 6/2005 Astle et al.
6,938,665 B2 * 9/2005 Lewis et al. ..... 160/96
6,939,599 B2 9/2005 Clark
6,948,280 B2 9/2005 Marcinkowski et al.
D525,715 S 7/2006 Richardson et al.
7,069,865 B2 7/2006 Strong et al.
7,210,277 B2 5/2007 Steed et al.
D547,880 S 7/2007 Ashby et al.
D548,362 S 8/2007 Ashby et al.
2001/0009703 A1 7/2001 Toshikawa
2002/0000545 A1 1/2002 Pettit et al.
2002/0043035 A1 4/2002 Patel et al.
2002/0088560 A1 7/2002 Amin-Javaheri
2002/0092128 A1 7/2002 Houk, Jr. et al.
2002/0092245 A1 7/2002 Floyd et al.
2002/0092818 A1 7/2002 Craft et al.
2002/0170259 A1 11/2002 Ferris
2002/0174532 A1 11/2002 Skov et al.
2003/0024191 A1 2/2003 Hampel

| | | | |
|---|---|---|---|
| 2003/0029113 | A1 | 2/2003 | Wetzel, III et al. |
| 2003/0033770 | A1 | 2/2003 | Harel |
| 2003/0106472 | A1 | 6/2003 | Lonneman et al. |
| 2003/0114101 | A1 | 6/2003 | Paz |
| 2003/0118404 | A1 | 6/2003 | Lee |
| 2003/0125399 | A1 | 7/2003 | Zhang et al. |
| 2003/0126814 | A1 | 7/2003 | Cook et al. |
| 2003/0146426 | A1 | 8/2003 | Ray et al. |
| 2003/0154675 | A1 | 8/2003 | LaBruzza |
| 2003/0178383 | A1 | 9/2003 | Craft et al. |
| 2003/0197165 | A1 | 10/2003 | Perelli |
| 2003/0201272 | A1 | 10/2003 | Carter |
| 2003/0203150 | A1 | 10/2003 | Moran et al. |
| 2003/0217676 | A1 | 11/2003 | Strong et al. |
| 2003/0226815 | A1 | 12/2003 | Gaunt et al. |
| 2004/0049992 | A1 | 3/2004 | Seavy |
| 2004/0074158 | A1 | 4/2004 | De Zen |
| 2004/0163340 | A1 | 8/2004 | Harel |
| 2004/0187400 | A1 | 9/2004 | Anderson |
| 2005/0166476 | A1 | 8/2005 | Feng |
| 2005/0223655 | A1 | 10/2005 | Mower et al. |
| 2005/0252109 | A1 | 11/2005 | Fuccella et al. |
| 2005/0279034 | A1 | 12/2005 | Tsang |
| 2006/0048459 | A1 | 3/2006 | Moore |
| 2006/0059792 | A1 | 3/2006 | Tiramani |
| 2006/0108899 | A1 | 5/2006 | Jin |
| 2006/0191209 | A1 | 8/2006 | Reisman |
| 2007/0044391 | A1 | 3/2007 | Richardson |
| 2007/0209295 | A1 | 9/2007 | Mower et al. |
| 2007/0251166 | A1 | 11/2007 | Thiagarajan et al. |

FOREIGN PATENT DOCUMENTS

| | | |
|---|---|---|
| CA | 2446581 | 11/2002 |
| EP | 0339216 | 11/1989 |
| FR | 2552467 | 3/1985 |
| JP | 5230935 | 9/1993 |
| JP | 06226820 | 8/1994 |
| JP | 07-012123 | 2/1995 |
| JP | 08108464 | 4/1996 |

OTHER PUBLICATIONS

Keter North America; *Owner 's Manual, Apex 8×6 Extension Kit*; date created: Sep. 25, 2003; date modified: Oct. 30, 2003.
Keter North America; *Owner's Manual, Apex 8×6*; date created: May 15, 2004; date modified: May 15, 2004.
Royal Outdoor Products Co.; *4' Extension Kit for Winchester Models S010, S011 & S020, Model E001 Owner's Manual 10'×12' Version 2.8*; date created: Oct. 29, 2003; date modified: Oct. 29, 2003; copyright 2003.
Royal Outdoor Products Co.; *7' Extension Kit for Winchester Models S010, S011 & S020, Model E002 Owner's Manual 10'×15' Version 2.9*; date created: Oct. 29, 2003; date modified: Oct. 29, 2003; copyright 2003.
Royal Outdoor Products Co.; *The Winchester II Storage Building, Model S011 Owner's Manual 10'×8' Version 3.2*; date created: Oct. 29, 2003; date modified: Oct. 29, 2003; copyright 2003.
Royal Outdoor Products Co.; *The Winchester Storage Building, Model S010 Owner's Manual 10'×8' Version 3.2*; date created: Oct. 29, 2003; date modified: Oct. 29, 2003; copyright 2003; copyright 2003.
Rubbermaid Home Products; *3713 Big Max 7'×3' 6" Resin Storage Building Assembly*; date created: Jan. 19, 2004; date modified: Jan. 19, 2004; copyright 2003.
Rubbermaid Home Products; *3784 Big Max 7'×7' Resin Storage Building Assembly*; date created: Jan. 19, 2004; date modified: Jan. 19, 2004; copyright 2003.
Rubbermaid Home Products; *Roughneck Vertical Storage Shed 3673*; date created: Jun. 30, 2004; date modified: Jun. 30, 2004; copyright 2003.
Suncast Corporation; *GS8000 Owner's Manual*; date created: Aug. 26, 2004; date modified: not available; copyright 2004.
Suncast Corporation; *GS8500 Owner 's Manual*; date created: Mar. 11, 2004; date modified: not available; copyright 2003.
Suncast Corporation; *GS9000 Owner 's Manual*; date created: Aug. 26, 2004; date modified: not available; copyright 2004.
Suncast Corporation; *GS9500 Owner's Manual*; date created: Mar. 8, 2004; date modified: not available; copyright 2004.
The STEP2 Company; *LifeScapes Storage Building*; date created: Feb. 2, 2004; date modified: Jul. 14, 2004; copyright 2004.
The STEP2 Company; *LifeScapes Storage House*; date created: Feb. 2, 2004; date modified: Mar. 4, 2004; copyright 2004.
The STEP2 Company; *LifeScapes Storage Shed*; date created: Feb. 2, 2004; date modified: Mar. 4, 2004; copyright 2004.
Thinking Outside, L.L.C.; *Bill of Materials for SmartShed Deluxe Plus*; date created: Apr. 16, 2004; date modified: Apr. 16, 2004.
Thinking Outside, L.L.C.; *Bill of Materials for SmartShed Deluxe*; date created: Apr. 2, 2004; date modified: Apr. 2, 2004.
Thinking Outside, L.L.C.; *Bill of Materials for SmartShed Extension Unit*; date created: Apr. 16, 2004; date modified: Apr. 16, 2004.
Thinking Outside, L.L.C.; *Bill of Materials for SmartShed Utility*; date created: Apr. 2, 2004; date modified: Apr. 2, 2004.
Thinking Outside, L.L.C.; *SmartShed Outdoor Storage Chest Parts List*; date created: Aug. 17, 2004; date modified: Aug. 18, 2004.
US Polymers Inc.; *DuraMax Storage Shed Owner's Manual/Instructions for Assembly Size; 10'×8' Ver: 2.0*; date created: Jan. 3, 2004; date modified: Jan. 3, 2004.
US Polymers Inc.; *DuraMax Storage Shed Owner's Manual/Instructions for Assembly Size; 8'×6' Ver: 1.2*; date created: Feb. 25, 2003; date modified: Feb. 25, 2003.
US Polymers Inc.; *DuraMax Storage Shed Owner's Manual/Instructions for Assembly Size; 10'×8' Ver: 1.2*; date created: Feb. 26, 2003; date modified: Feb. 26, 2003.
U.S. Appl. No. 11/742,469, filed Apr. 30, 2007, Steed et al.
LifeScapes Storage Building, The Step2 Company, 4 pages, 2004.
LifeScapes Storage House, The Step2 Company, 2 pages, 2004.
LifeScapes Storage Shed, The Step2 Company, 4 pages, 2004.
U.S. Appl. No. 11/742,469, filed Apr. 30, 2007, Steed.
U.S. Appl. No. 11/091,811, filed Mar. 28, 2005, Mower et al.
U.S. Appl. No. 11/091,813, filed Mar. 28, 2005, Mower et al.
U.S. Appl. No. 11/091,837, filed Mar. 28, 2005, Mower et al.
U.S. Appl. No. 11/091,848, filed Mar. 28, 2005, Mower et al.
U.S. Appl. No. 11/091,849, filed Mar. 28, 2005, Mower et al.
U.S. Appl. No. 11/091,606, filed Mar. 28, 2005, Mower et al.
U.S. Appl. No. 11/091,861, filed Mar. 28, 2005, Mower et al.
International Search Report and Written Opinion from PCT/US2005/010749, dated Jul. 9, 2008, 8 pages.
Examination Report from Canadian Patent Application No. 2,525,833, dated Sep. 11, 2008, 2 pages.

* cited by examiner

DOOR ASSEMBLY FOR A MODULAR ENCLOSURE

CROSS-REFERENCE TO RELATED APPLICATIONS

This application is a continuation-in-part of U.S. patent application Ser. No. 10/890,601, which was filed on Jul. 14, 2004, now U.S. Pat. No. 7,210,277.

This application claims priority to and the benefit of U.S. Provisional Patent Application Ser. No. 60/557,369, entitled SHED CONSTRUCTED FROM BLOW-MOLDED PLASTIC, which was filed on Mar. 29, 2004. This application claims priority to and the benefit of U.S. Provisional Patent Application Ser. No. 60/586,387, entitled SHED CONSTRUCTED FROM BLOW-MOLDED PLASTIC, which was filed on Jul. 8, 2004. This application is a continuation-in-part of U.S. Design patent application Ser. No. 29/202,299, entitled SHED, which was filed on Mar. 29, 2004, now U.S. Pat. No. D506,267. This application is a continuation-in-part of U.S. Design patent application Ser. No. 29/202,291, entitled SHED CONSTRUCTED FROM BLOW-MOLDED PLASTIC, which was filed on Mar. 29, 2004, now U.S. Pat. No. D506,266. This application is a continuation-in-part of U.S. Design patent application Ser. No. 29/202,267, entitled EXTERIOR SURFACE OF A SHED, which was filed on Mar. 29, 2004, now U.S. Pat. No. D505,497. This application is a continuation-in-part of U.S. Design patent application Ser. No. 29/202,397, entitled DEVICE FOR ATTACHING PEGBOARD TO A SURFACE, which was filed on Mar. 29, 2004, now abandoned. This application is a continuation-in-part of U.S. Design patent application Ser. No. 29/204,812, entitled EXTERIOR PORTION OF A SHED, which was filed on May 3, 2004, now U.S. Pat. No. D506,011. This application is a continuation-in-part of U.S. Design patent application Ser. No. 29/204,811, entitled EXTERIOR PORTION OF A SHED, which was filed on May 3, 2004, now U.S. Pat. No. D506,268.

Each of these applications and patents is expressly incorporated by reference in its entirety.

BACKGROUND OF THE INVENTION

1. Field of the Invention

The invention generally relates to enclosures and, in particular, to modular enclosures.

2. Description of Related Art

Many types of enclosures are used for storing various items such as tools, machines, lawn care equipment, recreational equipment, athletic equipment, supplies and the like. Conventional storage enclosures often include walls, a door, a floor and a roof. The walls, door, floor and roof of typical storage enclosures often include one or more parts that are interconnected. The walls, door, floor and roof may then be attached to form the enclosure.

A well known type of storage enclosure is a shed. Conventional sheds are typically relatively small structures that may be either freestanding or attached to another structure, and sheds are often used for storage and/or shelter. Disadvantageously, conventional sheds often require a substantial amount of time, labor, skill and effort to build and construct. Conventional sheds may include one or more windows or vents to allow light and air to enter the shed. The windows and vents of many conventional sheds, however, often require a number of interconnected components and are difficult to manufacture and install. Additionally, many conventional sheds are difficult to repair, modify, change or rearrange because the sheds may be difficult or impossible to disassemble or dismantle. Accordingly, it is often impractical or unfeasible to move or reconfigure many conventional sheds.

Conventional sheds are often constructed from wood. Wooden sheds, however, are relatively heavy and require a large amount of time to construct and assemble. In particular, wooden sheds are frequently constructed from a large number of support beams, trusses, sidewalls and roof panels that are connected by a large number of screws or bolts. These numerous parts typically increase the costs of the shed and require a large amount of time and effort to construct the shed. In addition, wooden sheds typically deteriorate over time and often require continual maintenance. For example, conventional wooden sheds may be damaged by rotting or otherwise deteriorating when exposed to the elements. In addition, the wood may warp or decay over time. In order to help protect the wood from being damaged, conventional sheds must be periodically painted, stained or otherwise finished. Undesirably, this may result in significant maintenance costs.

Known sheds may also be constructed from metal. For example, the roof and walls of conventional metal sheds may be constructed from sheet metal. Disadvantageously, the sheet metal is often flexible and easily damaged. In particular, the sheet metal walls may be damaged by forces being applied to either the inner or outer walls of the shed. In particular, this may cause the walls to undesirably bow inwardly or outwardly and, in some circumstances, may create an opening in the wall. Significantly, the damaged sheet metal may be more susceptible to rust or corrosion and the damaged sheet metal may be very difficult to repair or replace. In addition, conventional metal sheds often require a plurality of screws or bolts to assemble the shed, which may increase manufacturing costs and the time required to assemble the shed. Moreover, metal sheds often have a tendency to rust and deteriorate over time, especially when exposed to the elements. Thus, metal sheds may have to be painted or otherwise protected from rusting or oxidation.

The materials used to construct conventional sheds are often heavy and bulky. For example, many conventional sheds have a length of 8 to 12 feet (2.4 to 3.7 meters), and a width of 8 to 12 feet (2.4 to 3.7 meters). In particular, known sheds are often 8 feet by 8 feet (2.4 by 2.4 meters), 8 feet by 10 feet (2.4 by 3 meters), 8 feet by 12 feet (2.4 by 3.7 meters), 10 feet by 12 feet (3 by 3.7 meters) or 12 feet by 12 feet (3.7 by 3.7 meters). Thus, the components used to constructed these sheds are often elongated and may have a length of 6 feet (1.8 meters) or more and a width of 2 feet (0.6 meters) or greater. Accordingly, many of the components are large and bulky. In addition, if these components are constructed from wood or metal, then the components may be very heavy. Thus, the components of conventional sheds may be large, awkward, heavy and generally unwieldy.

Many conventional sheds are shipped in an unassembled configuration because of their large size in the assembled configuration. The weight of the components, however, may result in significant shipping expenses and those expenses may be compounded every time the shed is transported or shipped. For example, there may be significant costs when the manufacturer ships the shed to the retailer, which the consumer may ultimately have to pay. Many consumers may have to pay more to have the shed delivered from the retailer because of the weight of the packaging. In addition, many consumers may be unwilling or unable to purchase these conventional sheds because they have no practical way of taking the shed home. Specifically, many consumers are unable to lift or move the packaging of many conventional sheds. In particular, the consumer may also have to rent or borrow a forklift to load and unload the scourage m vehicle. Accordingly, these large costs and difficulties in transportation may discourage many potential consumers from purchasing conventional sheds.

In addition to conventional sheds being constructed from heavy and bulky materials and components, conventional sheds are often shipped in very large and heavy boxes. These gigantic shipping boxes often will not fit in a typical retail consumer's vehicle. Accordingly, the consumer may have to rent or borrow a vehicle, such as a truck, to take the shed home.

In greater detail, a conventional shed having a width of 10 feet (3 meters), a length of 8 feet (2.4 meters) and a height of 7 feet (2.1 meters) that is constructed from polyvinylchloride (PVC) plastic is shipped in a box having a length of 96 inches (2.4 meters), a width of 48 inches (1.2 meters) and a height of 36 inches (0.9 meters). Thus, the packaging has a volume of 96 cubic feet (2.7 cubic meters). Another known shed, which is constructed from blow-molded and injection-molded plastic, has a width of 7 feet (2.1 meters), a length of 7 feet (2.1 meters) and a height of 8 feet (2.4 meters) is shipped in a box that has a length of 78 inches (2 meters), a width of 48 inches (1.2 meters) and a height of 32 inches (0.8 meters). This packaging has a volume of 69.3 cubic feet (2 cubic meters). Still another known shed, which is constructed from roto-molded plastic and plastic coated aluminum, has a width of 7 feet (2.1 meters), a length of 7 feet (2.1 meters) and a height of 8 feet, 8 inches (2.6 meters) is shipped in a box that has a length of 100 inches (2.5 meters), a width of 55 inches (1.4 meters) and a height of 50 inches (1.27 meters), and this packaging has a volume of 159.1 cubic feet (4.5 cubic meters) and a weight of 540 pounds (245 kilograms) including the packaging. Still yet another known shed, which is constructed from injection-molded plastic, has a width of 7 feet (2.1 meters), a length of 7 feet (2.1 meters) and a height of 7.5 feet (2.3 meters) is shipped in a box that has a length of 96 inches (2.4 meters), a width of 48 inches (1.2 meters) and a height of 46 inches (1.17 meters). This packaging has a volume of about 69.3 cubic feet (1.9 cubic meters) and a weight of 350 pounds (159 kilograms) including the packaging. A further known shed that is constructed from blow-molded plastic has a width of 7 feet (2.1 meters), a length of 15.5 feet (4.7 meters) and a height of 6.5 feet (2 meters) is shipped in a box that has a length of 96 inches (2.4 meters), a width of 48 inches (1.2 meters) and a height of 48 inches (1.2 meters), and this packaging has a volume of 128 cubic feet (3.6 cubic meters) and a weight of 548 pounds (249 kilograms) including the packaging. Another conventional shed is constructed from roto-molded plastic and it has a width of 5.5 feet (1.7 meters), a length of 6 feet (1.8 meters) and a height of 6.5 feet (2 meters). This known shed is shipped in packaging having a length of 77 inches (1.96 meters), a width of 38 inches (0.96 meters), a height of 12 inches (0.3 meters) and a weight of 248 pounds (112 kilograms). Still another conventional shed is constructed from extruded polypropylene and it has a width of 8 feet (2.4 meters), a length of 6 feet (1.8 meters) and a height of 7 feet (2.1 meters). This shed is shipped in packaging having a length of 78 inches (2 meters), a width of 30 inches (0.76 meters), a height of 33 inches (0.84 meters) and a weight of 318 pounds (144 kilograms). Yet another conventional shed is constructed from thermo-formed ABS plastic and it has a width of 8 feet (2.4 meters), a length of 8 feet (2.4 meters) and a height of 6 feet (1.8 meters). This shed is shipped in packaging having a length of 66 inches (1.68 meters), a width of 39.5 inches (1 meter), a height of 15 inches (0.38 meters) and a weight of 325 pounds (147 kilograms). Accordingly, the size and weight of many known sheds is substantial, which may greatly complicate and increase the costs of shipping.

Because conventional sheds are shipped in boxes that have such a large size and volume, fewer sheds may be shipped in standard shipping containers or in commercial trailers. Accordingly, the shipping costs per shed (such as, from a supplier to a retailer) can be significantly increased. Also, because these packaged sheds are so large and heavy, many shippers may find it difficult to efficiently deliver the sheds and may refuse to ship the sheds. In addition, because many conventional packaged sheds are so large and heavy, they typically must be shipped to consumers using freight shippers, which may charge even more for these heavy, large and awkward boxes. In some instances, this cost may be simply too large for a customer to justify the purchase.

Known storage sheds are also typically constructed of a variety of awkwardly shaped components, which can be difficult to ship and can be susceptible to damage if shipped. In order to ship and protect these awkwardly shaped components, large amounts of packaging materials may be required. The packing material, however, takes additional space in the packaging and the packing material increases the shipping costs. In addition, because the components may be awkwardly shaped, custom packing materials may be required and the packing material may be irreparably damaged during shipping. Thus, the packing material may not be reusable and may create a significant amount of waste. Further, it may require a significant amount of time to prepare these awkward components for shipping, and this may increase labor costs and decrease manufacturing efficiency. Finally, the awkwardly shaped components often consume a large amount of area, which may increase the overall volume required to ship the shed and that may correspondingly increasing shipping costs.

Conventional sheds are also often constructed from a variety of interconnected components that form a number of joints or seams. Disadvantageously, these seams or joints are often susceptible to leaks. For example, the seams or joints may allow water to enter the shed and the water can damage whatever is stored within the shed.

In addition, many sheds are subjected to a variety of adverse weather conditions and some conventional sheds may be damaged if they are constructed from weak materials or poorly assembled. For example, conventional sheds may be damaged by heavy winds. Known sheds may also have a flat or slightly sloped roof, which may allow snow to collect on the roof. Undesirably, the snow may damage the roof and, in extreme circumstances, may cause the roof to collapse. The flat roofs may also allow water and other objects to collect on the roof, which may damage the roof and/or leak through the roof and into the shed.

BRIEF SUMMARY OF THE INVENTION

A need therefore exists for an enclosure that eliminates the above-described disadvantages and problems.

One aspect is an enclosure that may be constructed from a number of components. At least some of the components may be interchangeable and the enclosure may be a modular enclosure.

Another aspect is an enclosure that may be part of a kit. The kit, for example, may include a number of components that may be interchangeable and/or interconnected. The components may also be part of a group and/or be available individually or separately.

Still another aspect is an enclosure that may include one or more components that may be interconnected to form a structure. The structure may include walls, roof, floor, etc. and these components can be connected. Preferably, the components can be relatively quickly and easily connected and disconnected. Advantageously, this may allow the components to be easily reconfigured, repaired and/or replaced. In addition, this may allow the structure to be easily moved, reused and the like.

Yet another aspect is an enclosure that may be used in a variety of different situations and environments. For instance, the enclosure may be used for storage and/or to protect items from the elements. In particular, the enclosure may be a shed, but it will be appreciated that the enclosure may have a much wider applicability and may be used for a number of different purposes. Thus, while the enclosure may be illustrated and described in connection with a shed, the enclosure could have other suitable arrangements, configurations, designs, purposes and the like.

A further aspect is an enclosure, such as a shed, that may be at least partially constructed from relatively lightweight materials such as blow-molded plastic. The blow-molded plastic components may be constructed from polyethylene with ultraviolet (UV) additives or inhibitors, if desired, but other suitable plastics and materials may be used to construct the shed. Advantageously, the blow-molded plastic components may provide superior weathering and durability because, for example, the blow-molded plastic may be able to withstand the elements and it is generally impact resistant. In addition, the blow-molded plastic components may be easy to clean and virtually maintenance free. For example, painting and finishing of the blow-molded plastic is not required. Further, the blow-molded plastic may include two walls that are separated by a distance. The double walls may create air pockets that help insulate the shed. Further, blow-molded plastic generally does not rust or otherwise deteriorate over time, and the blow-molded plastic is rodent and insect resistant. Thus, constructing at least a portion of the shed from blow-molded plastic may allow the shed to be used in a wide variety of situations and environments.

A still further aspect is a shed that is at least substantially constructed from blow-molded plastic. Advantageously, at least a portion of the walls, roof, floor and/or doors may be constructed from blow-molded plastic. The gables, corners and other portions of the shed may also be constructed from blow-molded plastic. Significantly, the blow-molded plastic components may include finished interior and exterior surfaces. For example, the exterior surface could include one design or pattern and the interior surface could include another design or pattern. Advantageously, the patterns on the opposing surfaces may include discrete points of intersection and depressions, which may be sized and configured to increase the strength and/or rigidity of the components, may be located at those points. In particular, because the patterns may extend inwardly, that may decrease the size and/or height of the depressions located at the points of intersection.

Another aspect is a shed that may be constructed from lightweight materials so that the shed can be easily transported and shipped. In addition, the shed is preferably constructed from lightweight materials so that a consumer can transport the shed and more easily assembly the shed.

Yet another aspect is a shed that may be sized and configured to be shipped and transported in relatively small sized packaging. Desirably, the components of the shed are sized and configured to fit within a limited area so that the size of the packaging is decreased or minimized. For example, a shed with a length of about 10 feet (3 meters), a width of about 8 feet (2.4 meters) and a height of about 8 feet (2.4 meters) is preferably sized and configured to fit within one package that is about 94 inches (2.38 meters) in length by about 31 inches (0.8 meters) in width by about 12 inches (0.3 meters) in height and a second package that is about 72 inches (1.8 meters) in length by about 31 inches (0.8 meters) in width by about 12 inches (0.3 meters) in height. This significantly decreases the size of the packaging in comparison to the packaging of conventional sheds.

Still another aspect is a shed that may include components constructed from plastic, such as high density polyethylene, and the plastic components may provide sufficient strength and rigidity to allow a strong and sturdy structure to be created. As discussed above, various components of the shed may be constructed from blow-molded plastic, but other processes such as injection molding, rotary molding, compression molding and the like may also be used to construct the various components of the shed. Advantageously, the blow-molded plastic components are desirably designed to create rigid, high-strength structures that are capable of withstanding repeated use and wear. Significantly, the blow-molded plastic components may be easily manufactured and formed into the desired size and shape. In addition, the blow-molded plastic components can form structural elements of the shed to minimize the number of parts required to construct the shed. Further, the blow-molded plastic components may be easily interconnected and disconnected, and the blow-molded plastic components may be simply and easily assembled and/or disassembled with minimum effort and tools. It will be appreciated that frames, braces, other support members, fasteners and the like may also be used to support and construct the shed, if desired.

Advantageously, the shed may be relatively simple to manufacture because one or more of the components constructed from blow-molded plastic. In addition, one or more features may be integrally formed in the blow-molded plastic components, such as a window or window frame. The blow-molded plastic components may by strong and lightweight because the components may include two opposing walls that are spaced apart by a relatively small distance. In addition, the blow-molded plastic components may include one or more depressions, connections or tack-offs that may interconnect the opposing surfaces and these depressions may further increase the strength of the components. Further, the blow-molded plastic components can desirably be formed in various shapes, sizes, configurations and designs, which may allow an attractive and functional shed that is available in a variety of configurations and sizes to be constructed.

Another aspect is a shed that may be quickly and easily assembled, which may reduce manufacturing and labor costs. For example, this may allow the manufacturer to quickly and easily assemble the shed. In addition, this may allow the manufacturer to ship the shed in an unassembled configuration and the consumer may quickly and easily assembly the shed. Advantageously, shipping the shed in the unassembled configuration may reduce manufacturing and shipping costs.

Yet another aspect is a shed that may contain one or more different types of connections between various components. For example, one or more of the walls may include a living hinge and that may allow the corners of the shed to be formed. In addition, the roof top or cap, skylights, door, gables and/or shelves may also include one or more living hinges. Advantageously, the living hinges may allow the shed to be quickly and easily assembled. In addition, the living hinges allow these components to be moved between a generally flat or planar position and a folded or angled position. Significantly, these components may be efficiently packed and shipped in the generally planar configuration, which may significantly decrease the size of the packaging. The living hinges are also generally impervious to the elements, such as wind or rain, which may increase the potential uses of the shed. Further, the living hinges may increase the strength and/or rigidity of the structure and/or the connection of the various components.

Still another aspect is a shed that may include one or more skylights. The skylights are preferably located in the roof of the shed and, in particular, in the roof cap. The skylights are preferably constructed from injection molded plastic and, as discussed above, the skylights may include a living hinge. The skylights may be permanently fastened to the shed or at least a portion of the skylights may be selectively attached to the shed to form a vent or opening.

A further aspect is a shed that may include one or more doors that are preferably constructed from blow-molded plastic. The doors may include a rod or tube that preferably extends that entire length of the door to provide an upper and lower pivot point. Advantageously, the rod or tube may also increase the strength and/or rigidity of the door. The door may also include an outwardly extending flange or projection, which may be positioned proximate the rod or tube, that may help create a seal for the door.

A still further aspect is a shed that may include a door handle that allows the door to be more easily opened and closed. The handle may also allow the door to be locked, if desired. The handle may be connected to a metal strip or member that is located proximate the outer edge of the door. The metal strip may extend the length of the door and it may reinforce and/or stiffen the door. In addition, the metal strip may increase the mass or weight of the door, which may allow the door to be more easily opened and closed. The increased mass or weight may also improve the feel of the door when it is being opened or closed. The door may also include an end piece and the metal strip may be disposed between the end piece and the door.

Another aspect is a shed that may include a plurality of panels that are interconnected. For example, the shed may include one or more floor panels, wall panels and/or roof panels that are interconnected. Preferably, the floor panels, wall panels and/or roof panels are connected to adjacent floor panels, sidewalls and/or roof panels, respectively, with one or more overlapping portions to help securely connect the panels or walls. In particular, the panels may include one or more extensions, flanges, projections, protrusions, etc., that extend outwardly from one panel and overlap with one or more receiving portions, notches, grooves, openings, etc. in the adjacent panel. Advantageously, this may allow the panels to be interconnected. The overlapping portions may be connected by fasteners, such as screws or bolts, or adhesives to help secure the panels together. Significantly, the overlapping portions may help prevent rain, snow, sunlight, foreign objects and the like from undesirably entering the shed.

Yet another aspect is a shed that may include interconnected floor panels, interconnected wall panels and interconnected roof panels. Desirably, the connections between adjoining floor panels are not aligned with the connections of adjoining wall panels. In addition, the connections of the adjoining wall panels are not aligned with the connections of the adjoining roof panels. Thus, the connections of the floor panels are preferably offset from the connections of the wall panels, and the connections of the wall panels are preferably offset from the connections of the roof panels. The floor panel connections are preferably offset from the wall panel connection by a distance, and the wall panel connections are preferably offset from the roof panel connection by a distance, but it will be appreciated that these connections may also be aligned at different angles or otherwise offset. Advantageously, the offset connections may allow a strong and sturdy shed to be constructed. Additionally, the connections of the floor panels may be generally vertically aligned with the connections of the roof panels, but these connections may also be offset. Further, the offset connections may allow the size of the shed to be changed while still allowing a strong and rigid shed to be constructed.

Still another aspect is a shed that may include one or more floor panels, wall panels and/or roof panels, and one or more of these panels may be reinforced. For example, the floor, wall or roof panels may be constructed from blow-molded plastic and one or more reinforcing members may be disposed within the panels. Advantageously, the reinforcing members may increase the strength and/or rigidity of the panels. In addition, the reinforcing members may be encapsulated within the panels, which may protect the reinforcing members from the elements.

A further aspect is a shed that may include sidewalls that are directly connected to the floor. For example, the sidewalls may contain one of more protrusions or projections and the floor may include one or more openings or receiving portions. The projections may be inserted into the receiving portions to securely connect the sidewalls to the floor. Advantageously, this may allow the sidewalls to be connected to the floor by a friction, interference and/or snap fit connection, if desired. The sidewalls and floor may also be connected by one or more fasteners, such as screws or bolts, if desired.

A still further aspect is a shed that may include a roof that is directly connected to the sidewalls. Preferably the roof is connected to the sidewalls so that there is an overhang of the roof to the sidewalls. Advantageously, this may allow water to run off the roof to the ground without contacting the sidewalls, which may help prevent water leaks and the water from marring or damaging the sidewalls. The roof and sidewalls may be connected, for example, by one or more interlocking pieces such as a tongue and groove arrangement. The roof and sidewalls may also be connected by one or more fasteners, such as screws or bolts, if desired.

Yet another aspect is a shed that may include a gable and the gable may be connected to the sidewalls and the roof. In particular, the gable may be connected to the sidewalls and/or roof by one or more interlocking pieces such as a tongue and groove arrangement. The gable may also be connected to the sidewalls and/or roof by one or more fasteners, such as screws or bolts, if desired. The gable may also be connected to the sidewalls and/or roof by one or more tabs. The tabs, for example, may be formed as part of the gable and may be pivotally attached to the gable by a living hinge. The tabs could be connected to the sidewalls or roof by a fastener such as a screw or bolt.

A further aspect is a shed that may include roof trusses constructed from metal. In particular, the shed may include trusses that are constructed from metal and have a generally A-frame type configuration. Advantageously, the metal roof truss may be used in connection with panels constructed from blow-molded plastic to create a strong and durable roof. The roof truss may assist in connecting the roof panels to the shed and the truss may be sized and configured to allow any water or moisture that passes between the roof panels to be drained from the shed.

A still further aspect is a shed that may include a roof cap that is disposed at the top of the roof. The roof cap is preferably constructed from blow-molded plastic and it may include a living hinge that allows a portion of the roof cap to be disposed on each side of the roof. Advantageously, the roof cap may help prevent water or moisture from entering the shed. The roof cap may also include one or more openings that are sized and configured to allow skylights to be attached to the shed.

Yet another aspect is a shed that may include one or more windows. The windows, for example, may be for aesthetic reasons and/or to allow light to enter the shed. The windows may include a frame that is integrally formed in a sidewall of the shed and the frame may include opposing grooves or slots into which a polycarbonate or acrylic sheet may be disposed. Preferably, the polycarbonate or acrylic sheet is slidably disposed within the grooves or slots to allow the window to be opened and closed. The window may also include a locking mechanism to lock the window and the window may be sized and configured to allow it to be partially opened, if desired.

Still another aspect is a shed that may allow pegboard, tool holders and the like to be attached. For example, the shed may include one or more receiving portions that are sized and configured to allow attachment members to be attached. The attachment members may be constructed from plastic, such as injection molded plastic, and attachment members may include a base that is sized and configured to be attached to the receiving portions. If desired, the attachment members may be attached to the receiving portions by a friction, interference or snap fit.

Another aspect is a shed that may include one or more shelves. For example, a shelf may be attached to the rear wall of the shed and the shelf may extend from one sidewall to the opposing sidewall. Advantageously, if the shelf extends from one sidewall to the opposing sidewall, then the shelf may be connected to the sidewalls and/or the rear wall, which may increase the strength and/or rigidity of the shed. A shelf may also be connected to a corner, and that may further increase the strength and/or rigidity of the shed. The shelves, however, could be attached to any desired portion of the shed. In addition, the shelves may include living hinges that allow the shelves to be securely attached to the shed.

Yet another aspect is a shed that may include one or more vents. The vents preferably allow air to circulate within the shed and the vents may be constructed from injection molded plastic. The vents may be connected to any suitable portions of the shed, such as the gables, and the vents may be quickly and easily connected to an opening that is integrally formed in the gable. Advantageously, the vents may be connected to the gables by a friction, snap or interference fit, and/or the vents may be connected to the shed by fasteners or adhesives, if desired. The vent may also include a screen or other type of partition to help prevent foreign objects from undesirably entering the shed.

Another aspect is a door assembly for a shed that may include a door constructed from blow-molded plastic, the door including an upper portion, a lower portion, a first side and a second side; a hinge member receiving portion disposed on a first side of the door, the hinge member receiving portion being integrally formed with the door as part of a unitary, one-piece construction; a hinge member disposed within the hinge member receiving portion, the hinge member pivotally connecting the door to the shed; a first reinforcement member constructed from metal and disposed proximate the second side of the door, the reinforcement member being at least partially exposed on an outer surface of the door; and a handle disposed proximate the second side of the door, the handle being sized and configured to facilitate opening and closing of the door. The door assembly may also include a flange that extends outwardly from the hinge member receiving portion, the flange being sized and configured to prevent water from unintentionally entering the shed. In addition, the door assembly may include a second reinforcement member that is disposed proximate the second side of the door, the second reinforcement member being at least substantially disposed within the door.

Yet another aspect is a door assembly for a shed that may include a door constructed from blow-molded plastic, the door including an upper portion, a lower portion, a first side and a second side, the door being sized and configured to move between an open position and a closed position; a hinge member disposed proximate the first side of the door, the hinge member being sized and configured to allow the door to pivot relative to the shed; a locking member disposed proximate the second side of the door, the locking member being movable between a first position in which the door may be secured in the closed position and a second position in which the door may be freely opened; a first securing portion disposed proximate an upper portion of the locking member, the first securing portion being sized and configured to contact a portion of the roof when the locking member is in the first position to assist in securing the door in the closed position; and a second securing portion disposed proximate a lower portion of the locking member, the second securing portion being sized and configured to contact a portion of the floor when the locking member is in the first position to assist in securing the door in the closed position. The door assembly may include a latch plate with a receiving portion that is connected to the floor and the second securing portion may be disposed within the receiving portion of the latch plate when the locking member is in the first position. The door assembly may also include a first reinforcement member that is constructed from metal and disposed proximate the second side of the door, and the reinforcement member may be at least partially exposed on an outer surface of the door. In addition, the door assembly may include a second reinforcement member that is disposed proximate the second side of the door, and the second reinforcement member may be at least substantially disposed within the door.

Still another aspect is a door assembly for a shed that may include a wall panel that is constructed from blow-molded plastic; a door panel constructed from blow-molded plastic and positioned proximate the wall panel, the door panel including a first side and a second side; a seam disposed between the wall panel and the door panel; and a flange outwardly extending from the first side of the door panel, the flange being integrally formed with the door panel as part of a unitary, one-piece structure, the flange being sized and configured to cover at least a portion of the seam to help prevent water from entering the shed. The door assembly may also include a first reinforcement member constructed from metal and disposed proximate the second side of the door, the reinforcement member being at least partially exposed on an outer surface of the door; and a second reinforcement member disposed proximate the second side of the door, the second reinforcement member being at least substantially disposed within the door.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

Before describing preferred and other exemplary embodiments in greater detail, several introductory comments regarding the general applicability and scope of the invention may be helpful.

First, the following detailed description of preferred and other exemplary embodiments is generally directed towards an enclosure such as a storage enclosure. It will be appreciated that the storage enclosure may be used to temporarily and/or permanently store a variety of items, objects, devices and the like depending, for example, upon the intended use of the enclosure. The principles of the present invention, however, are not limited to storage enclosures. It will be understood that, in light of the present disclosure, the enclosures disclosed herein can have a variety of suitable shapes, arrangements, configurations and the like; and that the enclosures can be used for a variety of different functions, purposes and uses.

Second, the enclosures discussed in more detail below and shown in the accompanying figures are illustrated in connection with exemplary and preferred embodiments of a shed. It will be appreciated that the shed can have a wide variety of suitable arrangements and configurations. It will also be appreciated that the enclosure does not have to be a shed and the enclosures can be other types of structures, storage devices, units, enclosures, boxes, bins, containers, recreational equipment enclosures, organizers and the like. In addition, the size and dimensions of the shed and its various components can be varied depending, for example, upon the intended use and/or desired purpose of the shed.

Third, the particular materials used to construct preferred and exemplary embodiments of the shed are illustrative. For example, as discussed in greater detail below, blow-molded plastic is preferably used to construct various portions of the shed, such as floor panels, wall panels, door panels and/or roof panels. It will be understood, however, that other materials can be used such as thermoplastics, resins, polymers, acrylonitrile butadiene styrene (ABS), polyurethane, nylon, composites and the like. It will also be understood that other suitable processes may be used to construct these various components, such as extrusion molding, injection molding, vacuum molding, rotational molding and the like. Further, it will be understood that these and other components of the shed can be made from other materials such as metal (including steel, aluminum, etc.), wood and the like.

Further, to assist in the description of the shed, words such as upper, lower, top, bottom, front, back, right and left are used to describe the accompanying figures. It will be appreciated, however, that the shed can be located in a variety of desired positions, angles and orientations. A detailed description of the shed now follows.

Figure 1:
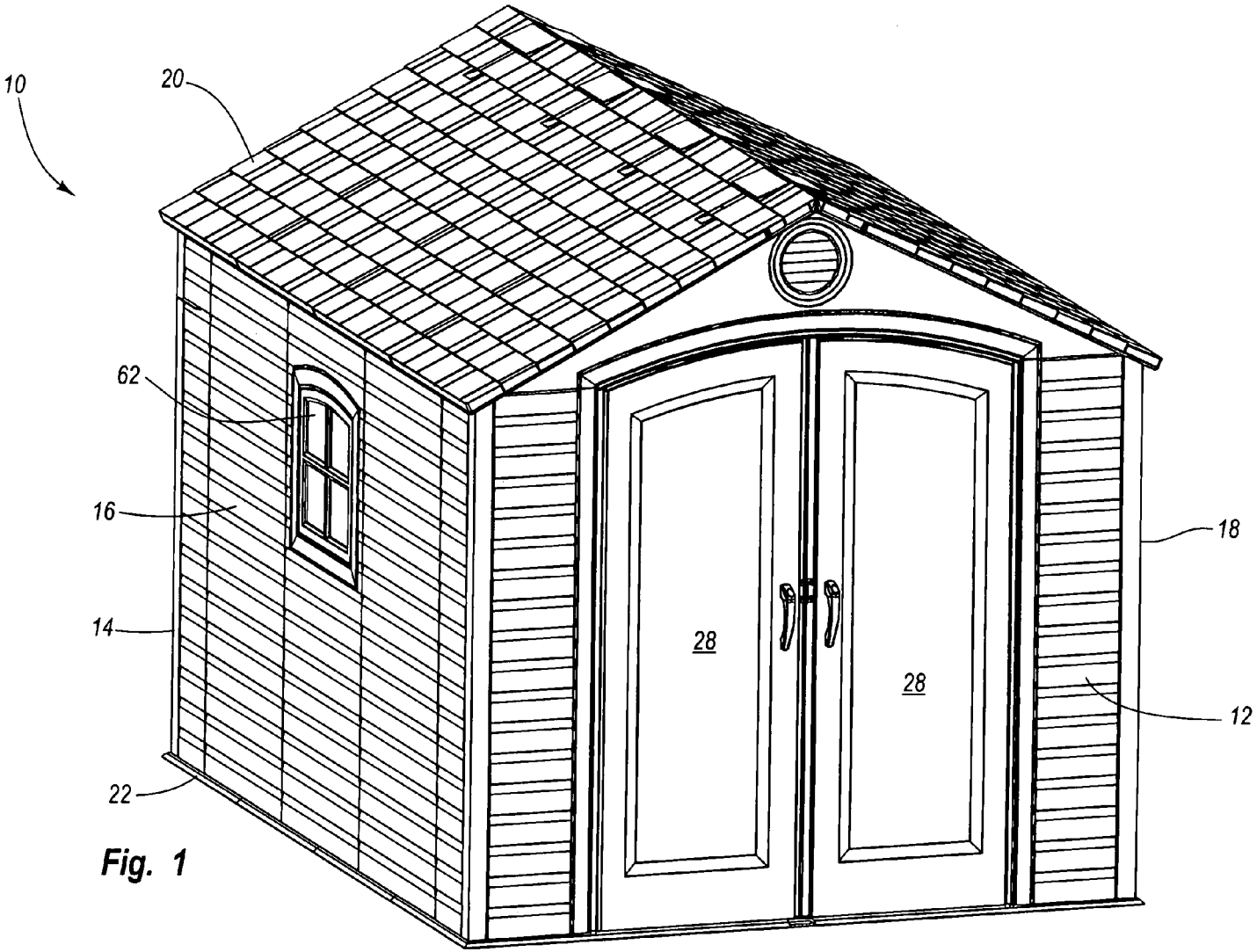
FIG. 1 is a front perspective view of an exemplary embodiment of a shed.
Figure 2:
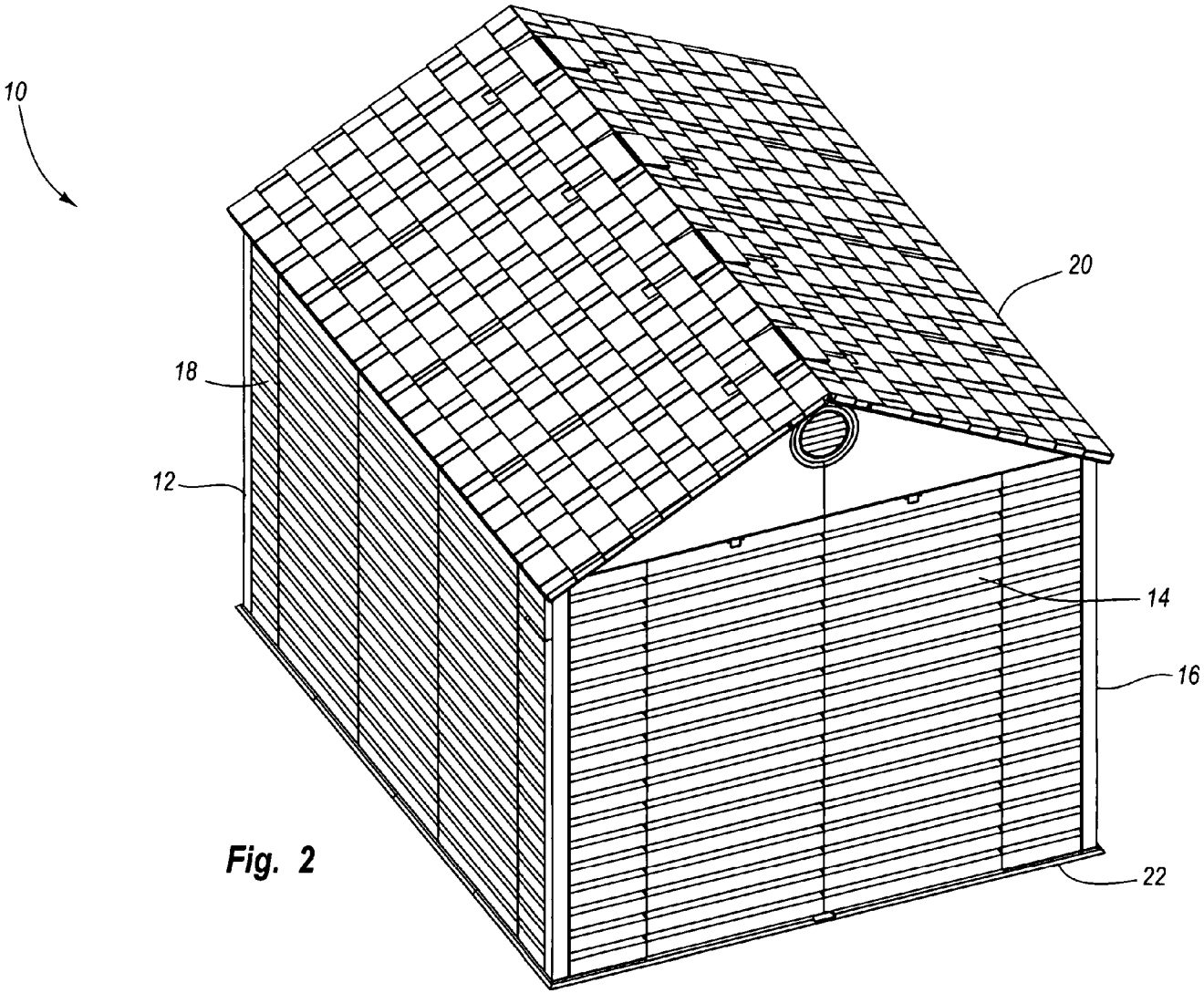
FIG. 2 is a rear perspective view of the shed shown in FIG. 1.

As shown in FIGS. 1 and 2, an exemplary embodiment of the shed 10 includes a front wall 12, a rear wall 14, a left sidewall 16 and a right sidewall 18. The shed 10 also includes a roof 20, a floor 22 and doors 28. As shown in the accompanying figures, the edges of the roof 20 may overhang the left and right sidewalls 16, 18. Advantageously, this may allow rain to run off the roof without contacting the sidewalls. In addition, the edges of the roof 20 may overhand the front and rear walls 12, 14, which may also allow rain to run off the roof without contacting the front or rear walls. Further, the floor 22 may extend beyond the walls 12, 14, 16, 18 and the outer edges of the floor may be generally aligned with the edges of the roof 20, if desired. All or a portion of the roof 20 may also extend beyond the outer edges of the floor 22 or, if desired, the floor may extend beyond the edges of the roof. The walls 12, 14, 16, 18; roof 20; and floor 22 may also be generally aligned and/or spaced apart depending, for example, upon the intended use or purpose of the shed 10.

As discussed in greater detail below, the shed 10 may be a modular structure with a number of connected and/or interlocking components. The components, for example, may be connected by a snap-fit, interference and/or friction fit; and the components may be connected by one or more connectors or fasteners, such as screws and bolts. The modular structure may allow the same components to be used to form different parts of the shed 10. For example, the walls 12, 14, 16, 18; roof 20 and/or floor 22 may be formed from a number of panels and one or more of the panels may be interchangeable. This may allow the shed 10 to be more easily constructed and it may reduce the number of molds required to make the components. Advantageously, this may also allow the shed 10 to be quickly and easily assembled without a large number of parts or tools. In addition, the modular components may allow the shed 10 to be made with larger or smaller dimensions using generally the same components. This may significantly increase the potential uses of the shed 10.

The shed 10 may also provide a relatively inexpensive enclosure that may be efficiently manufactured, shipped, stored, displayed, transported and the like. The shed 10 may also be sold as a kit or as an assembled structure. In addition, the shed 10 may include components that are sold separately, which may allow a consumer to repair, replace, reconfigure and/or modify the shed. The shed 10 may also be sold according to specified dimensions, but the dimensions may be changed to expand or contract the shed. The shed 10 may also be sold with an expansion kit that is sized and configured to increase the size of As shown in the accompanying figures, the walls 12, 14, 16 and 18 may include a pattern or design. For example, the outer surfaces of the walls 12, 14, 16 and 18 may have textured surfaces and/or the walls may have a pattern that includes blocks, slats, siding and the like. In particular, the front right and front left corners of the shed 10 may include blocks that extend from the floor 22 to the roof 20, and blocks may extend along the left and right sidewalls 16, 18 of the shed. One of ordinary skill in the art will appreciate that the shed 10 can include other suitable patterns and designs to create the structure. For example, as seen in FIGS. 1 and 2, the outer surfaces of the walls 12, 14, 16, 18 may include a generally horizontal pattern that creates the appearance of slats or siding.

Figure 3:
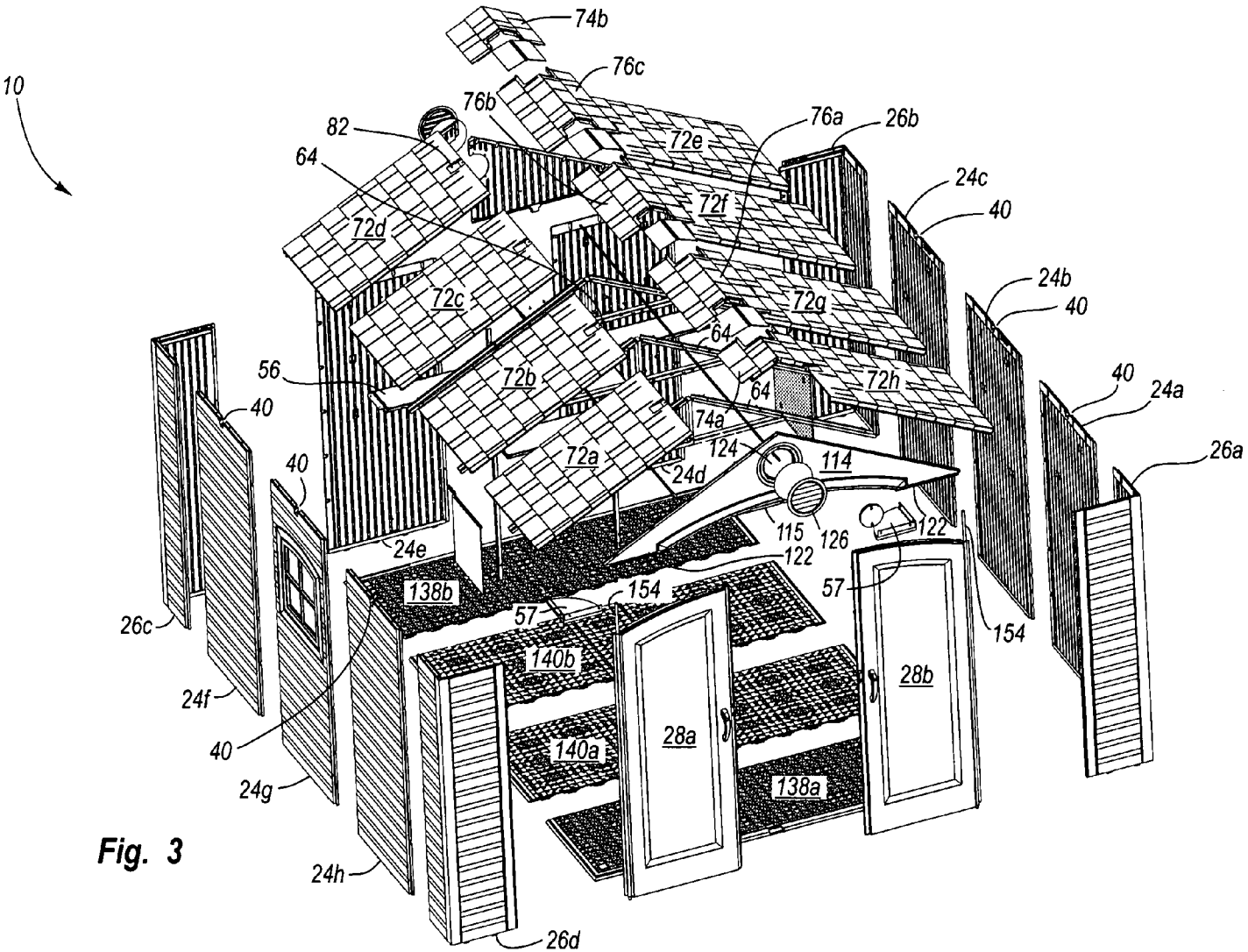
FIG. 3 is an exploded, front perspective view of the shed shown in FIG. 1.
Figure 4:
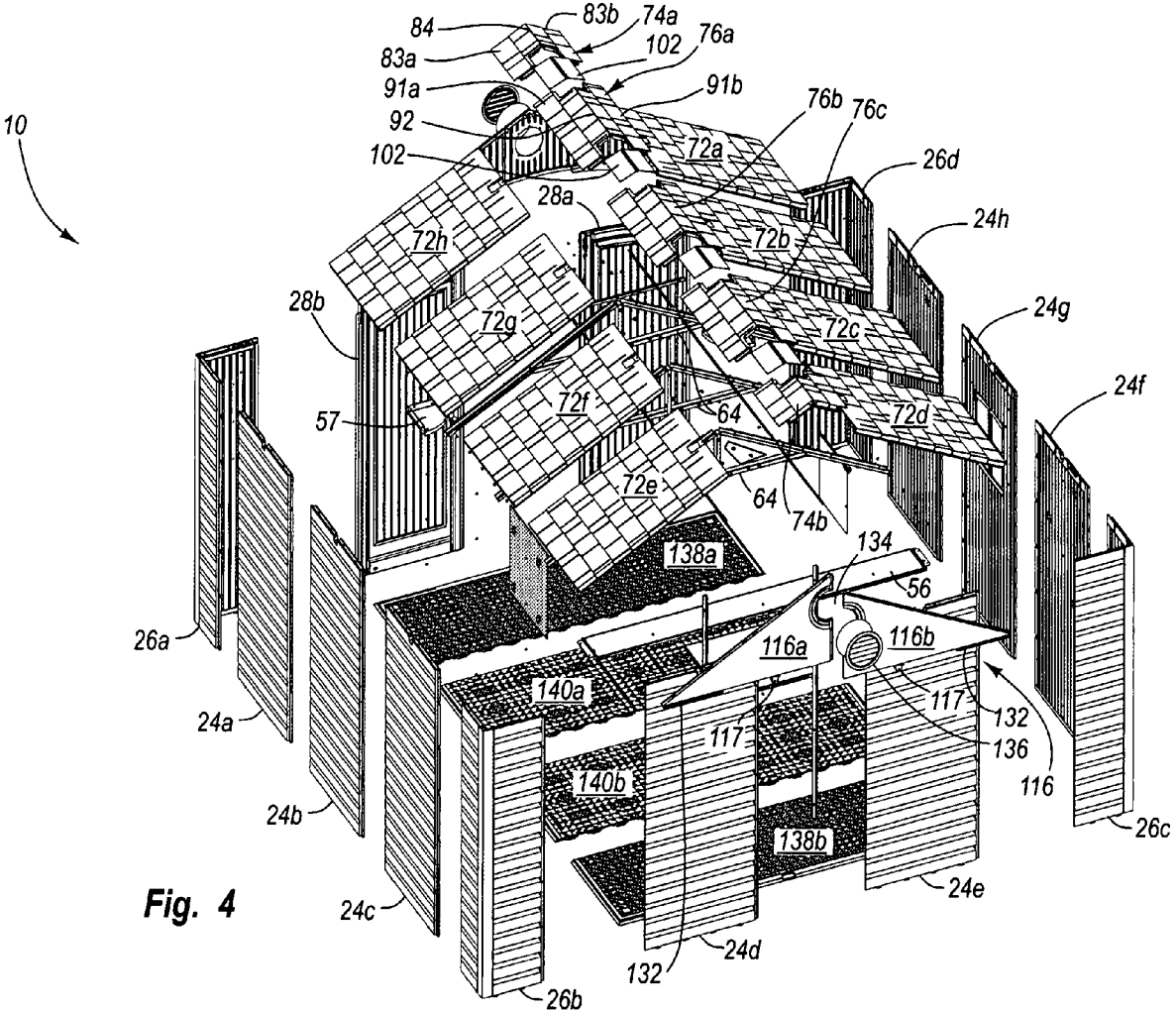
FIG. 4 is an exploded, rear perspective view of the shed shown in FIG. 1.

As shown in FIGS. 3 and 4, the shed 10 is constructed from a number of components that are interconnected to form the shed. In particular, as described in greater detail below, the walls 12, 14, 16, 18 of the shed 10 can be constructed from a number of interconnected panels. Additionally, the roof 20 may include a number of interconnected panels and the floor 22 may also include a number of interconnected panels. It will be appreciated that the number of components used to form the walls 12, 14, 16, 18; roof 20; and floor 22 may depend, for example, upon the size and configuration of the shed 10.

Significantly, the various components may allow the shed 10 to be relatively quickly and easily assembled. This may allow, for example, the manufacturing costs of the shed 10 to be decreased. This may also allow the shed 10 to be shipped in an unassembled configuration and the consumer may be able to quickly and easily assemble the shed. Advantageously, shipping the shed 10 in an unassembled configuration may reduce shipping costs and increase the potential uses of the shed. In addition, as discussed in greater detail below, the components of the shed 10 are preferably generally lightweight and that may also reduce shipping costs and facilitate transportation or shipping of the shed. Further, as discussed in greater detail below, various components of the shed 10 may be sized and configured to minimize the size and shape of the packaging. This may greatly decrease the size of the packaging, which may considerably decrease shipping costs and allow, for example, the consumer to readily transport the shed 10.

Further, while the shed 10 may be shown in the accompanying drawings as having a general size and configuration, it will be appreciated that the shed may be larger, smaller or have other suitable dimensions. In addition, as discussed below, the length of the shed 10 may be increased or decreased, which may significantly expand the potential uses and functionality of the shed.

Various exemplary features and aspects of the shed 10 will now be discussed in more detail. It will be appreciated that the shed 10 does not require all or any of these exemplary features and aspects, and the shed could have other suitable features and aspects depending, for example, upon the intended design, use or purpose of the shed.

Wall Panels & Corner Panels

As shown in FIGS. 3 and 4, the walls 12, 14, 16, 18 may include a number of panels that are interconnected. In particular, the walls 12, 14, 16 18 may include a number of modular panels and one or more of these modular panels may be interchangeable. For example, the walls 12, 14, 16, 18 may be constructed from wall panels 24*a-h* and corner panels 26*a-d*. These wall panels 24*a-h* and corner panels 26*a-d* may be used to construct a shed with a generally rectangular configuration. It will be appreciated, however, that shed could have other suitable configurations such as square, polygonal, triangular, circular and the like. In addition, as discussed in greater detail below, the roof 20 may be constructed from a number of roof panels, the floor 22 constructed from a number of floor panels, and the doors 28 may be constructed from a number of door panels.

In greater detail, the rear wall 14, the left sidewall 16 and the right sidewall 18 may have a generally similar construction in that they may be primarily constructed from wall panels 24 and corner panels 26. For example, the right sidewall 18 may be formed from a portion of the front right corner panel 26*a*, three wall panels 24*a*, 24*b*, 24*c*, and a portion of the right rear corner panel 26*b*. The rear wall 14 may be constructed from another portion of the right rear corner panel 26*b*, two wall panels 24*d*, 24*e*, and a portion of the left rear corner panel 26*c*. Similarly, the left sidewall 16 may be constructed from another portion of the left rear corner panel 26*c*, three wall panels 24*f*, 24*g*, 24*h*, and a portion of the left front corner panel 26*d*.

Each of the wall panels 24*a-h* preferably has a generally rectangular configuration with a height of about 6 feet (1.8 meters) and a width of about thirty inches 30 inches (0.76 meters) to create a shed 10 with a minimum height of about 6 feet (1.8 meters), a length of about 10 feet (3 meters), and a width of about 8 feet (2.4 meters). Advantageously, manufacturing and assembly of the shed may be greatly simplified because each of the wall panels 24*a-h* may have the same size and configuration. It will be appreciated that the wall panels 24 could have other suitable sizes and configurations depending, for example, upon the size and/or intended use of the shed. In particular, the panels could be larger or smaller to create a shed of different dimensions and, as discussed below, additional or fewer panels may be used to change the size of the shed.

The corner panels 26*a-d* desirably include a first portion that is separated by a second portion by a living hinge. Preferably, the living hinge extends from the top to the bottom of the corner panels 26 and it allows the first and second portions to move relative to each other. For example, the living hinge may allow the corner panels 26 to be positioned in a generally flat, planar configuration, which may facilitate shipping. The living hinge may also allow the corner panels 26 to be disposed at an angle to form, for example, a corner of the shed 10. In particular, the living hinge preferably divides the corner panels 26 in half and it allows the corner panels to form a ninety degree or right angle. Significantly, if the living hinge extends the entire length of the corner panel 26, that may help prevent water and foreign objects from undesirably entering the shed 10. In addition, the living hinge may allow a strong and sturdy connection of the first and second portions of the corner panels 26 to be created. It will be appreciated that the corner panels 26 may also include one or more living hinges, which may extend along all or just a portion of the length of the corner panels, and the corner panels could be disposed at other suitable angles. It will also be appreciated that the corner panels 26 do not require living hinges and the corner panels may have other suitable configurations, arrangements, connections and the like.

Each of the corner panels 26*a-d* preferably have the same general configuration, which may help create a modular structure. For example, the corner panels 26*a-d* may have a generally rectangular configuration with a height of about 6 feet (1.8 meters) and a width of about thirty inches 30 inches (0.76 meters) when the panels are in the generally flat, planar configuration. Advantageously, this flat, generally planar configuration may facilitate shipping, transport and/or storage of the shed 10 because the corner panels 26 may be shipped and stored in the generally planar configuration and then simply bent into the desired position for assembly of the shed. In addition, because the corner panels 26 may have generally the same size and configuration as the wall panels 24 in the planar configuration, that may allow the shed to be easily shipped, transported and/or stored. In particular, this may allow the wall panels 24 and corner panels 26 to be stacked and/or positioned adjacent to each other within the packaging. It will be appreciated, however, that the wall and corner panels 24, 26 may be shipped in any desired configuration.

As shown in FIGS. 3 and 4, the wall panels 24 may be connected to a corner panel 26 and/or another wall panel. Advantageously, the same type of connection configuration may be used to connect the wall panels 24 and/or corner panels 26. For example, the left side of each wall panel 24*a-h* may have generally the same configuration and the right side of each wall panels 24*a-h* may have generally the same configuration so that the wall panels 24 can be used interchangeably. In addition, the left side of each corner panel 26*a-d* may have generally the same configuration and the right side of each corner panel 26*a-d* may have generally the same configuration so that the corner panels 26 can be used interchangeably. Such a construction may simplify the manufacturing and assembly of the shed 10. Additionally, the left side of each wall panels 24*a-h* may have generally the same configuration as the left side of each corner panels 26*a-d*, and the right side of each wall panels 24*a-h* may have generally the same configuration as the right side of each corner panels 26*a-d*, which may allow the wall and/or corner panels to be used interchangeably. Further, the right and left sides of the wall and/or corner panels 24, 26 may be generally mirror images and/or include complementary features that allow the panels to be readily connected and disconnected. It will be appreciated, however, that the wall panels 24 and/or corner panels 26 may also have other suitable configurations and arrangements, and the panels do not have to be interchangeable or have the same general configuration.

The wall panels 24*a-h* and/or corner panels 26*a-d* preferably are securely connected to allow a strong and sturdy shed 10 to be constructed. Advantageously, the secure connection of the panels 24, 26 may help prevent inadvertent separation of the panels and may enhance the structural integrity of the shed 10. In addition, a tight-fit between the panels 24, 26 may help prevent water and/or air from undesirably entering the shed 10. Further, the secure connection of the panels 24, 26 may prevent undesirable movement of panels and other portions of the shed 10.

Figure 6:
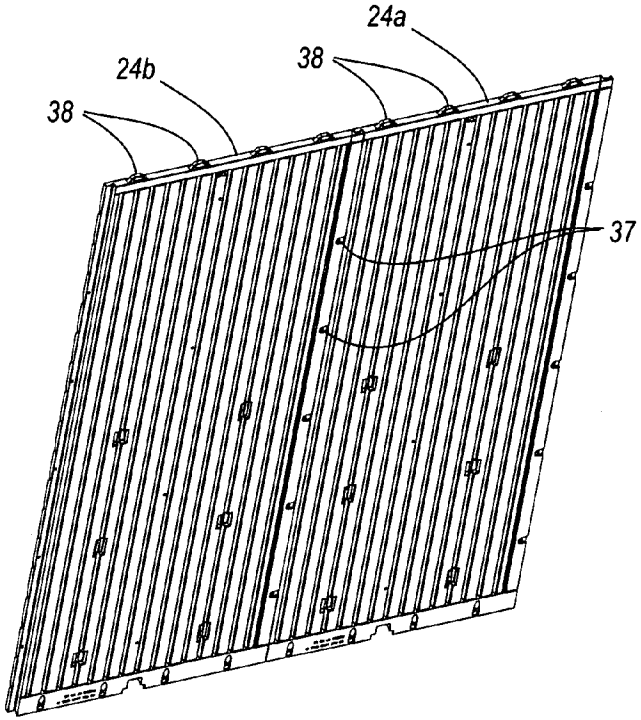
FIG. 6 is a perspective view of a portion of the shed shown in FIG. 1, illustrating an exemplary embodiment of a connection of two panels.
Figure 5:
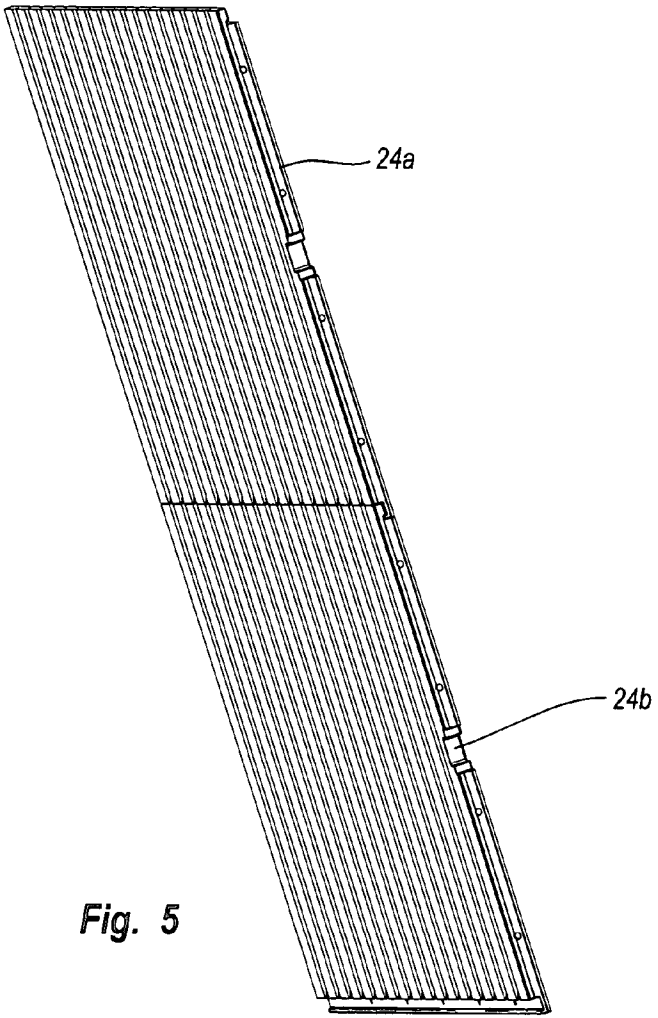
FIG. 5 is a perspective view of a portion of the shed shown in FIG. 1, illustrating an exemplary embodiment of a connection of two panels.
Figure 7:
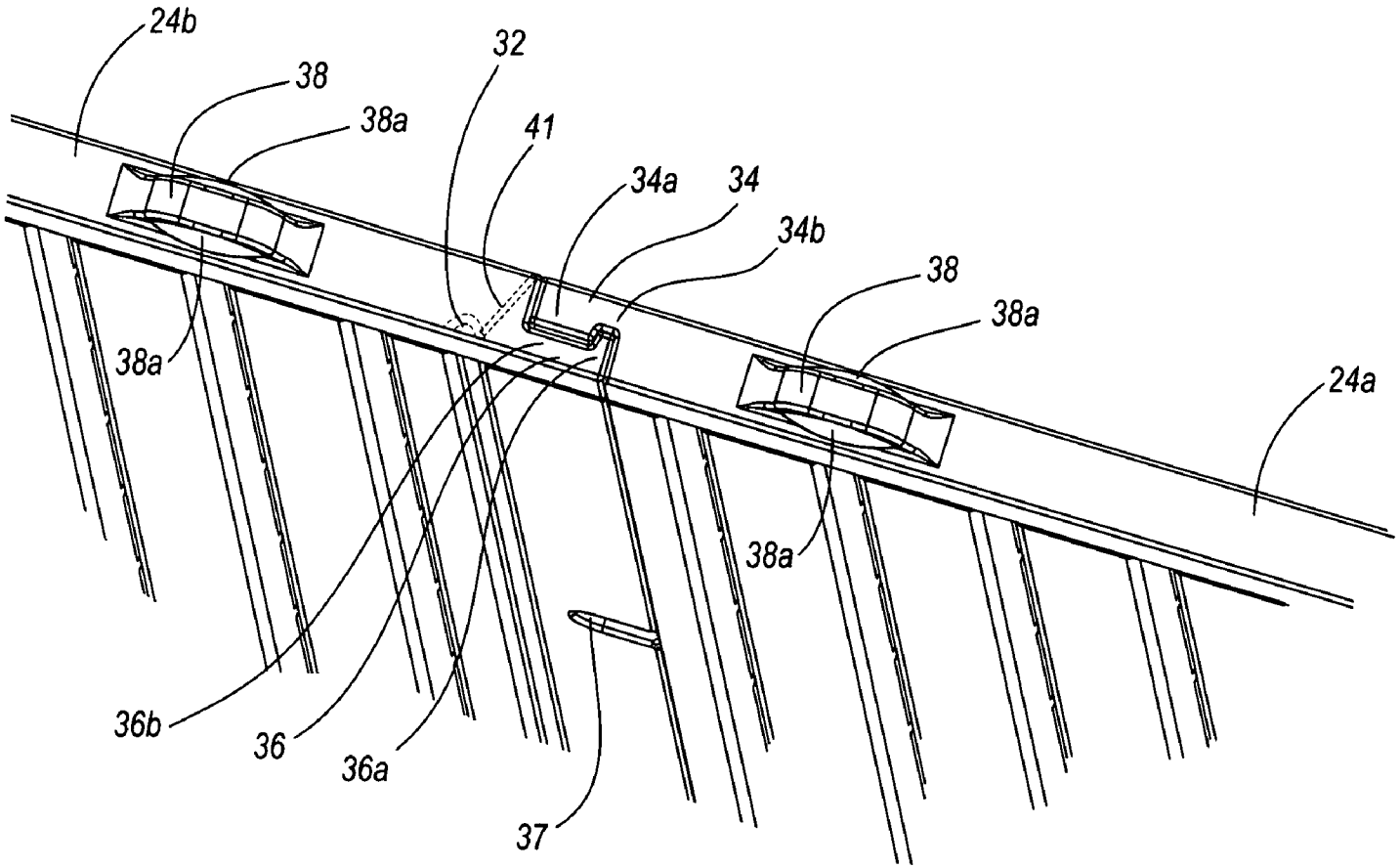
FIG. 7 is an enlarged perspective view of a portion of the panels shown in FIG. 6, illustrating a reinforcing member disposed within one of the panels.

As shown in FIGS. 5, 6 and 7, the connection of the walls panels 24 and/or corner panels 26 may include overlapping portions. The overlapping portions may extend along all or just a portion of the connection between the panels 24, 26, and the panels may be connected by one or more overlapping portions. That is, for example, two adjacent panels 24, 26 may be connected by a single overlapping portion or multiple overlapping portions depending, for example, upon the intended design and/or use of the shed 10.

In greater detail, as shown in FIG. 7, the wall panels 24*a*, 24*b* are used to illustrate an exemplary embodiment of the connection between two adjacent wall panels and this same general configuration may be used to connect other wall and corner panels 24, 26. One of ordinary skill in the art will appreciate, however, that this type of connection does not have to connect all the wall and corner panels 24, 26 and that other suitable types of connections and connectors may also be used.

The wall panel 24 may include an inner surface, an outer surface, a top portion, a bottom portion, a left side and a right side. The top portion of wall panel 24*a* may be substantially flat but, if desired, the inner surface can have a different height that the outer surface. A mating interface is provided on the left side of the wall panel 24*a* and the right side of the wall panel 24*b*. For example, as shown in FIG. 7, the left side of the wall panel 24*a* may include one or more connectors, which may include an extension or flange 34 that is generally aligned with and flush with the outer surface of wall panel 24*a*. The extension 34 may include a connecting member, which may include an enlarged portion 34*a*, and an extension, such as a neck portion 34*b*. In addition, the right side of the wall panel 24*b* may include one or more connectors, which may include an extension or flange 36 that is generally aligned with and flush with the inner surface of the wall panel 24*b*. The extension 36 may include a connecting member, which may include an enlarged head portion 36*a* and an extension, such as a neck portion 36*b*.

As shown in FIGS. 5, 6 and 7, the extensions 34, 36 may overlap and mate together to connect the panels 24*a*, 24*b*. In particular, the enlarged head portion 34*a* of the extension 34 may fit within the neck portion 36*b* of the extension 36 and the enlarged head portion 36*a* of the extension 36 may fit within the neck portion 34*b*. Advantageously, these extending portions and receiving portions may allow the panels 24*a*, 24*b* to be rigidly connected and help prevent the panels from inadvertently separating. In addition, these extensions or flanges may interlock to secure the panels 24*a*, 24*b* together. Further, the extensions or flanges may be sized and configured to allow the panels 24*a*, 24*b* to be connected by a friction, interference or snap fit.

The panels 24*a*, 24*b* may also include other features that facilitate attachment of the panels. For example, the extensions 34, 36 may include one or more detents, ribs, projections and the like that may help connect and/or align the panels. In addition, the panels may include beveled and/or rounded surfaces to facilitate connection of the panels.

Advantageously, the overlapping portions, such as the extensions 34, 36, do not extend beyond a plane generally aligned with the inner or outer surfaces of the panels 24*a*, 24*b*. This allows the panels 24*a*, 24*b* to be connected so that the inner and outer surfaces of the panels are generally aligned. While the panels 24*a*, 24*b* preferably include complimentary overlapping portions that allow the panels to be securely connected and the inner and outer surfaces of the panels to be generally aligned, the panels could be connected in any suitable manner or arrangement.

As shown in FIGS. 6 and 7, the extension 36 on the wall panel 24*b* may include one or more portions 37 that are sized and configured to allow a fastener, such as a screw, to connect the panels 24*a*, 24*b*. In particular, the portions 37 of the wall panel 24*a* may include a screw boss that is sized and configured to receive a screw. Advantageously, the mechanical fastener may secure the wall panels 24*a*, 24*b* together. It will be appreciated that any number of screw bosses and screws may be used to connect the panels 24*a*, 24*b*, but screw bosses and/or screws are not required.

Additionally, as seen in FIGS. 6 and 7, the bottom portion of the wall panels 24*a*, 24*b* may include outwardly extending protrusions 38. The outwardly extending protrusions 38 may include a locking portion 38*a* that is formed on the inner and/or outer surfaces of the protrusion. The locking portion 38*a* may have a generally tapered configuration and it may extend outwardly from the side of protrusion 38. The locking portion 38*a* may also include an outwardly extending lip or edge, which may be spaced apart from the bottom of the protrusion 38. As will be discussed in more detail below, the protrusion 38 and locking portion 38*a* may assist in connecting the wall panels 24*a-h* to the floor 22.

One of ordinary skill in the art will understand that the wall panels 24*a-h* and the corner panels 26*a-d*, and the interconnection of these panels, may have other suitable configurations, arrangements, features and the like. Additional embodiments and disclosure regarding wall panels, corner panels and the interconnection of these and other components is disclosed in Assignee's co-pending U.S. patent application Ser. No. 11/091,813, entitled SYSTEM AND METHOD FOR CONSTRUCTING A MODULAR ENCLOSURE, filed Mar. 28, 2005, which is incorporated by reference in its entirety.

Blow-Molded Plastic

The wall panels 24 and corner panels 26 are preferably constructed from a lightweight material such as plastic. In addition, other portions of the shed 10, such as the roof 20, floor 22 and doors 28, may also be constructed from a lightweight material such as plastic. In particular, these and other components may be constructed from high density polyethylene and these components are desirably formed by a blow-molding process. Importantly, blow-molding may allow strong, lightweight, rigid and sturdy components to be quickly and easily manufactured. In particular, the blow-molded components may include a hollow interior portion that is formed during the blow-molding process, which may allow a lightweight component to be manufactured. Advantageously, this may allow the shed 10 to have significantly lighter weight than conventional sheds constructed from wood or metal. In addition, constructing the shed 10 from blow-molded plastic may allow the shed to be constructed from less plastic than conventional plastic shed, which may save manufacturing costs and reduce consumer costs. The blow-molded plastic may also include ultraviolet (UV) inhibitors that help prevent the plastic from deteriorating when exposed to sunlight. It will be appreciated that other suitable plastic, materials and/or processes may also be used to construct these and other components depending, for example, upon the particular design and use of the shed 10.

The shed 10 may also be constructed from blow-molded plastic because this may allow the shed to be economically manufactured. In addition, the blow-molded plastic may allow the shed 10 to be readily produced because, among other reasons, the components may be quickly manufactured and the blow-molded plastic components may be created with a variety of suitable shapes, sizes, designs and/or colors depending, for example, upon the intended use of the shed. Further, the blow-molded plastic components may be durable, weather resistant, generally temperature insensitive, corrosion resistant, rust resistant and generally do not deteriorate over time. Thus, the blow-molded plastic may allow a long-lasting and durable shed 10 to be constructed.

Advantageously, the blow-molded plastic components may include finished interior and exterior surfaces. For example, the walls 12, 14, 16, 18 may include an outer surface that has a particular design or pattern such as blocks. The outer surfaces of the walls 12, 14, 16, 18 may also be textured or include designs that create the appearance of wood, siding, bricks, stone, stucco and the like. For example, as shown in FIGS. 1 and 2, the walls 12, 14, 16, 18 may include a generally horizontal pattern that creates the look of siding or slats. In addition, the interior surfaces of the walls 12, 14, 16, 18 may include a particular pattern or design such as a grid, network, lattice, web or other desired type of pattern or design. Significantly, these designs or patterns may be integrally formed as part of a unitary, one-piece structure during the manufacturing process.

The blow-molded plastic components of the shed 10 may also include one or more depressions, indentations or the like, and these depressions may be sized and configured to increase the strength and/or rigidity of the component. These depressions, which may also be known as "tack-offs," preferably cover at least a substantial portion of the components and the depressions may be arranged into a predetermined pattern. The depressions, for example, may be formed in one surface and extend towards an opposing surface. The ends of the depressions may contact or engage the opposing surface and/or the ends of the depressions may be spaced apart from the opposing surface. Advantageously, the depressions may help support the opposing surface and/or increase the structural integrity of the component. In addition, the depressions may be closely spaced in order to increase the strength and/or structural integrity of the component. Further, the depressions may be spaced or positioned into a generally regular or constant pattern so that the component has generally consistent properties. It will be appreciated that the depressions may have a variety of suitable configurations and arrangements. For instance, additional information regarding other suitable configurations and arrangements of the depressions is disclosed in Assignee's U.S. Pat. No. 7,069,865, entitled HIGH STRENGTH, LIGHT WEIGHT BLOW-MOLDED PLASTIC STRUCTURES, which was filed on Apr. 8, 2003; and U.S. Provisional patent application Ser. No. 60/659,982, entitled HIGH-STRENGTH, LIGHTWEIGHT BLOW-MOLDED PLASTIC STRUCTURES, which was filed on Mar. 9, 2005 (U.S. patent application Ser. No. 11/372,515, which was filed on Mar. 9, 2006, claims priority to and the benefit of U.S. Provisional patent application Ser. No. 60/659,982). These applications are incorporated by reference in their entireties.

The depressions may also be positioned on opposing surfaces of various components of the shed 10, if desired. For example, one or more depressions may be formed on a first surface and these depressions may extend towards the second, opposing surface. In addition, one or more depressions may be formed on the second surface and these depressions may extend towards the first surface. These depressions on the first and second surfaces may be generally aligned and the ends of the opposing depressions may touch or engage. Significantly, this may create depressions that may contact and support the opposing surface, but the depressions have a smaller size and/or height than conventional depressions because the depressions do not span the entire distance between the opposing surfaces. In contrast, the depressions on the opposing surfaces only span a portion of the distance separating the opposing surfaces.

Figure 6A:
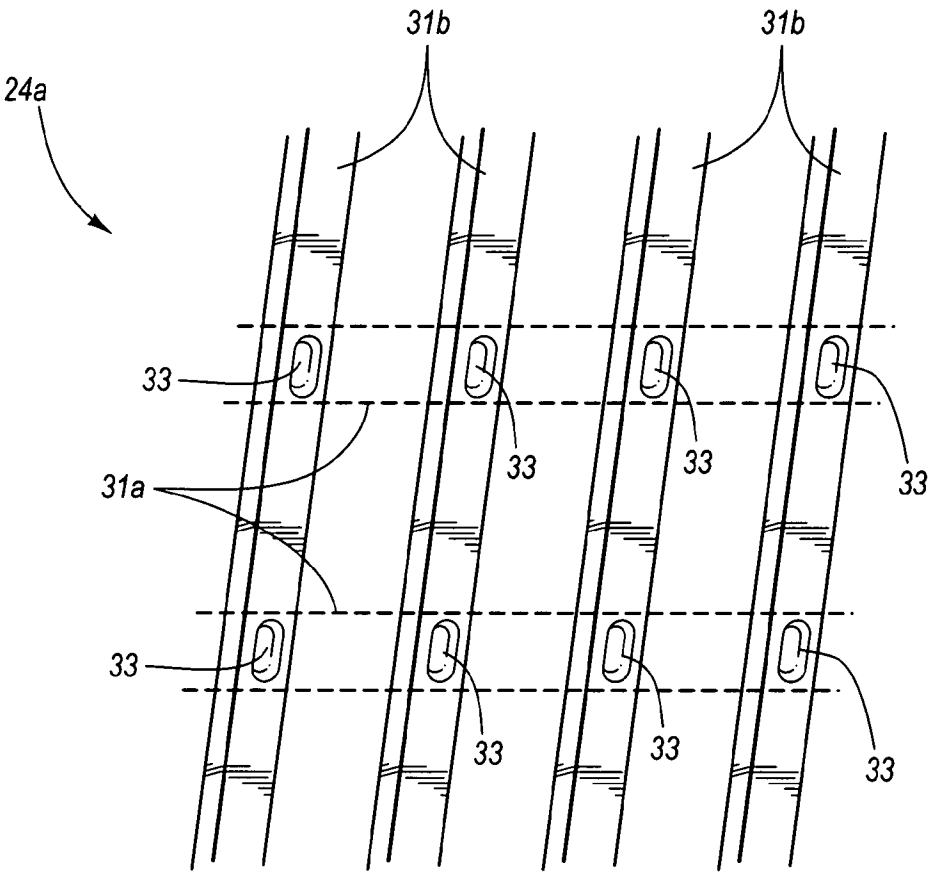
FIG. 6A is an enlarged perspective view of a portion of the two panels shown in FIG. 5, illustrating an exemplary pattern on one side of the panel and an exemplary pattern on the other side of the panel.

In greater detail, as best seen in FIGS. 5, 6, and 6*a*, a design or pattern may be disposed on both the inner surface and the outer surface of the exemplary wall panel 24*a* . While the design or pattern is illustrated in connection with the exemplary wall panel 24*a*, it will be appreciated that other components of the shed 10, such as the other wall panels 24, the corner panels 26, the door panels 28, the roof panels 72, the roof cap portions 74, 76, the floor panels 138, 140, the gables 114, 116 and the like may also include similar features and designs. At least a portion of each design or pattern preferably extends towards the opposing surface. Importantly, these designs or patterns may be specifically arranged to facilitate creating points of intersection between the designs or patterns. Advantageously, these points of intersection may allow depressions or contact points to be created, which may allow the strength and/or rigidity of the panel to be increased. In particular, the design or pattern on one surface of the panel may have a first orientation, such as horizontal, and the design or pattern on the other surface may have a second orientation, such as vertical. The points of intersection are located where the patterns or designs on the opposing surfaces meet or are positioned proximate to each other. Significantly, the designs or patterns may be particularly configured to allow depressions to be positioned at the points of intersection. Advantageously, the points of intersection may allow the depressions to be quickly and easily created. In addition, this may also allow the depressions to be hidden or concealed because they may be disposed within the pattern, which may improve the aesthetics and/or design of the shed. Further, this allows depressions to be formed on both or only one side of the panel.

For example, as shown in FIGS. 4, 5 and 6A, the outer surface of the exemplary wall panel 24*a* may include a first pattern 31*a* and the first pattern may be disposed in a generally horizontal orientation, for example, to create the appearance of siding or horizontal wood panels. The inner surface of the exemplary wall panel 24*a* may include a second pattern 31*b* and the second pattern, for example, may be disposed in a generally vertical orientation, such as a grid or vertical panels. Desirably, at least a portion of the first pattern 31*a* extends towards the inner surface of the wall panel 24*a* and at least a portion of the second pattern 31*b* extends towards the outer surface of the wall panel. The first pattern 31*a* and the second pattern 31*b* preferably include one or more locations where the patterns overlap or intersect. Advantageously, the points of intersection between the first pattern 31*a* and the second pattern 31*b* may be separated by a smaller distance than the distance separating the inner and outer surfaces of the wall panel 24*a* because of the extending patterns.

Advantageously, all or at least a portion of one or more of the depressions 33 may be located where the patterns intersect to minimize the size of the depressions. In particular, because at least a portion of the patterns extend towards the opposing surfaces, the points of intersection may minimize the distance separating the opposing surfaces. Significantly, this may allow the depressions to be smaller in size because the distance between the opposing surfaces is decreased. Because the depressions have a smaller length and/or size, less plastic material and/or less stretching of the plastic material may be required to create the depressions. Accordingly, this may allow the panel to be constructed with thinner walls. Importantly, if the panels are created with thinner walls, then less plastic material may be used to create the walls and that may decrease the cost of the panels.

The patterns or designs on the opposing surfaces are preferably sized and configured to allow the depressions to be closely spaced, which may allow panels with increased strength and/or structural integrity to be created. In addition, these patterns or designs may be sized and configured to allow the depressions to be separated by a generally constant distance so that the panels have generally uniform characteristics. It will be appreciated that the panels may also have other suitable designs and configurations, including angled, random, systematic and the like, depending, for example, upon the intended aesthetics or purpose of the panel and/or shed. As discussed in greater detail below, disposing the depressions at the points of intersection between the patterns formed in the opposing surfaces and reinforcing the panels with one or more reinforcing members may significantly increase the strength and/or structural integrity of the panels. This may also allow the panels to be constructed with thinner outer walls and a reduced amount of plastic material.

Because the patterns and depressions may be integrally formed in the panels during the manufacturing process, this may allow the shed to be quickly and easily manufactured. In addition, because features such as the living hinge may be integrally formed during the manufacturing process, blow-molded plastic is preferably used to construct various components of the shed 10. Further, if the living hinge is integrally formed during the manufacturing process, it may reduce the steps and time required to assemble the shed.

One skilled in the art, however, will appreciate that the components do not have to be constructed from blow-molded plastic and other suitable materials and/or processes can be used to construct the various components depending, for example, upon the intended use of the shed 10. Thus, some or all of the components could also be constructed from other materials with suitable characteristics, such as wood, metal and other types of plastic. Additionally, all the components do not have to be constructed from blow-molded plastic and some or all of the components could be constructed from injection molded plastic, extrusion molded plastic, and the like.

Various components of the shed 10 may also include reinforcements that may be sized and configured to increase the strength and/or rigidity of the shed. For example, the walls 12, 14, 16, 18, which are preferably constructed from blow-molded plastic panels, may include reinforcements to increase their strength and/or rigidity. In particular, the blow-molded plastic panels may include one or more reinforcing members that have different capabilities or characteristics than the panels. For instance, the reinforcing members may have different strength, resilience, compression and/or tension capabilities that the panels, which may allow the panel to be reinforced. Advantageously, the reinforced panel may have greater strength, rigidity, impact resistance, resilience and/or ability to prevent deformation. In addition, the reinforcing members may be arranged or configured to maximize the strengths or characteristics of the reinforcing members.

For example, as seen in FIG. 7, the exemplary wall panel 24*a* may be reinforced by a reinforcing member 41. The reinforcing member 41 is preferably disposed within a receiving portion that is formed inside of the wall panel 24*b* and it is sized and configured to support the reinforcing member in a desired position. For example, as seen in FIG. 7, the reinforcing member 41 may be disposed at an angle to maximize the desirable characteristics of the reinforcing member. In particular, the reinforcing member 41 may be sized and configured to be disposed between one or more alignment portions, such as a groove 32, and an outer edge of the panel 24*a*. As discussed above, the panel 24*a* may include one or more connectors, which may include the neck portion 36*b* of the extension 36, which may facilitate connection of the wall panel 24*a* to another wall panel and/or a corner panel. Thus, the reinforcing member 41 may be disposed between the groove 32 and the extension 36. In addition, the reinforcing member 41 may have a width that is greater than the distance between the inner surface and the outside surface of wall panel 24*b* so that the reinforcing member is disposed at an angle with respect to the inside surface and the outside surface. Advantageously, angling the reinforcing member 41 in this manner can maximize the strength and characteristics of the reinforcing member. It will be appreciated, however, that the reinforcing member 41 may be disposed in any desired portion of the wall panel 24*a* and at any desired angle or orientation depending, for example, upon the characteristics of the reinforcing member and/or the intended use of the shed 10.

As shown in FIG. 7, the reinforcing member 41 may be disposed near an edge of the wall panel 24*b*, which may facilitate connection of the wall panel to another structure. It will be understood that each of the wall panels 24*a-h* may include one or more reinforcing members and other portions of the shed, such as the roof 20, may also include reinforcing portions if desired. While the reinforcing members 41 may be disposed near the edges of the panels, it will be appreciated that the reinforcing members may be disposed in any suitable position, angle, orientation and the like.

The reinforcing member 41 is preferably connected to the exemplary wall panel 24*a* by cutting an opening or slit into an end of the panel and inserting the reinforcing member into the receiving portion formed inside the panel. The reinforcing member 41 is preferably an elongated structure that extends generally the length of the panel, but the reinforcing member could have any suitable size and configuration. Advantageously, after the reinforcing member is inserted into the panel 24*b*, the blow-molded plastic may recover and close the opening. Thus, the reinforcing member 41 may be enclosed or encapsulated within the panel 24*b*. Therefore, the panel 24*b* may help protect the reinforcing member 41 from damage. Because the reinforcing member 41 may be disposed within the wall panel 24*b*, it does not have to be finished and it is not exposed to the elements. It will be appreciated, however, that all of a portion of the reinforcing member 41 may be disposed outside of the wall panel 24*b*. Further, while mechanical fasteners are not required to connect the reinforcing member 41 and the panel 24*b*, mechanical fasteners may be used if desired.

The reinforcing member 41 is preferably an elongated member that is constructed from metal. Advantageously, the reinforcing member 41 may be a thin, flat, generally planar metal strip, such as a sheet metal strip, that is relatively simple to cut and form. It will be appreciated that the reinforcing member 41 could also have other suitable configurations such as cylindrical, tubular, T-shaped, L-shaped, V-shaped, corrugated and the like. The reinforcing member 41 may also be constructed from other materials with suitable characteristics such as other types of metals, plastics, composites, wood, etc. Further, while the reinforcing member 41 may be disposed at an angle, such as 45 degrees, the reinforcing member could be disposed in any suitable position and/or orientation.

Additional information regarding structures constructed from blow-molded plastic and reinforcing members for blow-molded plastic structures is disclosed in Assignee's U.S. Pat. No. 7,210,277, entitled PARTITION SYSTEM, which is incorporated by reference in its entirety.

Corner Panels

Figure 8:
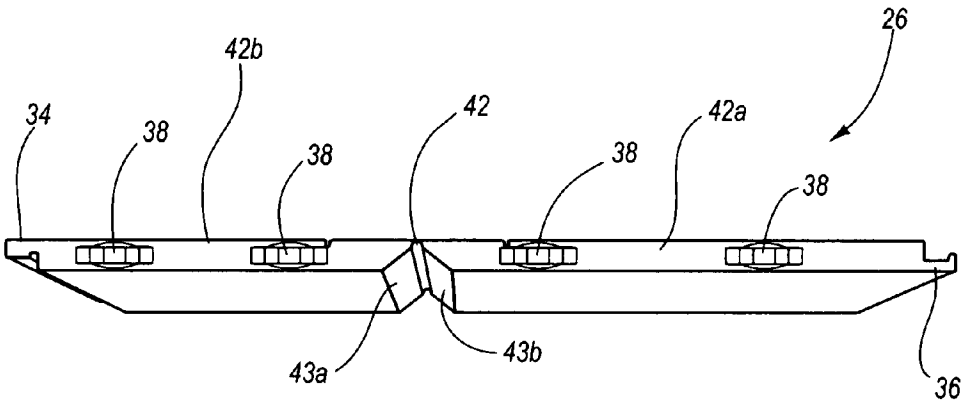
FIG. 8 is perspective view of a portion of the shed shown in FIG. 1, illustrating an exemplary corner panel with a living hinge, illustrating the corner panel in a generally planar configuration.
Figure 9:
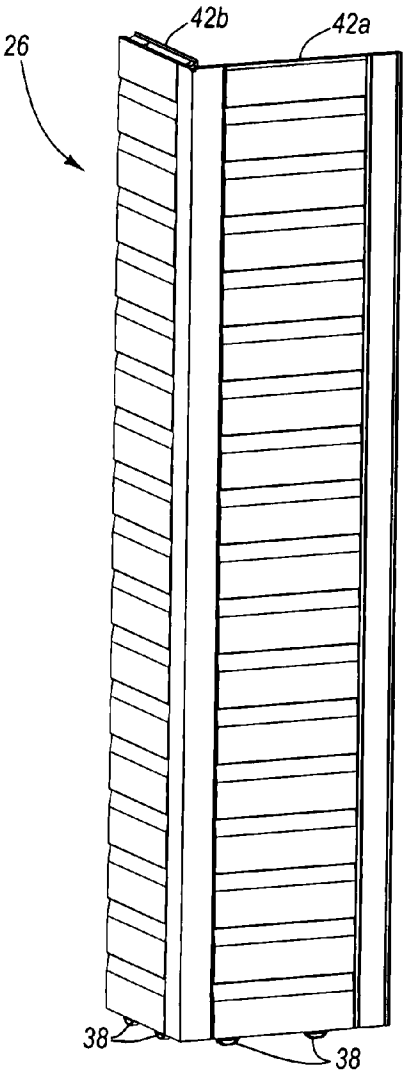
FIG. 9 is another perspective view of the corner panel shown in FIG. 8, illustrating the corner panel in a folded or angled configuration.

As discussed above, the shed 10 includes four corner panels 26*a-d*, which are preferably construed from blow-molded plastic and include a living hinge. In greater detail, as shown in FIGS. 8 and 9, the exemplary corner panel 26 may include a first portion 42*a* and a second portion 42*b* disposed about the living hinge 42. The living hinge 42 allows the corner panel 26 to be positioned between a first position as shown in FIG. 8 in which the first portion 42*a* and second portion 42*b* have a generally flat, planar configuration and a second position as shown in FIG. 9 in which the first portion 42*a* and second portion 42*b* are disposed at an angle about the living hinge 42. Advantageously, when the corner panel is in the first, generally planar configuration, that may facilitate packing, shipping and transportation of the shed 10.

As shown in FIGS. 8 and 9, the corner panel 26 can be constructed in a similar manner and configuration as the wall panel 24. For example, the corner panel 26 may include an inner surface, an outer surface, a top portion, a bottom portion, a left side and a right side. The living hinge 42, for example, may be positioned proximate the outer surface and the living hinge may include a first inner surface 43*a* and a second inner surface 43*b* that are disposed at an angle. Preferably, the first inner surface 43*a* and the second inner surface 43*b* are disposed at approximately a 45 degree angle relative to the outer surface so that when the corner panel 26 is folded into the second angled position, the first and second inner surfaces 43*a*, 43*b* may abut or be positioned proximate to each other. Advantageously, the first and second inner surfaces 43*a*, 43*b* may help position the corner panel 26 at the desired angle in the second position. It will be appreciated that the corner panel could also be disposed at other suitable angles and, accordingly, the first and second inner surfaces 43*a*, 43*b* maybe disposed at other desired angles.

As best seen in FIG. 8, the left side and the right side of the corner panel 26 may include extensions 34, 36 that are sized and configured to allow the corner panel to be attached to the adjacent wall panels. As discussed below, the corner panels 26 may also be sized and configured to be connected to the doors 28. In addition, as also discussed below, the bottom portion of the corner panels 26*a-d* may include protrusions 38 that are sized and configured to be connected to the floor 22. Further, although not shown in FIGS. 8 and 9, the corner panels 26 may include one or more reinforcing members.

Shelf

Figure 13B:
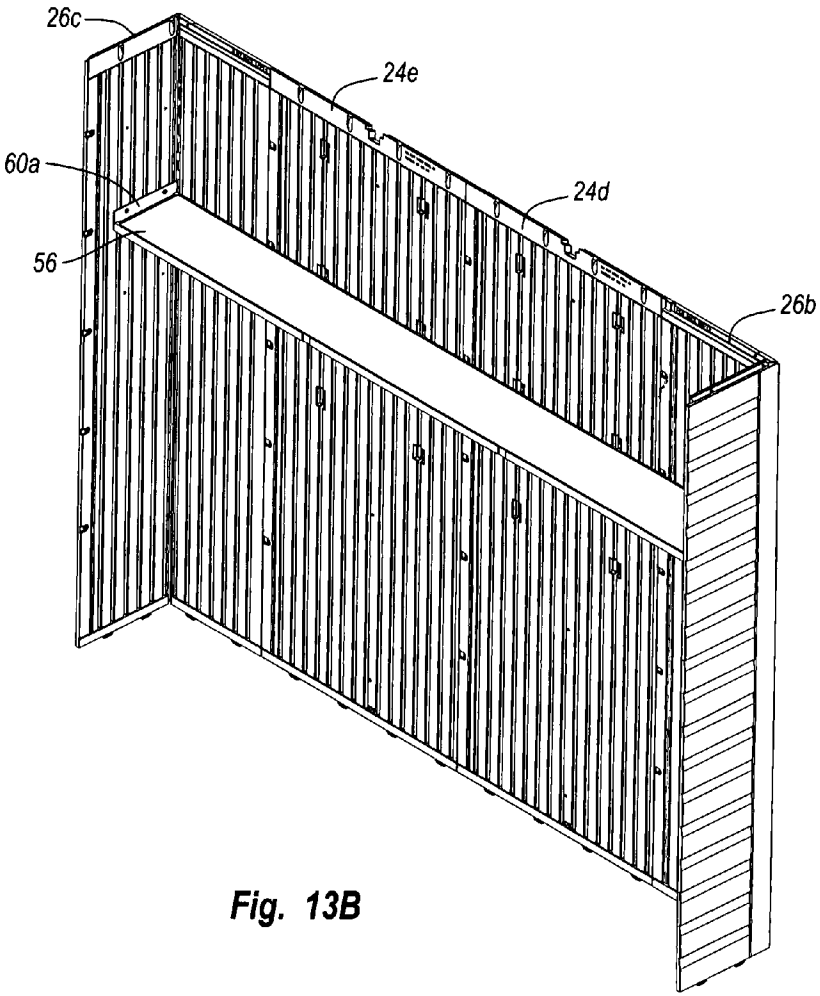
FIG. 13B is another perspective view of a portion of the shed shown in FIG. 1, illustrating another exemplary shelf.

As shown in the accompanying figures, the shed 10 may include one or more shelves. For example, as shown in FIGS. 3, 4 and 13B, the shed 10 may include a shelf 56 that is located proximate the rear wall 14 of the shed. The shelf 56 is preferably constructed from blow-molded plastic and it may include one or more extensions that are sized and configured to facilitate attachment of the shelf to the shed 10. In particular, the shelf 56 may include a first extension disposed on the right side of the shelf and a second extension disposed on the left side of the shelf. The first and second extensions are preferably integrally formed as part of the shelf 56 by living hinges and the extensions can be attached to desired portions of the shed, such as the inner surfaces of wall and/or corner panels 24, 26, by one or more fasteners. Significantly, because the shelf 56 may be attached to opposing walls of the shed 10, that may increase the strength and structural integrity of the shed.

The shelf 56 may also include one or more extensions disposed on the rear portion of the shelf to allow the shelf to be attached to the rear wall of the shed. Advantageously, the extensions and living hinges allow the shelf 56 to be securely connected to the shed 10 and the extensions may extend upwardly and/or downwardly depending, for example, upon the intended use of the shelf. Significantly, the living hinges allow the shelf 56 to be shipped in a generally flat, planar configuration and then the extensions can be disposed at an angle when the shelf is attached to the shed. In addition, the extensions may include one or more screw bosses so that the shelf 56 can be attached to the shed 10 via screws or other suitable fasteners.

In greater detail, as shown in FIG. 13B, the shelf 56 may include a top surface, a bottom surface (not shown), a front side, a rear side, a left side and a right side (not shown). The shelf 56 may also include a left extension 60*a*, a rear extension (not shown) and a right extension (not shown), which extensions are preferably connected to the shelf 56 by living hinges located on the left side, the rear side and the right side. The shelf 56 is preferably sized and configured so that the outer perimeter of shelf fits snugly within inside perimeter of shed 10 and one or more screw bosses can be formed in the left, rear and right extensions so that shelf can be attached to shed via screws. The shelf 56 may also one or more reinforcing member, as described above, if desired.

Figure 13A:
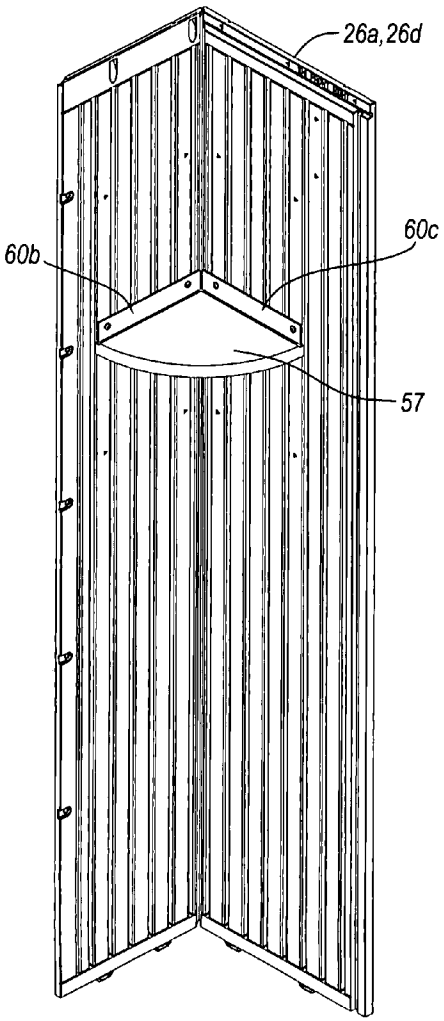
FIG. 13A is a perspective view of a portion of the shed shown in FIG. 1, illustrating an exemplary shelf.

Likewise, as shown in FIG. 13A, one or more shelves 57 may include a top surface, a bottom surface (not shown), a front side, a left rear side, and a right rear side. The shelf 57 may also include a left rear extension 60*b* and a right rear extension 60*c*, which extensions are preferably connected to the shelf 57 by living hinges located on the left rear side and the right rear side. The shelf 57 is preferably sized and configured so that the outer perimeter of shelf fits snugly within inside perimeter of shed 10 and one or more screw bosses can be formed in the extensions 60*b*, 60*c* so that shelf can be attached to shed via screws. The shelf 57 may also one or more reinforcing member, as described above, if desired.

One of ordinary skill in the art will appreciate that the shelves can have a variety of suitable configurations and arrangements. For example, the shelves may include one or more features disclosed in Assignee's co-pending U.S. patent application Ser. No. 11/091,606, entitled MODULAR ENCLOSURE WITH LIVING HINGES, filed Mar. 28, 2005, which is incorporated by reference in its entirety.

Window

As shown in FIG. 1, the shed 10 may also include a window 62. The window 62 is preferably located in one or more of the wall panels 24*a-h* depending, for example, upon the intended design and/or appearance of the shed 10. Advantageously, the window 62 may provide light and/or ventilation for the shed 10. Preferably, the window 62 is disposed in a wall panel 24 that is generally the same as the other wall panels and the window preferably does not include any outwardly extending projections that would interfere with the packaging, shipping or transportation of the shed 10. In addition, the window 62 is preferably relatively easy to manufacture and straightforward to install.

For example, as seen in FIGS. 1 and 3, the window may include a frame that is integrally formed in one of the panels 24 and surrounds an opening. The frame may include one or more decorative or aesthetic portions that may improve the appearance of the window 62. The frame may also include one or more cross-members that extend across part of the opening. The frame may also include grooves or slots that are disposed on opposing sides of the opening and which are sized and configured to receive the window. The window is preferably a transparent or translucent member that allows at least some light to pass through. The window is also preferably constructed from a relatively flexible, strong and impact resistant material such as acrylic or polycarbonate. Advantageously, the window may be constructed using a wide variety of techniques and methods, such as injection molding, rotary molding, compression molding and the like. In addition, the window may include a first portion and a second portion connected by a living hinge, for example, to permit the window to be moved between an opened or angled position and a closed or generally flat position. One of ordinary skill in the art will appreciate that the window may be constructed from other suitable materials, including glass, and processes, if desired, and the shed does not require windows.

In greater detail, the window is preferably disposed within the grooves and the window may be removable if desired. In addition, the window may be slidable within the grooves to allow the window to be opened or closed. The window may also include one or more stops, detents and the like which may hold the window in the open, closed or partially open positions. The window may also include an optional locking member that secures the window in the closed or partially open position. The locking member may simply include a bracket that is attached to the panel or window frame and is movable between an unlocked position and a locked position. When the locking member is in the locked position, the window may not be opened. On the other hand, when the locking member is in the unlocked position, the window may be freely opened.

Advantageously, the frame may be integrally formed in the panel 24 as part of a unitary, one-piece structure. In addition, the frame may not extend outwardly from either the inner or outer surfaces of the panel, which may facilitate stacking and manufacturing of the panels. Further, the consumer may easily install and remove the window, and the window can be locked if desired. Additional information regarding these and other aspects of a window with suitable features is disclosed in Assignee's co-pending U.S. patent application Ser. No. 11/091,606 entitled MODULAR ENCLOSURE WITH LIVING HINGES, filed Mar. 28, 2005, which is incorporated by reference in its entirety.

Pegboard

The shed 10 may also include other features, if desired. For example, the shed 10 may include one or more features that allow items to be attached to the shed. In particular, the shed 10 may include one or more attachment portions that allow pegboard 53 to be attached to a portion of the shed such as a wall panel. It will be appreciated that this feature may be extremely useful since pegboards are commonly used inside sheds to allow various items, such as tools, to be stored.

Figure 12:
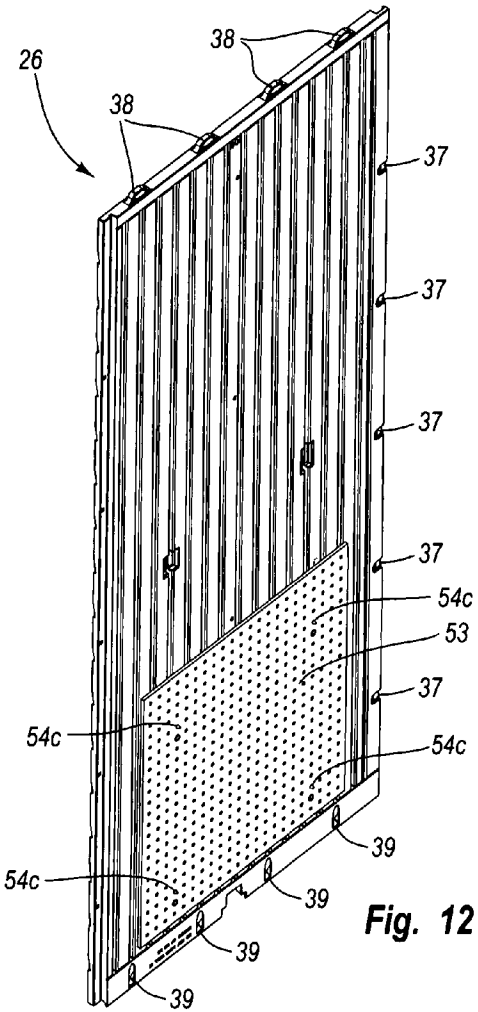
FIG. 12 is a perspective view of a pegboard connected to a panel using at least one of the connectors shown in FIG. 10.
Figure 11:
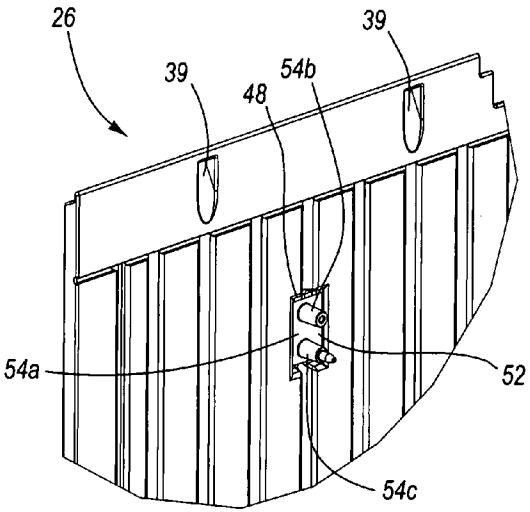
FIG. 11 is an enlarged perspective view of one of the connectors shown in FIG. 10.
Figure 10:
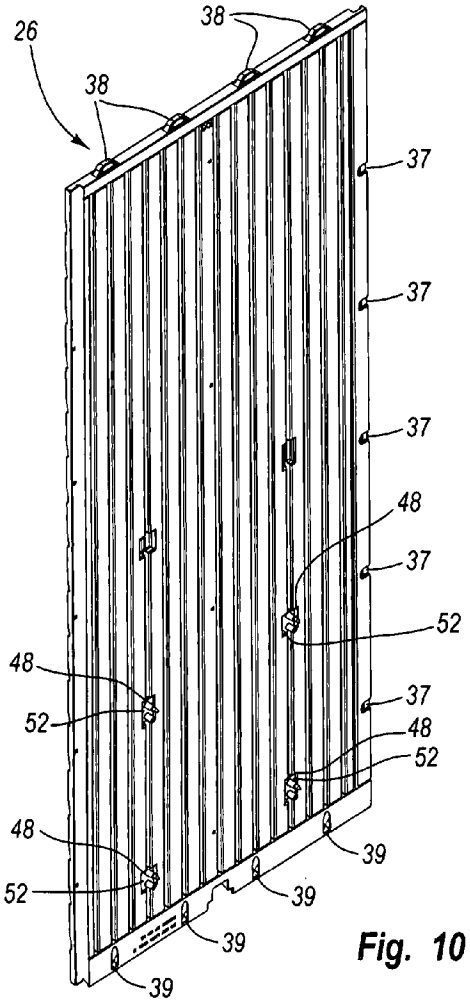
FIG. 10 is an enlarged perspective view of a portion of the shed shown in FIG. 1, illustrating exemplary connectors that may be used in connection with the shed.

For example, as shown in FIGS. 10, 11 and 12, the exemplary wall panel 26 may include a plurality of depressions 48 on the inner surface of the wall panel 26, and the depressions may include a bottom surface and a sidewall. The sidewall of the depressions 48 may be slightly curved inward nearest the inner surface of the wall panel 26, and the depressions 48 can include one or more access regions. As shown in FIGS. 10, 11 and 12, a connecting member 52 is preferably sized and configured to be connected to one or more of the depressions 48. The connecting member 52 may include a base 54*a* with two outwardly extending projections 54*b*, 54*c*. The first projection 54*b* may include a screw boss that is sized and configured to receive a fastener such as a screw and the second projection 54*c* may be sized and configured to help align and position the pegboard 53.

The base 54*a* is preferably sized and configured to be received and retained within one or more of the depressions 48. In particular, because the sidewall of the depressions may be slightly curved inward, the area of sidewall nearest inner surface of the wall panel 26 may be smaller than the area of the bottom surface of the depressions. Because the wall panel 24 is preferably formed of plastic, the sidewall of the depressions 48 may expand as the base 54*a* is pushed into the depression 48 and then the sidewall may contract after the connecting member 52 is inserted. Thus, the connecting member 52 may be received and retained within the depression 48 by a snap, interference or friction fit. The connecting member 52 can be removed by inserting a tool (e.g., a screw driver) into the access region of the depression 48 and applying force to the underside of base 54*a*. One of ordinary skill in the art will appreciate that the connecting member 52 may be attached to any desired portion of the shed 10 and it may be attached in any suitable manner.

As illustrated in FIG. 12, the connecting members 52 may allow pegboard 53 to be attached to the shed 10. In particular, one or more connecting members 52 may be attached to an inner surface of a wall panel and the second projections 54*c* may be used to position and align the pegboard 53. Specifically, the projections 54*c* may be inserted into holes in the pegboard 53 to correctly position the pegboard and fasteners can then be inserted through the pegboard and attached to the screw bosses formed in the projection 54*b*. The connecting members 52 are preferably constructed from injection molded plastic, but the connecting members can be formed from other suitable processes, such as rotary or compression molding, and other materials, such as metal. While the connecting members 52 are preferably separate components that are selectively attached to the shed 10, one or more connecting members may also be integrally formed as a unitary part of the shed.

Roof Assembly

Figure 14:
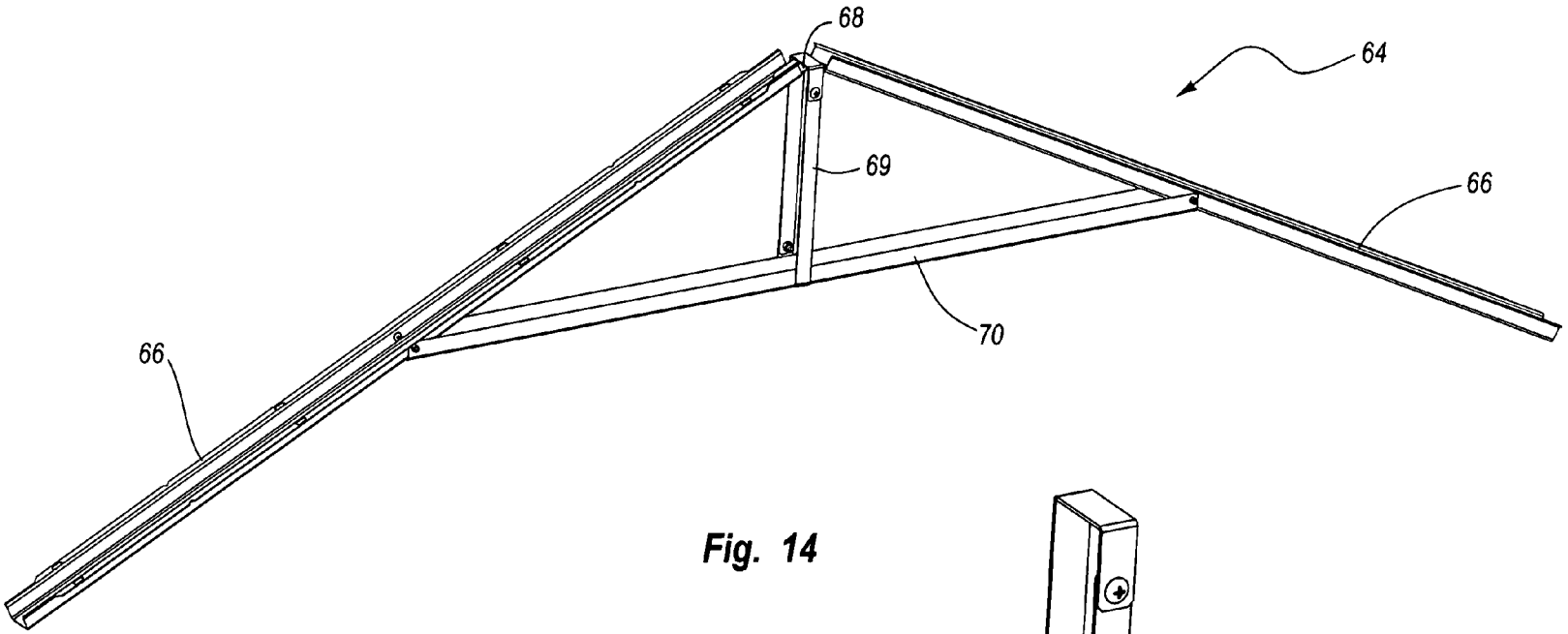
FIG. 14 is a perspective view of a portion of the shed shown in FIG. 1, illustrating an exemplary roof truss.
Figure 15:
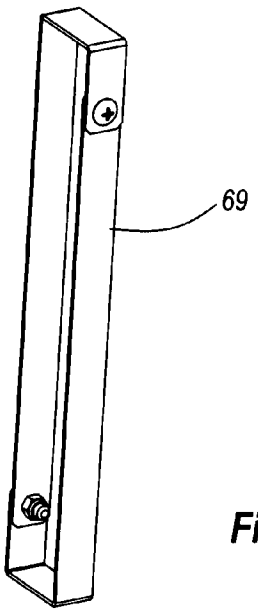
FIG. 15 is a perspective view of a portion of the roof truss shown in FIG. 14, illustrating an exemplary bracket that may be used in connection with the truss.
Figure 16:
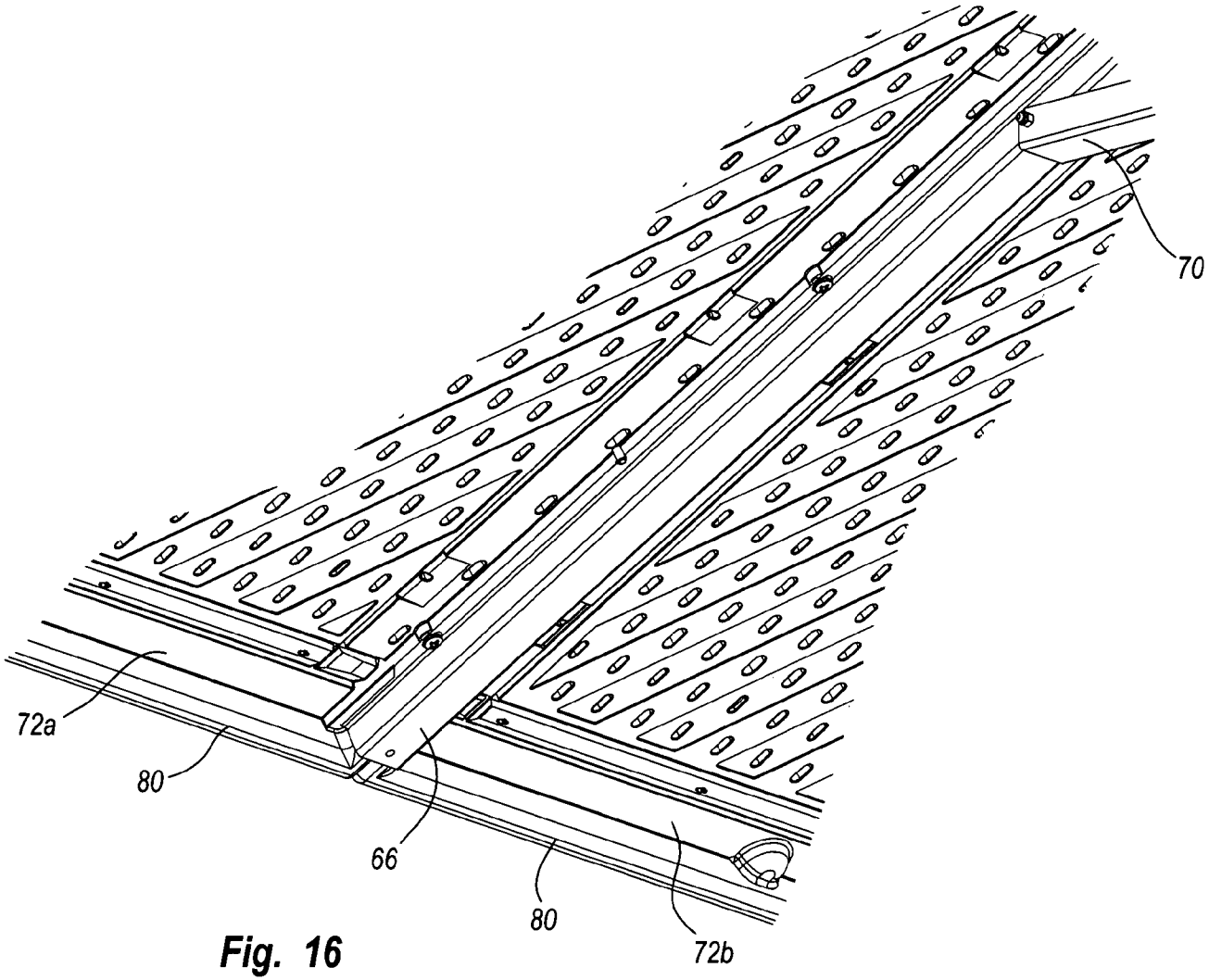
FIG. 16 is a perspective view of a portion of the shed shown in FIG. 1, illustrating an exemplary a connection of a pair of roof panels to a portion of the roof truss shown in FIG. 14.

Turning back to FIGS. 3 and 4, the roof 20 of the shed 10 will now be discussed in further detail. The roof 20 may include a plurality of trusses 64, and as shown in FIG. 14, each truss may include a pair of support beams 66 that are connected at one end by a bracket 68. The support beams 66 are preferably elongated structures and each of the support beams may include a channel. A cross beam 70 or rafter is connected proximate the midsection of the pair of support beams 66 to form a generally A-frame type truss system. bracket 69 may connect the bracket 68 and the cross beam 70, as shown in FIGS. 14 and 15. The support beams 66 and cross beams 70 are preferably constructed of metal (such as steel) and these beams can be powder coated, galvanized, or otherwise processed to reduce or minimize corrosion. It will be appreciated that these beams could also be constructed from other materials with suitable characteristics.

As shown in FIGS. 3 and 4, the roof 20 preferably has a modular construction with a plurality of roof panels 72 and roof caps 74, 76. For example, as shown in the accompanying figures, the roof 20 may include lower roof panels 72*a-h*, end roof cap portions 74*a*, 74*b*, and intermediate roof cap portions 76*a*, 76*b*, 76*c*. The roof panels 72 and roof caps 74, 76 are preferably constructed from blow-molded plastic, but these components could also be constructed from other materials and processes with suitable characteristics.

In greater detail, the roof 20 may include lower roof panels 72*a-h* and each lower roof panel may include an inner surface, an outer surface, a top portion, a bottom portion, a left side and a right side. The lower roof panels 72*a-h* may also include a lip 80 that extends outwardly away from the inner surface and is formed on one or more sides of the lower roof panel. The lip 80 may be formed on the outer periphery of selected lower roof panel 72*a-h* to create a thicker edge, which may create the appearance of thicker roof. The lip 80 may include a hollow interior portion that is formed during the manufacturing process. Advantageously, the lower roof panels 72 and the lip 80 are constructed from blow-molded plastic, which may be integrally formed as part of a unitary, one-piece structure. The lower roof panels 72*a-h* can include a textured surface or pattern on the outer surface to imitate, for example, shingles. In addition, the outer surface of the lower roof panels 72*a-h* and/or the lip 80 may also have a textured surface or pattern, such as shingles. One or ordinary skill in the art will appreciated that the shed 10 could have a variety of suitable designs and configurations.

Figure 18:
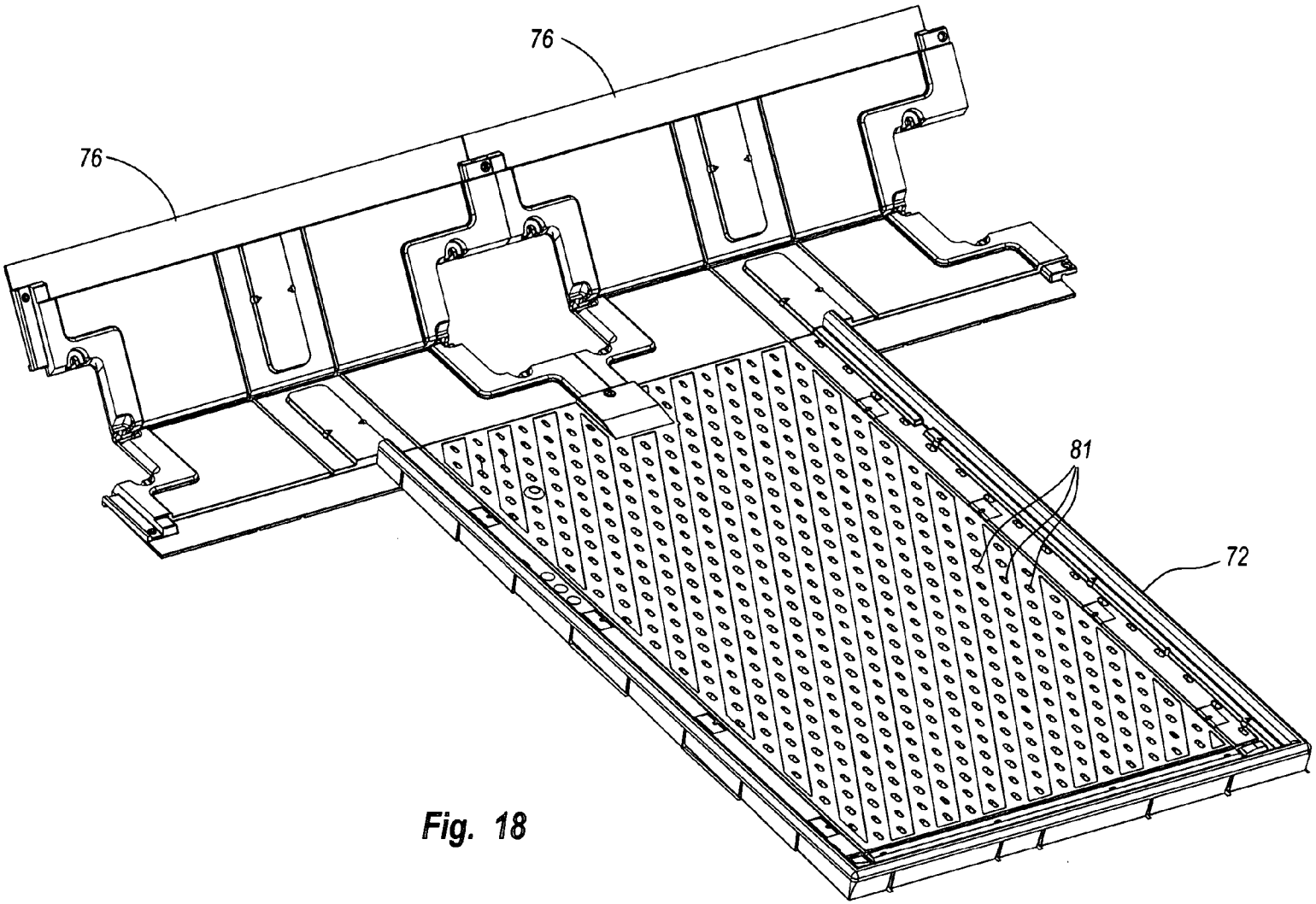
FIG. 18 is a perspective view of a portion of the shed shown in FIG. 1, illustrating an exemplary connection of a pair of roof cap portions to a roof panel.
Figure 19:
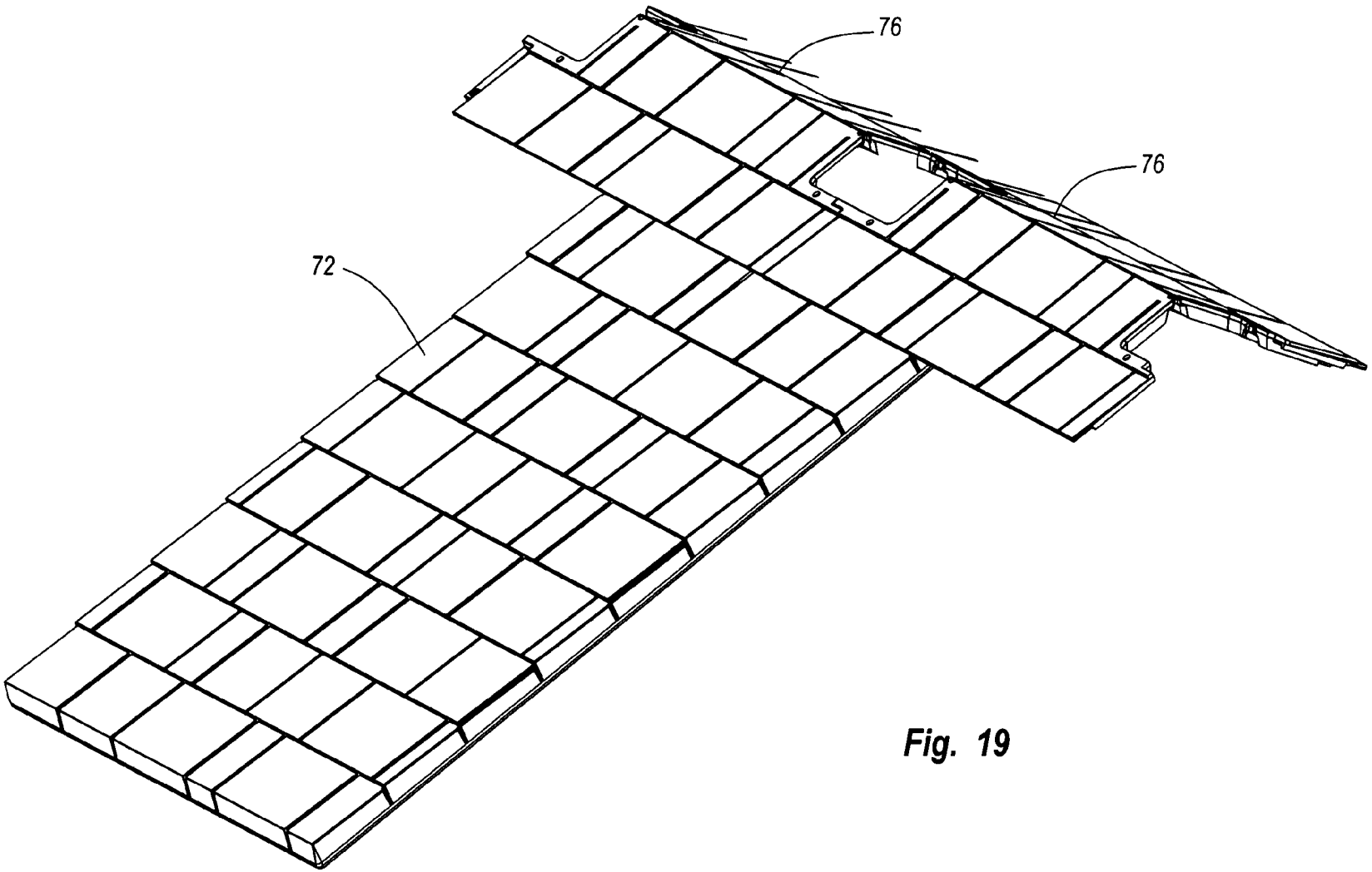
FIG. 19 is another perspective view of the connection of the roof cap portions and roof panel shown in FIG. 18.

As shown in FIG. 3, the lower roof panels 72*a-h* may include a depression or recess 82 formed on the top portion of the outer surface. As shown in FIGS. 3, 18 and 19, the depression 82 is preferably tapered and the depressions may be used to receive a portion of a pair of roof cap portions 74, 76. Advantageously, because the lower roof panels 72*a-h* may have generally the same or identical shape and configuration, the lower roof panels may be used interchangeably. As discussed above, the lower roof panels 72 may include one or more depressions that may be sized and configured to increase the strength and/or rigidity of the roof panels, such as depressions 81 shown in FIG. 18. In particular, the pattern on the outer surface of the lower roof panels 72 may create the appearance of shingles and the pattern on the inner surface of the lower roof panels may be sized and configured to allow the depressions 81 to be formed in the pattern so that the size of the depressions may be minimized. In addition, as discussed above, the lower roof panels 72 may include one or more reinforcing members, if desired.

Figure 44:
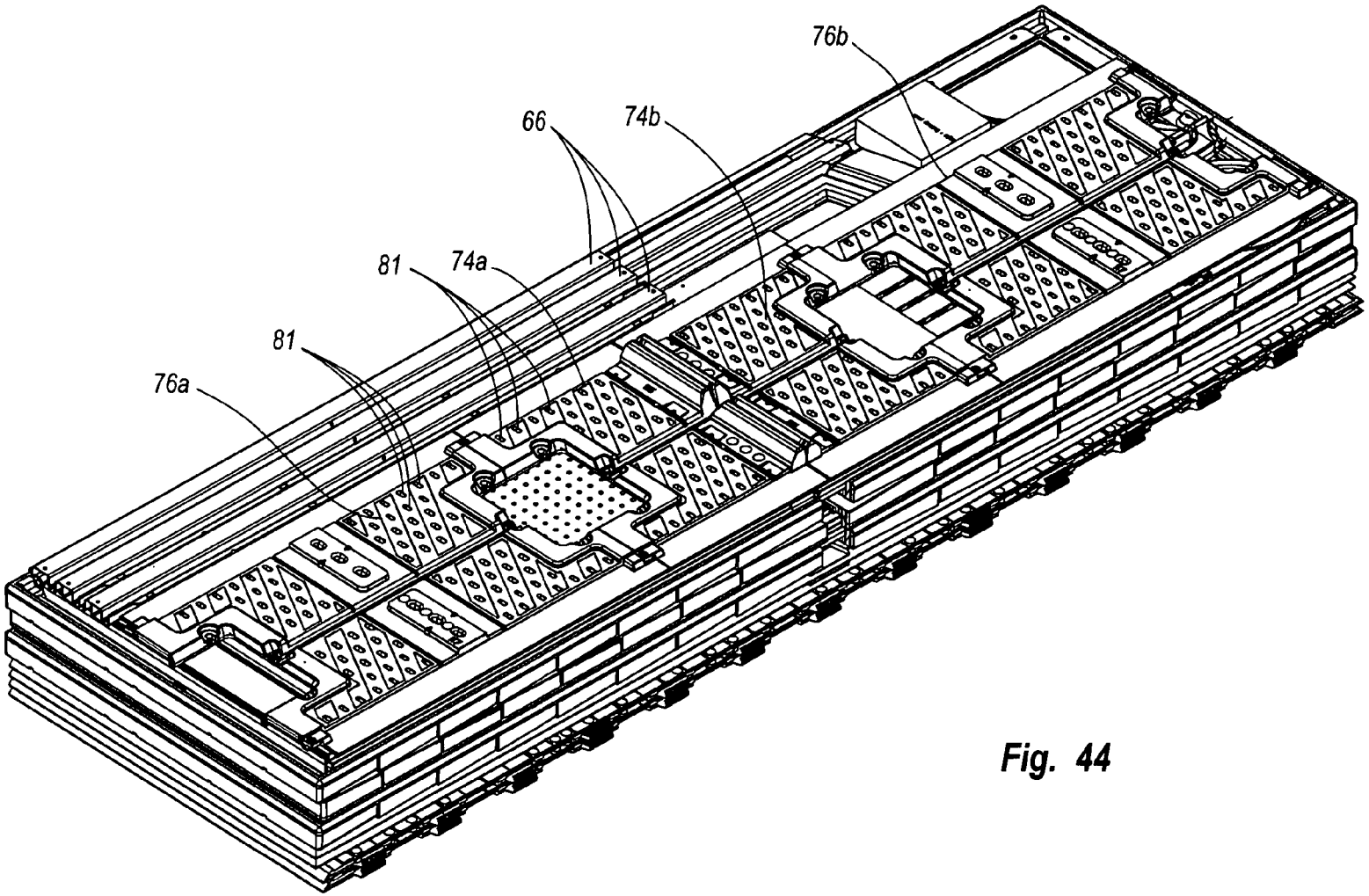

Similarly, the roof cap portions 74, 76 may include one or more depressions that may be sized and configured to increase the strength and/or rigidity of the roof cap portions, such as depressions 81 shown in FIG. 44. In addition, the roof cap portions 74, 76 may include one or more reinforcing members, if desired. Further, as discussed above, the roof cap portions 74, 76 and/or the roof panels 72 may include a pattern on one side and another pattern on the other side, and one or more depressions may be positioned where the patterns overlap or intersect.

The roof 20, as seen in FIG. 3, may include a roofline that is formed from the end roof cap portions 74*a*, 74*b* and the intermediate roof cap portions 76*a-c*. The end roof cap portions 74*a*, 74*b* and the intermediate roof cap portions 76*a-c* are preferably constructed from blow-molded plastic. It will be appreciated that the end roof cap portions 74*a*, 74*b* can be substantially mirror images of each other and the intermediate roof cap portions 76*a-c* can also be substantially mirror images of each other. It will be understood, however, that the end roof cap portions 74*a*, 74*b* and/or the intermediate roof cap portions 76*a-c* do not have to be mirror images, respectively, and these portions may have other suitable designs and configurations.

Advantageously, the end roof cap portions may include a first portion and a second portion that are joined together by a living hinge. For example, the end roof cap portion 74*a* may include a first portion 83*a* and a second portion 83*b* that are joined together by a living hinge 84. As such, the end roof cap portion 74*a* can be selectively positioned between a generally flat, planar position that may facilitate packaging and an angled or use position. In addition, the end roof cap portion 74*a* may include a top surface, a bottom surface, a front side, a back side, a left side and a right side. The top surface of the end roof cap portion 74*a* can be textured to imitate shingles. Additionally, a space may be located between the first and second portions 83*a*, 83*b*, and the end roof cap portion 74*a* may have a generally C-shaped configuration. The space may be configured to assist in installing an optional skylight in roof 20. However, it will be appreciated that a skylight is not necessary, in which case, the end roof cap portion 74*a* can be configured without the space.

The roof 20 may also include an intermediate roof cap portion, such as the intermediate roof cap portion 76*a*, may include a first portion and a second portion joined by a living hinge. For example, the end roof cap portion 76*a*, may include a first portion 91*a* and a second portion 91*b* that are joined together by a living hinge 92. Thus, the intermediate roof cap portion 76*a* can be selectively positioned between a generally flat, planar position that may facilitate packaging and an angled or use position. The intermediate roof cap portions 76 may also include an inside surface, an outside surface, a front side, a back side, a left side and a right side. Desirably, the outside surface of the intermediate roof cap portions 76 is textured to imitate shingles so that it matches the other portions of the roof 20. The intermediate roof cap portions 76 may also include one or more spaces located between the first portion and second portion, and the intermediate roof cap portions may have a generally H-shaped configuration. The spaces may be sized and configured to assist in installing an optional skylight in the roof 20. It will be appreciated that the skylight is not required and the intermediate roof cap portion 76 can be configured without the spaces.

Figures 20, 21:
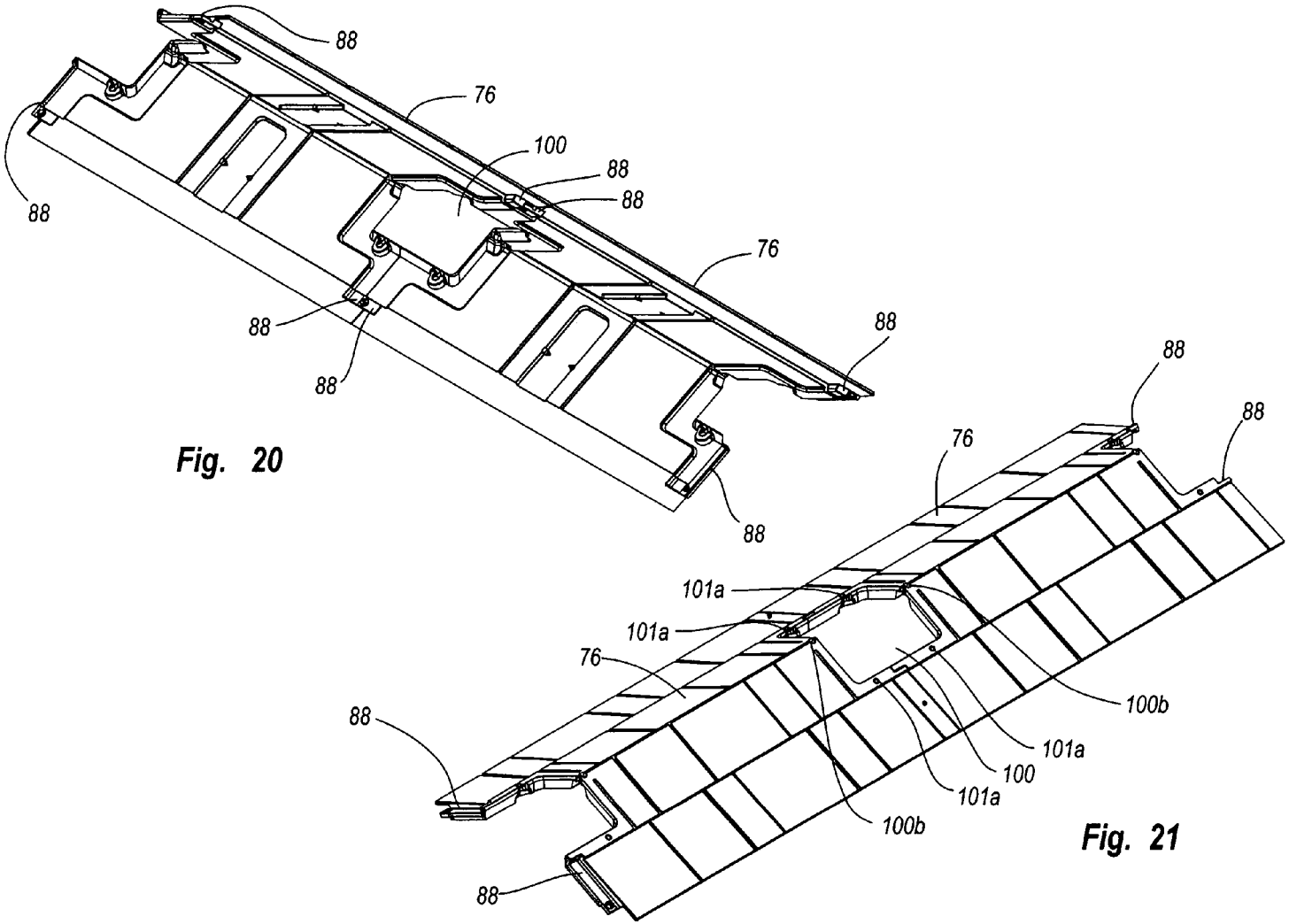
FIG. 20 is a perspective view of a portion of the shed shown in FIG. 1, illustrating an exemplary connection of a pair of roof cap portions.
FIG. 21 is another perspective view of the connection of the roof cap portions shown in FIG. 20.

As shown in FIGS. 20 and 21, the end roof cap portions 74 and the intermediate roof cap portions 76 preferably include one or more extensions, such as extensions 88, which may overlap and interconnect with other extensions. For example, an extension of an end roof cap portion 74 may engage or be connected to an extension of an intermediate roof cap portion 76. Also, the extensions of an intermediate roof cap portion 76 may engage or be connected to extensions of two intermediate roof cap portions, or the extensions of an intermediate roof cap portion may engage or be connected to extensions of an end roof cap portion 74 and an intermediate roof cap portion 76.

As shown in the accompanying figures, the end roof cap portions 74*a*, 74*b*, the intermediate roof cap portions 76*a-c* and the lower roof panels 72*a-h* can be connected to form the roof 20. For example, the roofline of the roof 20 may be formed by joining the end roof cap portions 74*a*, 74*b* and the intermediate roof cap portions 76*a-c*. As shown in FIG. 3, the end roof cap portions 74*a*, 74*b* are disposed on the ends of the roof 20 while the intermediate roof cap portions 76*a-c* are disposed towards the middle portion of the roof. The extensions of end roof cap portions 74*a*, 74*b* may engage or be connected to extensions of intermediate roof cap portions 76*a-c*, respectively, in an interlocking and/or overlapping configuration. The extensions of the intermediate roof cap portion 76*b* may engage or be connected to the other extensions of the intermediate roof cap portions 76*a-c* in an interlocking and/or overlapping configuration. Additionally, one or more mechanical fasteners, such as screws, rivets or the like, may also be used to secure the various portions of the roof 20, such as the roof cap portions 74, 76.

It will be appreciated that the roof 20 can have other suitable configurations and arrangements. For example, all or a portion of one intermediate roof cap portion may be placed adjacent to all or a portion of another intermediate roof cap portion or to all or a portion of an end roof cap portion. As shown in FIGS. 3, 18 and 19, these adjacent portions may be sized and configured to fit in the tapered depression 82 formed on the top side of lower roof panels 74—which may form a joint between the roof panel, the intermediate roof cap portion, and the end roof cap portion (or other intermediate roof cap portion). These adjacent portions may form at least a part of the engaged or connected extensions that are discussed above, and these portions may help provide a more water-tight configuration. Further, because the tapered depression 82 or other portion of the lower roof panel 72 may be disposed underneath the lower portion of the seam between the extensions 88 of adjacent cap portions 74, 76, water leaving that seam may advantageously be guided to the top surface of the lower roof panel to run off the roof 20. For example, an extension 88 of a cap portion 74, 76 may include a channel, groove, or other recessed portion that may help guide any water entering the seam between the cap portions.

Figure 17:
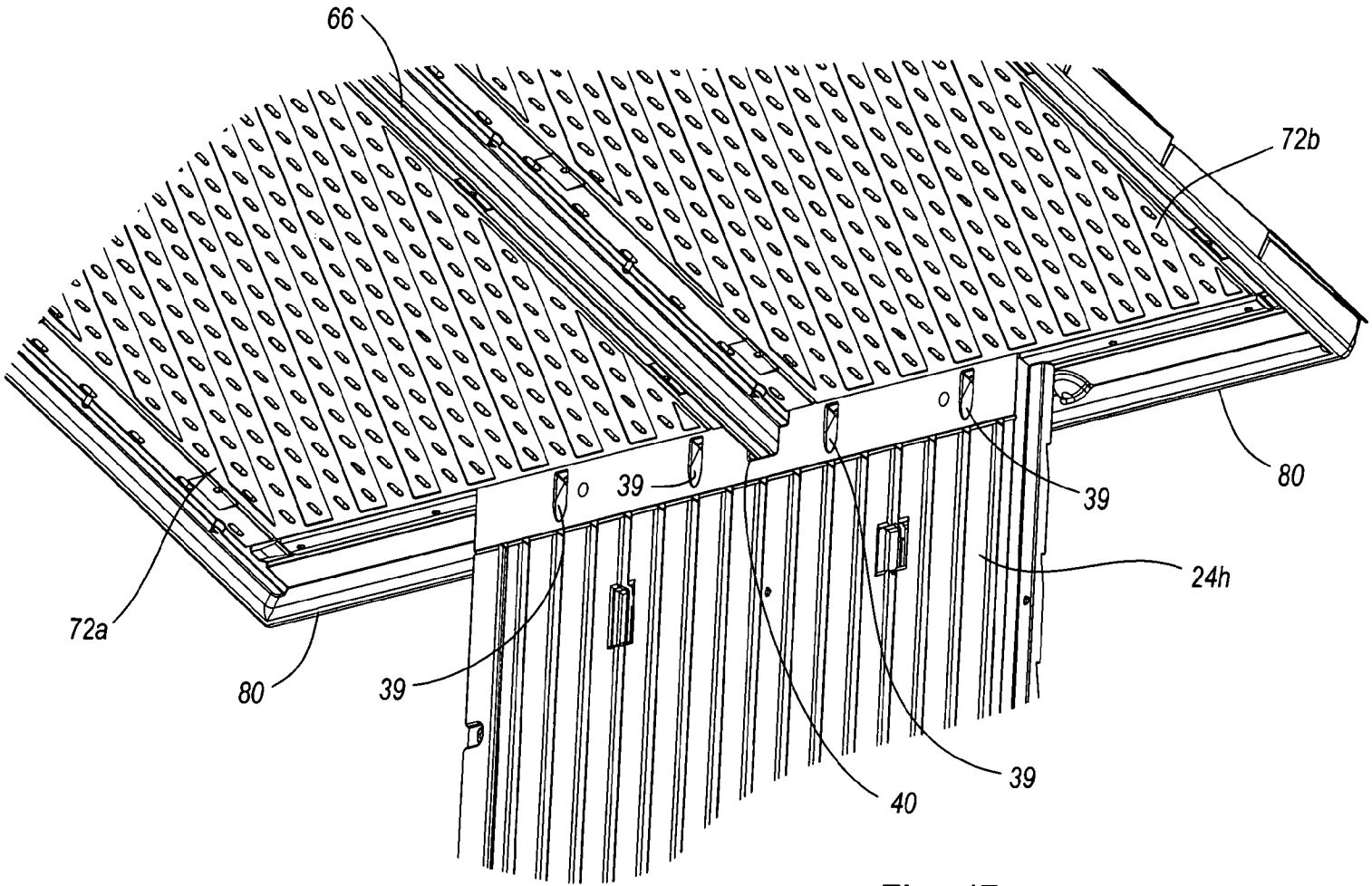
FIG. 17 is a perspective view of a portion of the shed shown in FIG. 1, illustrating an exemplary connection of a wall panel to the roof panels shown in FIG. 16.

The roof truss 64 may be sized and configured to assist in connecting the roof panels to the shed 10, and the truss may be sized and configured to allow any water or moisture that passes between the roof panels to be drained from the shed. For example, as shown in FIG. 17, an exemplary support beam 66 of a truss 64 may have a channel that is sized and configured to receive at least a portion of the lower roof panels 72*a* and 72*b*. In particular, the support beam 66 may help connect the lower roof panels 72*a*, 72*b*. Additionally, at least a portion of the lip 80 of the lower roof panel 72*a* and at least a portion of the lip of the lower roof panel 72*b* may be disposed within the channel of the support beam 66. Because the channel and/or other portions of the support beam 66 may be disposed underneath the seam between the lower roof panels 72*a*, 72*b*, any water or moisture penetrating the seam may be collected within the channel. Advantageously, as discussed below, because the truss 64 and the lower roof panels 72*a*, 72*b* preferably extend to and beyond the outer walls of the shed 10, the water or moisture may be transported out of the interior portion of the shed. While the support beam 66 may have a generally U-shaped configuration that defines at least a portion of the channel, it will be appreciated that the truss and support beam may have other suitable shapes, sizes and configurations.

As shown in the accompanying figures, the roof 20 may be connected to one or more wall panels 24. For example, as shown in FIG. 17, the wall panels 24 may include one or more screw bosses 39 that are sized and configured to receive a screw or other fastener to connect the wall panels to the roof (or to other portions of the shed, such as the gables 114, 116 discussed below). The wall panels 24 preferably include a receiving portion or opening 40 that is sized and configured to receive and/or be connected to at least a portion of the truss 64 and/or lower roof panel 72. In particular, as shown in FIG. 17, the opening 40 may be sized and configured to receive at least a portion of the support beam 66 or other portion the truss 64, at least a portion of the lip 80 of the lower roof panel 72*a* and at least a portion of the lip 80 of the lower roof panel 72*b*. This may allow the truss 64, the lower roof panel 72*a*, the lower roof panel 72*b* and the wall panel 24*h* to be securely connected, which may allow a strong and stable shed 10 to be created.

Advantageously, the roof 20 of the shed 10 may be cost effective because it may be constructed from a plurality of blow-molded panels that may be part of a modular construction. In addition, the blow-molded panels may be strong, lightweight and relatively rigid. The roof 20 may also be constructed with a pitch of about 6:12, which may allow water and snow to quickly and easily run off the roof. Further, the roof may be quickly and easily assembled because it is constructed from a relatively few parts that may be quickly and easily connected.

One of ordinary skill in the art will appreciate that the roof 20 may have other suitable shapes, sizes and configuration depending, for example, upon the intended use and/or design of the shed 10. Additional information and other features of a roof 20 that may be used in connection with the shed 10 are disclosed in Assignee's co-pending U.S. patent application Ser. No. 11/091,811, entitled ROOF SYSTEM FOR A MODULAR ENCLOSURE, filed Mar. 28, 2005, which is incorporated by reference in its entirety.

Skylight

As shown in FIGS. 3 and 4, the roof 20 can include one or more skylights. Advantageously, the skylights may reduce the need for artificial light. In addition, the skylights may be configured to provide ventilation for the shed 10. Further, the skylights may be positioned on the roof line so that light may be equally distributed throughout the shed 10. While the skylights are preferably constructed from transparent or translucent materials, the skylights could also be constructed from opaque materials. It will also be appreciated that the shed 10 may include any desired number of skylights, but skylights are not required.

In greater detail, as shown in FIGS. 20 and 21, when the roof cap is formed by joining end roof cap portions 74*a*, 74*b* and intermediate roof cap portions 76*a-c*, the openings or spaces in the cap portions may form apertures 100 in the roof cap. These openings are preferably sized and configured to receive a skylight 102, as shown in FIG. 22-26. Preferably, the spaces in end roof cap portions 74 and intermediate roof cap portions 76 have similar configurations so that resulting apertures 100 are similar in size along the roof cap. Thus, the same size and configuration of the skylight 102 can be used, which may reduce the cost of manufacturing. It will be understood, however, that the skylights 102 could have any suitable size and configuration, and the different skylights could have different sizes and configurations.

Figure 22:
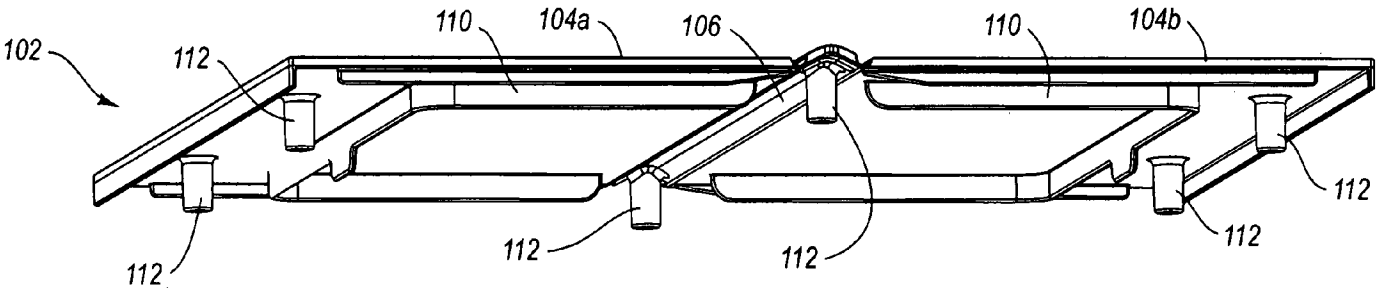
FIG. 22 is perspective view of a portion of the shed shown in FIG. 1, illustrating an exemplary skylight including a living hinge in a generally planar configuration.
Figure 23:
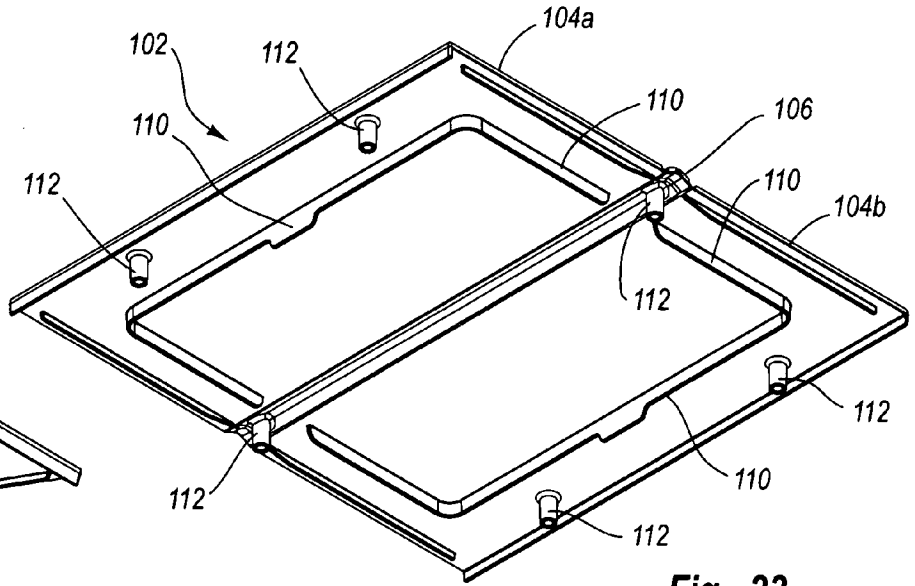
FIG. 23 is another perspective view of the skylight shown in FIG. 22, illustrating the skylight in the generally planar configuration.
Figure 24:
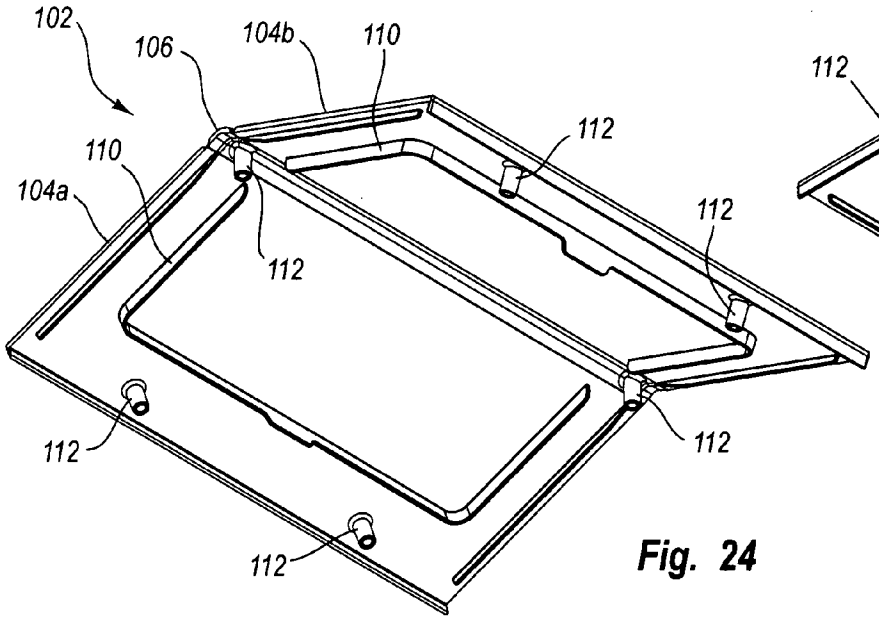
FIG. 24 is yet another perspective view of the skylight shown in FIG. 22, illustrating the skylight in a folded or angled configuration.
Figure 25:
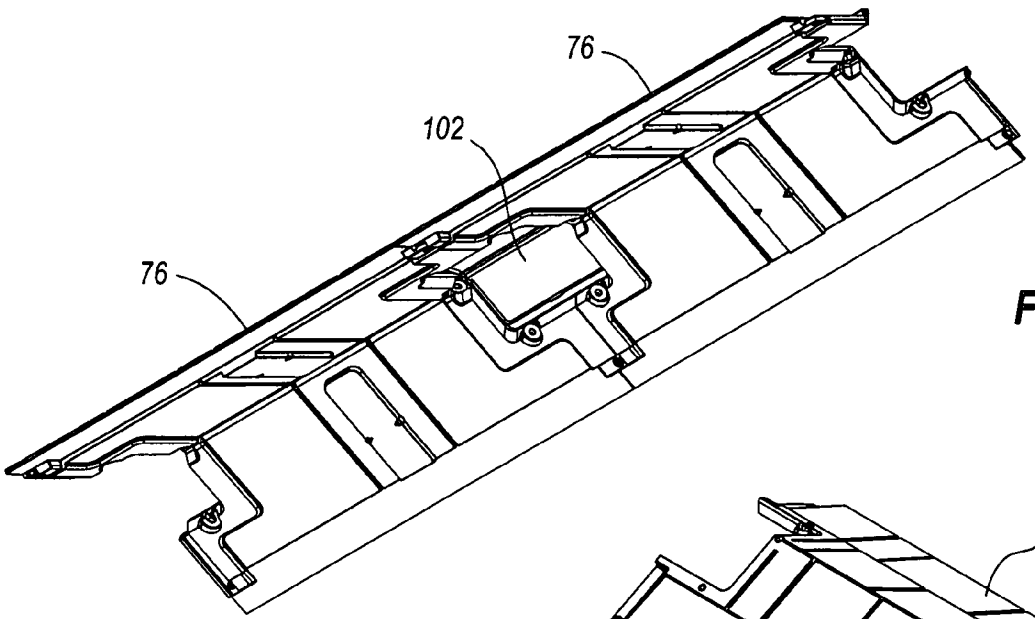
FIG. 25 is a perspective view of a portion of the shed shown in FIG. 1, illustrating an exemplary connection of the skylight to the roof cap portions.
Figure 26:
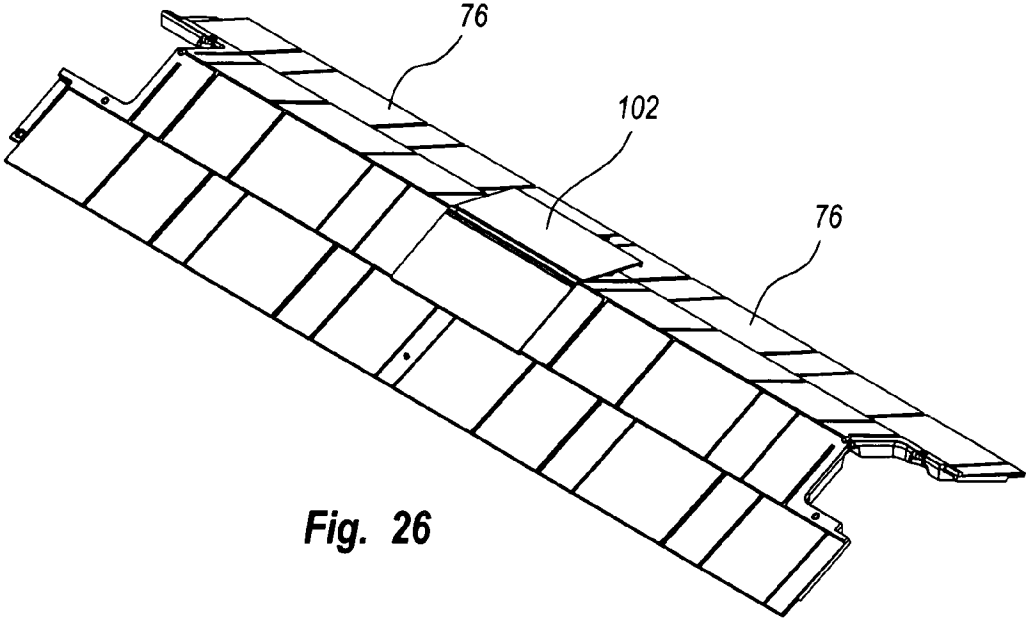
FIG. 26 is another perspective view of the connection of the skylight to the roof cap portions shown in FIG. 25.
Figure 27:
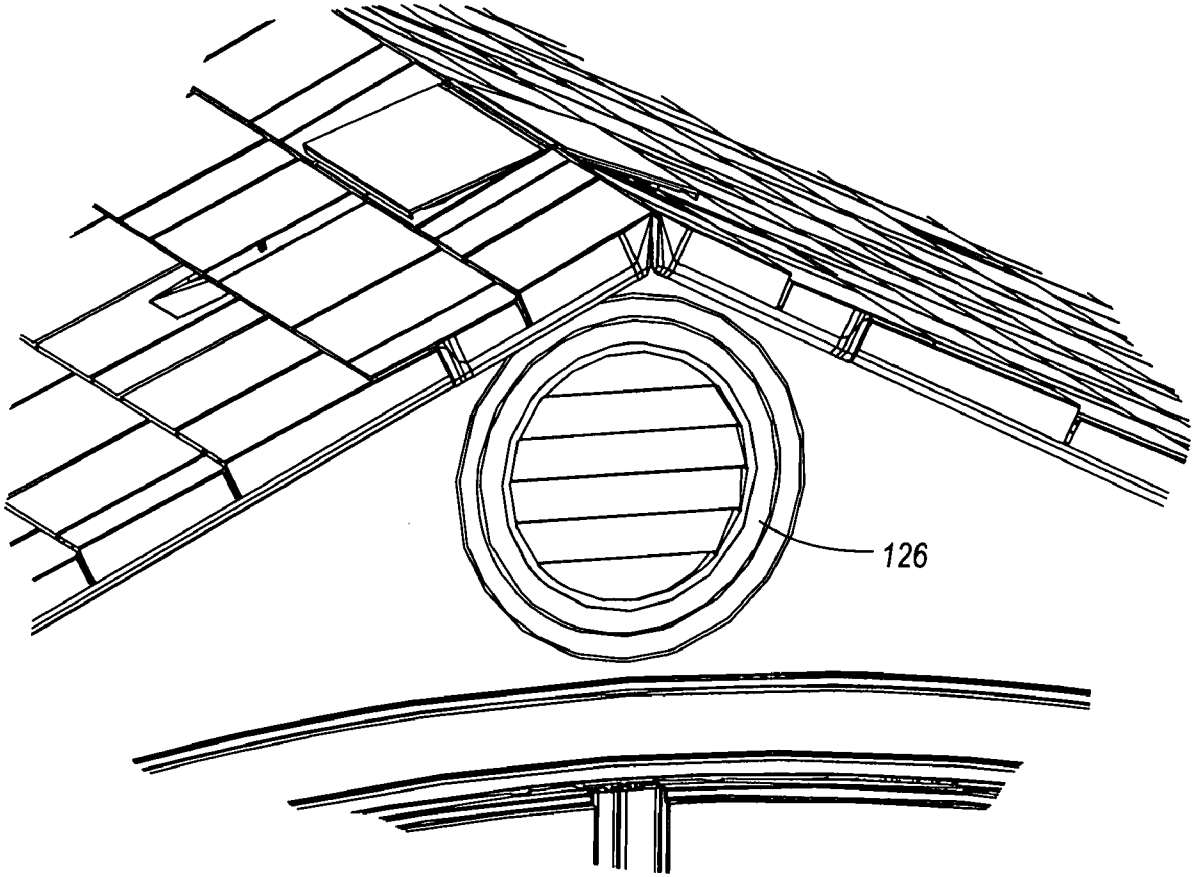
FIG. 27 is an enlarged perspective view of a portion of the shed shown in FIG. 1, illustrating a vent.

As shown in FIGS. 22, 23 and 24, the skylight 102 may include a first portion 104*a* and a second portion 104*b* that are connected by a living hinge 106 that allows the skylight to be selectively moved between a generally flat, planar position (as shown in FIGS. 22 and 23) that may facilitate packaging and an angled, use position (as shown in FIG. 24). The skylight 102 preferably includes a top surface, a bottom surface, a front side, a back side, a left side and a right side. A number of features may be formed on the bottom surface of skylight 102 to assist in connecting the skylight to roof 20. For example, the skylight 102 may include a plurality of ribs 110 that extend generally downwardly from the bottom surface of skylight. The ribs 110 are preferably positioned along the edge of the skylight 102 and the ribs may generally correspond to the size of aperture 100. The skylight 102 may also include a plurality of projections 112 that extend generally downwardly from the bottom surface of skylight. As shown in FIG. 23, some of the projections 112 can be formed on or along the living hinge 106. As shown in FIGS. 25 and 26, some of the projections 112 can also be sized and configured to be disposed in apertures 101*a* formed at or near the spaces on end roof cap portions 74 or intermediate roof cap portion 76. In addition, some of the projections 112 that are formed on or along the living hinge 106 can be disposed in apertures 101*b* formed on the living hinges of the end roof cap portions 74 or the intermediate roof cap portions 76.

When the skylight 102 is being attached to the roof 20, as shown in FIGS. 25 and 26, the skylight 102 may be positioned over the aperture 100 and at least partially inserted into the aperture so that the ribs 110 engage the sides of the aperture. The ribs 110 may be spaced apart slightly more than the perimeter of the aperture 100 so that the skylight 102 may be held within the aperture by a friction, snap or interference fit. The projections 112 may then be disposed in corresponding apertures 101. If desired, the one or more mechanical fasteners, such as screws, may then be used to secure the skylight 102 to the roof 20. On the other hand, all or a portion of the skylight 102 may be held by a friction, snap or interference fit to allow the skylight to be opened or closed. Advantageously, this may allow the skylight 102 to be used as a vent. One skilled in the art will appreciate that the skylight 102 can be attached to the roof 20 in any suitable manner and the skylights may be permanently or selectively attached to the roof.

As shown in the accompanying figures, the skylight 102 preferably has a substantially rectangular configuration, but it will be appreciated that the skylight may have any suitable configuration such as circular, oval, polygonal and the like. It will also be appreciated that the spaces formed in the end roof cap portions 74 and the intermediate roof cap portions 76 could have a different configuration and arrangement depending upon the size and configuration of the skylight.

The skylight 102 is preferably constructed from a relatively strong and durable material such as plastic. The plastic skylights 102 are preferably constructed by an injection molding process and the living hinge 106 is preferably integrally formed in the skylight, which may help create a watertight seal. It will be understood, however, that the skylight 102 could be constructed from other materials and processes with suitable characteristics.

The skylight 102 may also have other features and configurations, such as disclosed in Assignee's co-pending U.S. patent application Ser. No. 11/091,606, entitled MODULAR ENCLOSURE WITH LIVING HINGES, filed Mar. 28, 2005, which is incorporated by reference in its entirety.

Gables

Returning back to FIGS. 3 and 4, the shed 10 may also include one or more gables. In particular, the shed 10 may include a front gable 114 and rear gable 116, and these gables may form part of the roof 20. The front and rear gables 114, 116 are preferably constructed from panels and the panels may have generally the same construction as the wall and/or roof panels. For example, the gables 114, 116 may be constructed from blow-molded plastic, include one or more depressions that are sized and configured to increase the strength and/or rigidity of the gables, and include one or more reinforcing members. In addition, the front and rear gables 114, 116 preferably have a generally triangular shaped configuration that extends between the right sidewall and the left sidewall. Further, the front gable 114 preferable extends between the front wall and the roof 20 and the rear gable 116 preferably extends between the rear wall and the roof. It will be appreciated that the gables 114, 116 may have other suitable arrangements, configurations and characteristics depending, for example, upon the size, configuration and intended use of the shed 10.

As shown in FIG. 3, the front gable 114 may include a front surface, a rear surface, a top left portion, a top right portion, a bottom left portion, a bottom right portion and a central bottom portion. The central bottom portion of the front gable 114 is preferably sized and configured to conform to the shape of the doors 28. In particular, the central bottom portion of the front gable 114 may include a curved portion that is sized and configured to facilitate the doors 28. Additionally, the top left portion and the top right portion of the front gable 114 are preferably sized and configured to conform to the shape of the roof 20. The top left portion and the top right portion of the front gable 114 may include one or more protrusions that, as explained in further detail below, are sized and configured to assist in connecting the front gable 114 to the roof 20. In addition, the bottom left portion and the bottom right portion of the front gable 114 may include one or more protrusions that, as explained in further detail below, are sized and configured to assist in connecting the front gable 114 to the corner panels 26*a*, 26*d*. Further, the front gable 114 may include an aperture 124 that is sized and configured to receive a vent 126. Also, the front gable 114 may include one or more door stops 115 that are sized and configured to contact, engage and/or abut at least a portion of the door panels 28 to help secure the door panels in a closed position and/or to help restrict the movement of the door panels. The door stops 115 are preferably integrally formed in the front gable 114 as a unitary construction during the manufacturing process, but the door stops may be connected to the front gable or other suitable portion of the shed 10. While the vent 126 may increase circulation of the air within the shed 10, the vent is not required.

Additionally, as shown in FIG. 3, the front gable 114 may consist of a single panel that extends substantially from the left sidewall 16 to the right sidewall 18. Advantageously, because the front gable 114 may consist of a single panel, that may facilitate assembly of the shed 10 and help create a strong and sturdy shed. It will be appreciated, however, that the gable 114 may consist of two or more parts and it may have other suitable designs and configurations.

As shown in FIG. 4, the rear gable 116 may includes a front surface, a rear surface, a top left portion, a top right portion and a bottom portion. The bottom portion of the rear gable 116 is preferably sized and configured to conform to the shape of the rear wall 14. The top left portion and the top right portion of the rear gable 116 are preferably sized and configured to conform to the shape of the roof 20. In addition, the top left portion and the top right portion of the rear gable 116 may include one or more protrusions that are sized and configured to assist in connecting the rear gable 116 to roof 20. The bottom portion may also include one or more protrusions that are sized and configured to assist in connecting the rear gable 116 to the rear wall 14. Further, the rear gable 116 may include an aperture 134 that is sized and configured to receive a vent 136, but the aperture and vent are not required. Also, the rear gable 116 may include one or more extensions 117 sized and configured to mate with and/or be received into corresponding channels 40 in the wall panels 24*d*, 24*e*.

FIG. 4 illustrates that the rear gable 116 can be formed from two parts 116*a*, 116*b* that may be interconnected. For example, the rear gable 116 may be formed with two generally identical portions that are mirror images of each other. In addition, a portion of the aperture 134 may be formed in one portion of the rear gable 116 and another portion of the aperture may be formed in the other portion of the rear gable. Advantageously, forming the rear gable 116 in two pieces may facilitate packaging of the shed 10, discussed further below.

One or more protrusions (not shown) can be used to connect the front and rear gables 114, 116 to the lower roof panels 72*a*, 72*d*, 72*e*, 72*h*. In greater detail, the protrusions are preferably connected to the front and rear gables 114, 116, respectively, by living hinges. Advantageously, the living hinges allow the protrusions to be moved between a generally planar, flat position that may facilitate shipping and an angled, use position that may facilitate attachment of the gables 114, 116 to the lower roof panels 72*a*, 72*d*, 72*e*, 72*h*. In particular, when the protrusions are folded into the used position, the protrusions can be disposed adjacent or next to the bottom surface of lower roof panels 74. The protrusions can then be attached to the lower roof panels 74 by any suitable type of connection, such as mechanical fasteners. The protrusions may comprise, for example, flaps having a generally rectangular configuration. Further, additional protrusions

122, 132 formed on the bottom portions of the gable 114, 116 can be connected to the corner panels 26*a-d* by any suitable type of connection, such as mechanical fasteners. Preferably, the protrusions 122, 132 may have a smaller thickness than the corner panels 26*a-d* so that the bottom portions of the front gable 114 and the rear gable 116 can rest on the top of the wall panels 24*d*, 24*e* and/or the corner panels 26*a-d*. If desired, the front and rear gables 114 and 116 may include one or more screw bosses so that the front and rear gables can be attached to the lower roof panels 74, wall panels 24*d*, 24*e*, and/or the corner panels 26*a-d* using screws or other suitable fasteners. Further, the wall panels 24*d*, 24*e* may also include one or more portions 39 that may include screw bosses sized and configured to receive a screw or other fastener to connect so that the wall panels to the rear gable 116. One of ordinary skill in the art will appreciate that the gables 114, 116; walls 12, 14, 16, 18; the protrusions of the gables; and roof 20 may have other suitable arrangements and configurations to allow the shed 10 to be formed and assembled.

As discussed above and shown in FIGS. 1-4, the front gable 114 can include the vent 126 disposed within the aperture 124. The vent 126 may include an outer edge and a plurality of slats. The vent 126 can also include a rib that extends outwardly from the bottom surface, if desired. The vent 126 can be constructed from extrusion molded plastic, for example, and the vent is preferably removable to allow it to be repaired and/or replaced. For example, the vent 126 could be secured to the aperture 124 by snap, friction or interference fit. The vent 126 can also be secured to the aperture 124 by mechanical fasteners such as screws. In addition, the front portion of the aperture 124 can include a recess or depression that is sized and configured to receive the outer edge of the vent 126, which may allow the outer surface of the vent to be generally aligned with the outer surface of the gable.

It will be appreciated that the gables 114, 116 could also have other suitable configurations and arrangements depending, for example, upon the intended use of the shed 10. The gables 114, 116 may also other suitable features, such as the features described in Assignee's co-pending U.S. patent application Ser. No. 11/091,811, entitled ROOF SYSTEM FOR A MODULAR ENCLOSURE, filed Mar. 28, 2005, which is incorporated by reference in its entirety.

Floor

As discussed above, the shed 10 preferably includes a floor 22 and the floor may provide a base or foundation for the shed. The floor 22 may also help position various components of the shed 10, such as the walls 12, 14, 16, 18 and doors 28. In addition, the floor 22 may increase the potential uses of the shed 10 and it may allow the shed to be used in a wide variety of situations and environments. Further, the floor 22 may include one or more floor panels and the floor panels may be interchangeable. This may allow the floor 22 to be part of a modular construction and, as discussed in greater detail below, the floor panels may have generally the same size and configuration as the wall panels and/or roof panels, which may facilitate manufacturing, shipping and transport of the shed. The floor panels may also have the same type of construction and/or structure as the as the wall panels and/or roof panels, which may also facilitate manufacturing of the shed.

Figure 30:
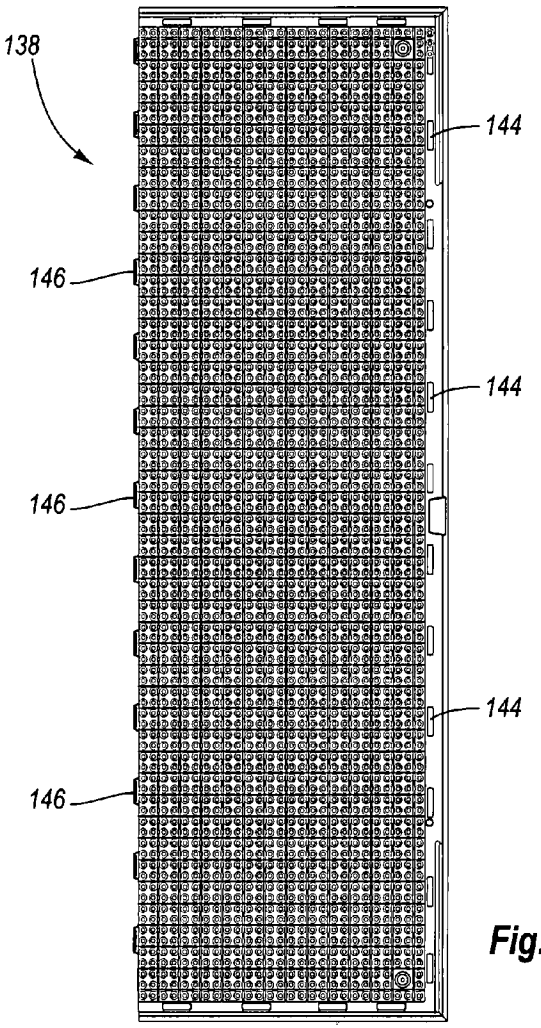
FIG. 30 is a top view of the floor panel shown in FIG. 28.
Figure 29:
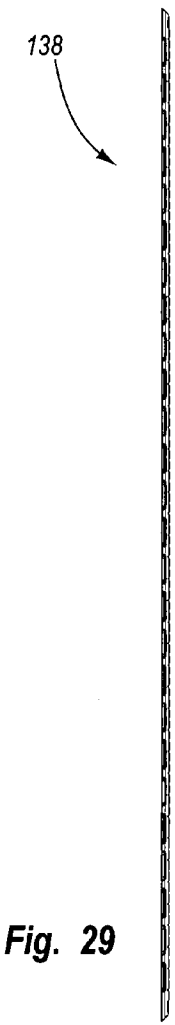
FIG. 29 is a side view of the floor panel shown in FIG. 28.
Figure 28:
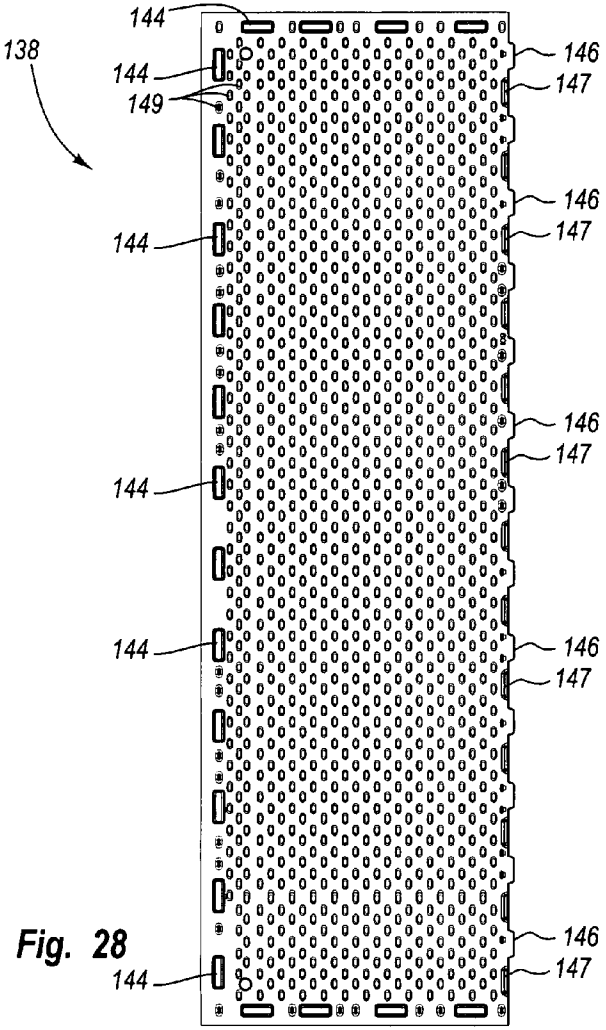
FIG. 28 is a bottom view of a portion of the shed shown in FIG. 1, illustrating an exemplary floor panel.
Figure 32:
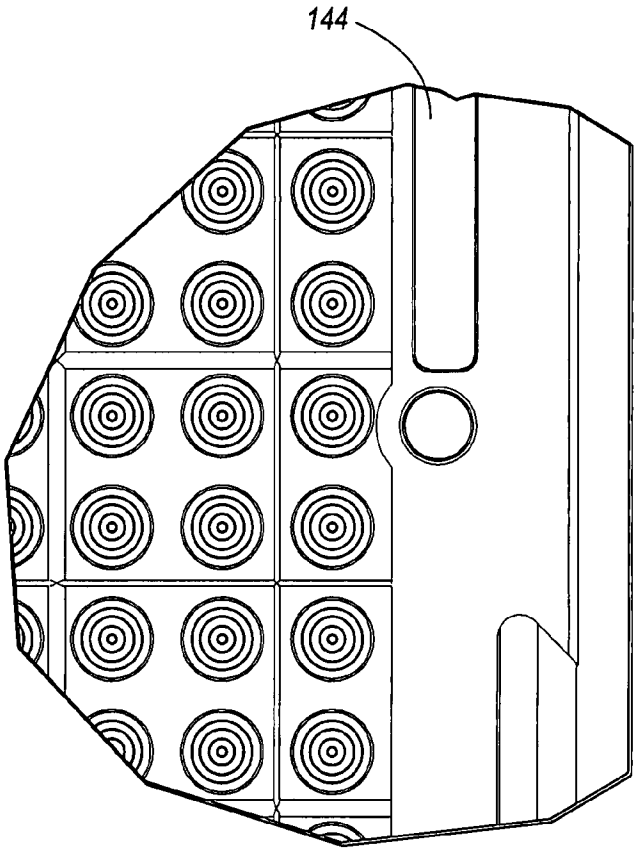
FIG. 32 is an enlarged top view of a portion of the floor panel shown in FIG. 28, illustrating a pattern on the upper surface.

In greater detail, as seen in FIGS. 3 and 4, the floor 22 preferably has a modular construction including end floor panels 138*a*, 138*b* and intermediate floor panels 140*a*, 140*b*. Each of the floor panels 138, 140 may include a top portion, a bottom portion, a front side, a rear side, a left side and a right side. As shown in FIGS. 28, 29 and 30, each of the end floor panels 138*a*, 138*b* may include a plurality of receiving portions 144 that are preferably sized and configured to allow, for example, the walls 12, 14, 16, 18 to be connected to the floor 22. Desirably, the receiving portions 144 are formed along three of the sides of the end floor panels 138*a*, 138*b*. In greater detail, the end floor panels 138*a*, 138*b* may include receiving portions 144 that are disposed along the left side, the right side and either the front side or the rear side. Similarly, the intermediate floor panels 140*a*, 140*b* may include such receiving portions 144 formed along two of their sides, in particular, the left side and the right side.

The sides of a floor panel without the receiving portions 144 may be sized and configured to be connected to an adjacent floor panel. In particular, the side of the end floor panels 138 without the receiving portions 144 may include a plurality of outwardly extending portions or protrusions that are sized and configured to be attached to an intermediate floor panel 140, and the sides of the intermediate floor panel 140 without the receiving portions 144 may also include a plurality of outwardly extending portions or protrusions that are sized and configured to be attached to an intermediate floor panel 140 or an end floor panel 138. For example, as shown in FIGS. 28-30, the end floor panels 138 may include one or more inwardly extending or recessed portions 147 sized and configured to contact, engage, and/or overlap corresponding protrusions of an intermediate floor panel 140, and the end floor panels may include one or more protrusions 146 sized and configured to contact, engage, and/or overlap corresponding inwardly extending or recessed portions of an intermediate floor panel. Similarly, an intermediate floor panel 140 may include one or more inwardly extending or recessed portions sized and configured to contact, engage, and/or overlap corresponding protrusions of a pair of adjacent floor panels 138, 140, and the pair of floor panels may include one or more protrusions sized and configured to contact, engage, and/or overlap corresponding inwardly extending or recessed portions of the intermediate floor panel. As shown in FIGS. 28-30, the protrusions 146 and the recessed portions 147 of a floor panel 138, 140 preferably alternate, and the protrusions are preferably flush with the bottom surface of the floor panels. In one embodiment, rather than alternating, the protrusions 146 and the recessed portions 147 of a floor panel 138, 140 may be generally aligned, and the protrusions may be alternately flush with top surface or bottom surface of the floor panel. When the two adjacent floor panels are connected by the overlapping and/or corresponding portions, the floor panels may be securely connected. In particular, the floor panels may be connected by a snap, friction or interference fit, or other suitable type of connection. Additionally, if desired, the connection can be reinforced by using, for example, mechanical fasteners such as screws.

Figure 31:
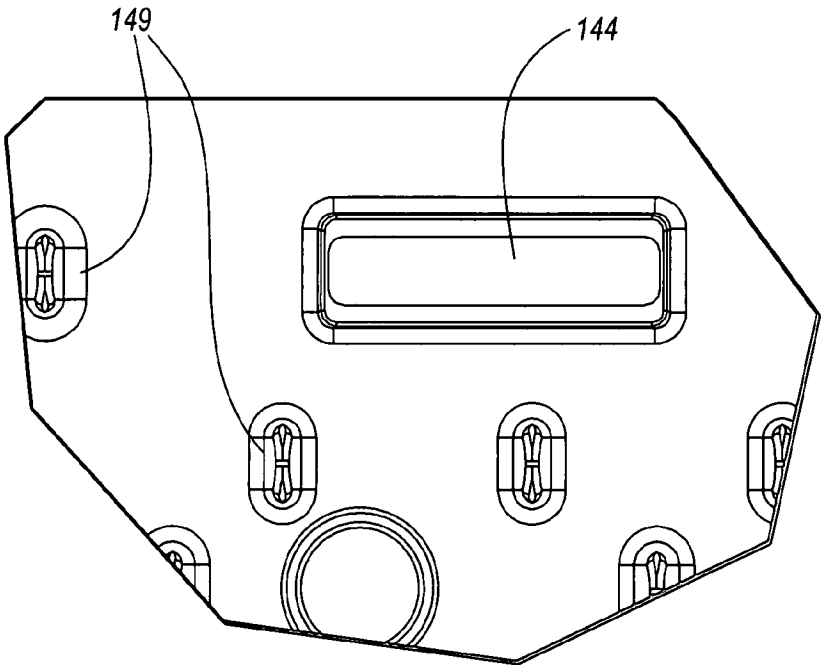
FIG. 31 is an enlarged bottom view of a portion of the floor panel shown in FIG. 28, illustrating a plurality of depressions formed in the lower surface and extending towards the upper surface.

The bottom surface of end floor panels 138 and the intermediate floor panels 140 may include a plurality of depressions, such as depressions 149 shown in FIG. 28 and 31. As discussed above, the depressions may be sized and configured to increase the strength and/or rigidity of the floor panels 138, 140. In particular, the depressions preferably cover substantially the entire bottom surface of the floor panels 138, 140 so that the panels have generally the same characteristics. It will be appreciated that the depressions may provide an integral support structure to the upper surface of the floor panels 138, 140 and the ends of the depressions may contact or engage the upper surface of the floor panels. On the other hand, the ends of the depressions may also be spaced apart from the upper surface of the floor panels 138, 140. In addition, the depressions are preferably closely spaced in a predetermined patter or array.

As discussed above, while it was previously believed that structures constructed from blow-molded plastic were made stronger by making the walls thicker and/or adding reinforcement structures such as ribs. The increased number of closely spaced depressions, however, provides the surprising and unexpected result that a stronger structure may be created without increasing the wall thickness or adding reinforcement structures such as ribs. In fact, the plurality of closely spaced depressions may allow the structures to be constructed with thinner walls. In addition, the plurality of closely spaced depressions may increase the strength and structural integrity of the structure despite forming disruptions in the continuity of bottom surface of floor panels 138, 140 and less plastic can be used to make the structure even though the plurality of depressions are formed in the structure. The costs of manufacturing and transportation may be decreased because less plastic may be used to construct the floor panels 138, 140 and the panels may allow a lighter weight shed to be constructed.

In particular, the plurality of closely spaced depressions may allow the thickness of the floor panels 138, 140 to be decreased. For example, the floor panels 138, 140 may now have a thickness of about 0.75 inches (1.9 centimeters) and still have the required strength and structural integrity. Additionally, as discussed above, one or both sides of the floor panels 138, 140 may include designs or patterns that allow the height and/or size of the depressions to be decreased. For example, one side of the floor panels 138, 140 may include a pattern and the other side of the floor panels may have a different pattern. The patterns are preferably sized and configured to include a number of points of intersection where the opposing surfaces are more closely spaced than other portions of the panels 138, 140. Advantageously, this may allow depressions to be located at the points of intersection of the patterns and the depressions may have a smaller size and/or height because the distance separating these points may be smaller. Because the depressions have a smaller size and/or height, that may allow the floor panels to be constructed with a thickness of about 0.75 inches (1.9 centimeters) or less.

The floor panels 138, 140 are preferably sized and configured to be directly connected to the walls 12, 14, 16, 18. As discussed above, the wall panels 24*a-b* and the corner panels 26*a-d* may include a number of outwardly extending protrusions 38 that are sized and configured to connect the wall panels to the floor panels 138, 140. In particular, as shown in the accompanying figures, exemplary wall panels 24*a*, 24*b* are joined together and connected to exemplary floor panel 140*a*. The protrusions 38 extending outwardly from the wall panels 24*a*, 24*b* are at least partially disposed within the receiving portions 144 formed in the floor panels 138, 140. Advantageously, the interconnection between the floor panels 138, 140 and the wall panels 24 or the corner panels 26 can be made by snap, interference or friction fit. In addition, as discussed above, the protrusions 38 can include one or more locking portions 38*a* and the receiving portions 144 can have a smaller opening or inwardly extending lip. The locking portions 38*a* and the opening or inwardly extending lip are preferably sized and configured so that as the protrusions 38 are being inserted into the receiving portions 144, the opening or inwardly extending lip may move, deform or deflect slightly to allow the protrusion to be inserted into the receiving portion. When the protrusion 38 is fully disposed within the receiving portion 144, the locking portions 38*a* may help prevent the wall or corner panel 24, 26 from being inadvertently removed from the floor panel 138, 140. Advantageously, the various protrusions 38, locking portions 38*a*, receiving portions 144 and the like may allow the components to be connected in a modular or interchangeable manner.

One of ordinary skill in the art will appreciate that the floor 22 and the interconnection of the walls 12, 14, 16, 18 and the floor could have other suitable arrangements and configurations. For example, floor 22 may include one or more features described in Assignee's co-pending U.S. patent application Ser. No. 11/091,861, entitled FLOOR FOR A MODULAR ENCLOSURE , filed Mar 28, 2005, which is incorporated by reference in its entirety.

Offset Configuration

Figure 47:
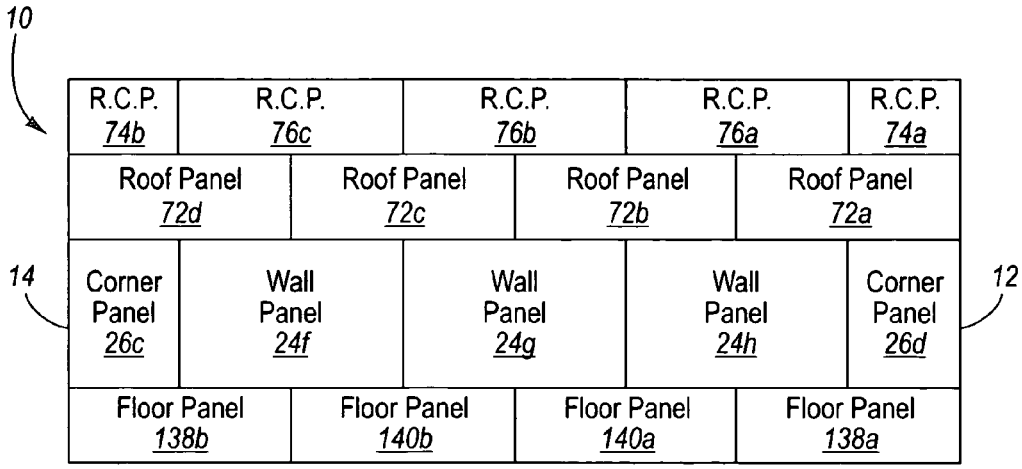
FIG. 47 is a block diagram of a left side view of a shed, illustrating an exemplary configuration of the roof caps, roof panels, corner panels, wall panels and floor panels.
Figure 48:
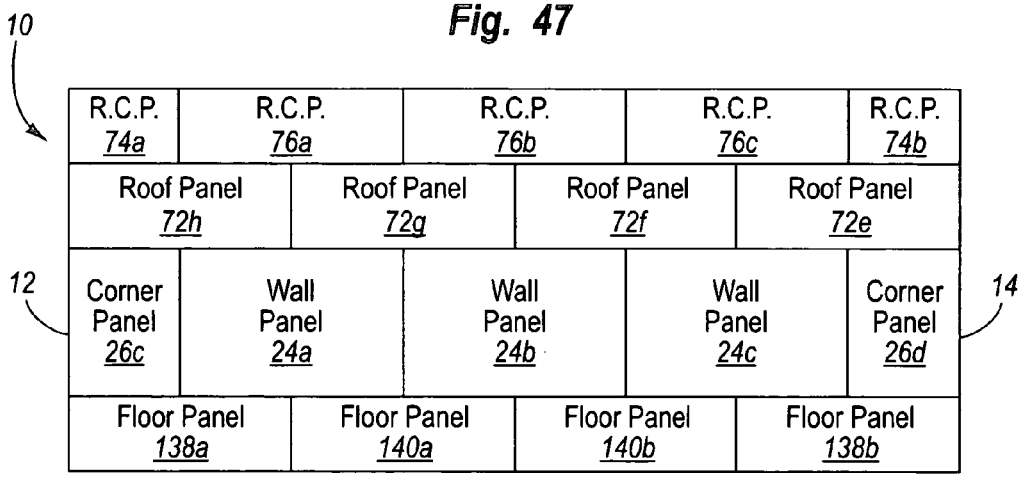
FIG. 48 is a block diagram of a right side view of a shed, illustrating an exemplary configuration of the roof caps, roof panels, corner panels, wall panels and floor panels.

As shown in FIGS. 1-4 and in FIGS. 47 and 48, the connection of the floor panels 138, 140 may be offset from the connection of wall panels 24 and/or the connection of wall panels 24 and corner panels 26. This configuration can assist making a strong and sturdy shed 10 because the connections or seams formed by joining adjacent floor panels 138, 140 and the connections or seams formed by joining adjacent wall panels 24 (and/or a wall panel 24 and a corner panel 26) are not aligned. In addition, as seen in FIGS. 1-4 and in FIGS. 47 and 48, the connection of the roof panels 72 may be offset from the connection of wall panels 24 and/or the connection of wall panels 24 and corner panels 26. Preferably, the connection of the floor panels 138, 140 and the connection of the roof panels 72 are generally vertically aligned and these connections are offset or spaced apart from the connection of the wall panels 24 to wall panels 24 or corner panels 26. Advantageously, this may allow a strong and sturdy shed 10 to be constructed.

Significantly, the offset or spaced apart connection between the floor panels 138, 140 and the panels 24, 26; and the offset or spaced apart connection between the roof panels 72 and the panels 24, 26 may be created by the corner panels 26. As discussed above, the corner panels 26 desirably include a living hinge, which may bisects the panel in half. Thus, the corner panel 26 preferably has one-half the width of a wall panel 24. The wall panels 24, roof panels 72 and floor panels 138, 140, preferably have generally the same width. Therefore, when the shed 10 is assembled, the corner panels 26 with the living hinges cause the connection of the wall panels 24, 26 to be offset from the connection of the roof panels and floor panels. This offset configuration can assist to strengthen the interlocking connections formed between wall panels 24, corner panels 26, roof panels 72, and floor panels 138, 140. Further, this offset configuration may increase the structural integrity of the shed 10 by staggering the locations of the connection of the panels. The shed 10, however, may be relatively easy to assembly, manufacture and ship because the wall, corner, roof and floor panels may have generally the same dimensions when the corner panels are disposed in the flat, planar configuration.

The size and configuration of the shed 10 may also be changed, if desired. For example, the shed 10 may have specified dimensions, but the dimensions may be changed to expand or contract the size of the shed. In particular, an expansion kit may be used to change the size and configuration of the shed 10. Advantageously, this may allow the shed 10 to be sold with one size and expansion kits may also be sold to allow the size and configuration of the shed to be changed. This may greatly enhance the potential uses of the shed 10.

Figure 49:
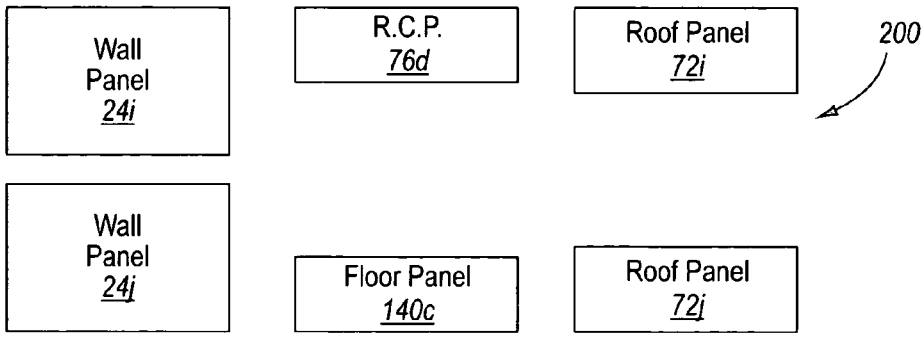
FIG. 49 is a block diagram of an exemplary embodiment of an extension kit.
Figure 50:
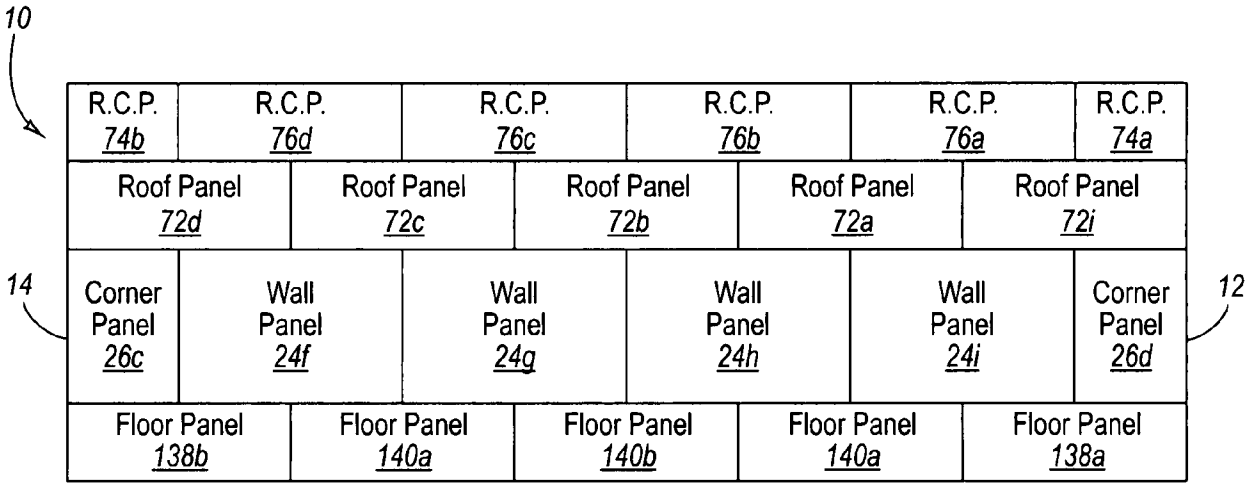
FIG. 50 is a block diagram of a left side view of the shed shown in FIG. 47, illustrating a use of the extension kit shown in FIG. 49 to enlarge the size of the shed.
Figure 51:
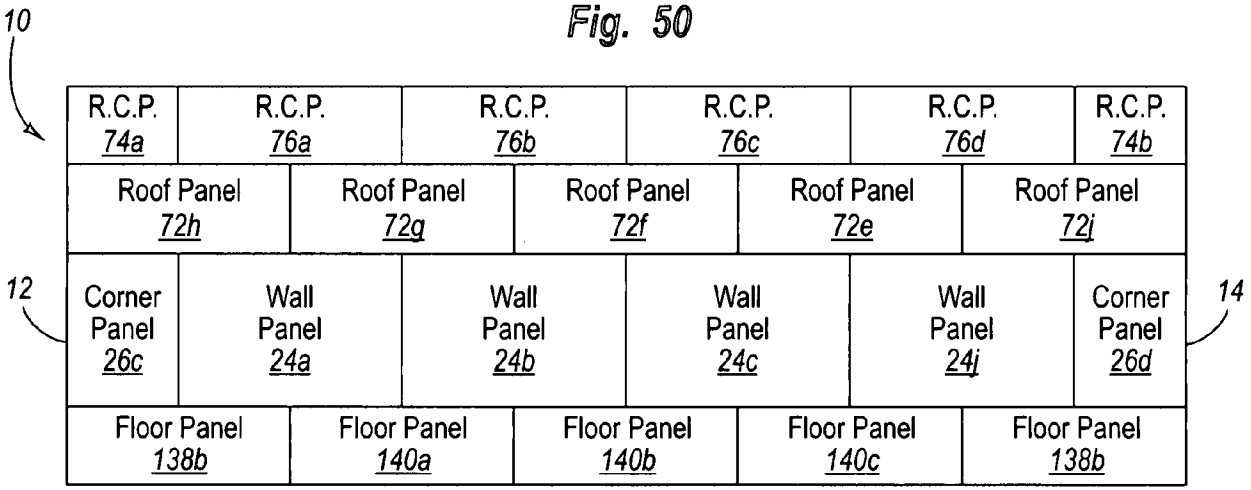
FIG. 51 is a block diagram of a right side view of the shed shown in FIG. 50.
Figure 52:
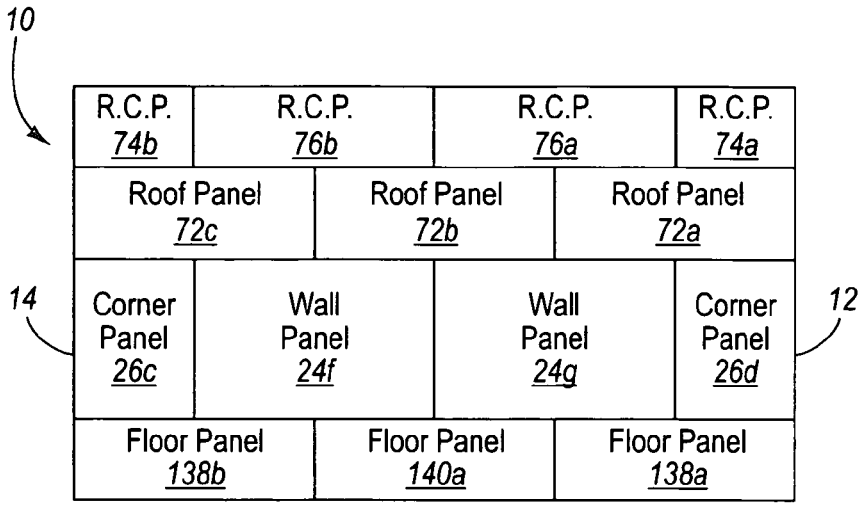
FIG. 52 is a block diagram of a left side view of the shed shown in FIG. 47, illustrating the shed contracted in position.
Figure 53:
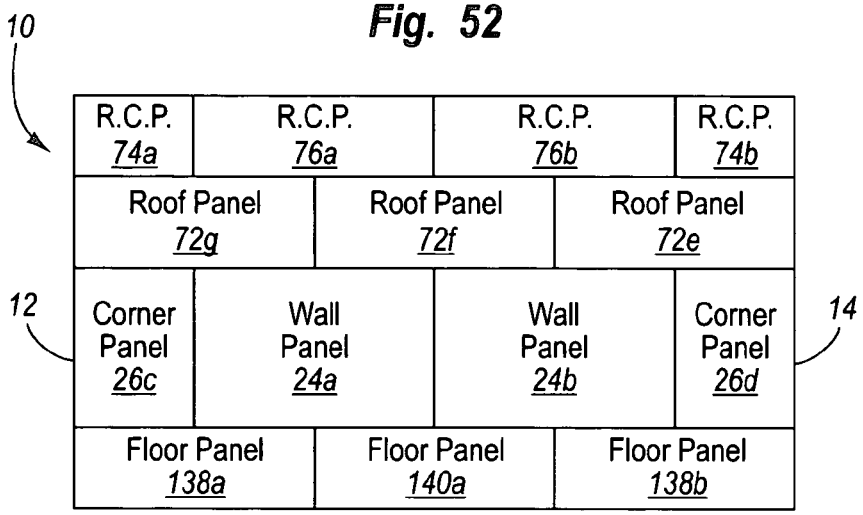
FIG. 53 is a block diagram of a right side view of the shed shown in FIG. 52.
Figure 54:
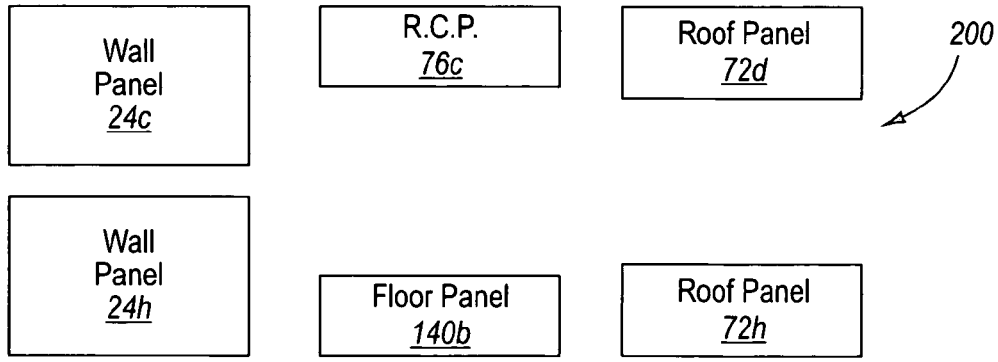
FIG. 54 is a block diagram of an exemplary embodiment of the components of the shed shown in FIG. 47.

For example, the shed 10 may have a first size as shown in FIGS. 47 and 48 and the shed 10 may be expanded to the size shown in FIGS. 50 and 51 using an expansion kit 200. In particular, as shown in FIG. 49, the expansion kit 200 may include a wall panel 24*i*, a wall panel 24*j*, an intermediate roof cap portion 76*d*, an intermediate floor panel 140*c*, a lower roof panel 72*i* and a lower roof panel 72*j*. As shown in FIGS. 50 and 51, the expansion kit 200 may be used to provide, for example, a longer shed 10. The expansion kit 200 may also include a truss, one or more fasteners, and/or other components suitable for expanding the size of the shed 10. Also, the size of the shed 10 shown in FIGS. 47 and 48 may be contracted to the size shown in FIGS. 52 and 53 by removing various components, such as those shown in FIG. 54. Thus, it will be understood that the shed 10 may have a variety of suitable sizes and configurations.

It will be appreciated that the shed 10 may have other suitable arrangements and configurations. For instance, the shed 10 may include one or more of the features disclosed in Assignee's co-pending U.S. patent Ser. No. 11/091,837, entitled MODULAR ENCLOSURE WITH OFFSET PANELS, filed Mar. 28, 2005, which is incorporated by reference in its entirety.

Door Assembly

The shed 10 preferably includes a door assembly which, as discussed above, may include one or more doors 28. For example, as shown in FIGS. 1 and 3, the shed 10 may include two doors 28 and each door may include a door panel 28*a*, 28*b*. However, it will be appreciated that the shed 10 can include any suitable number of doors and door panels. Advantageously, the door panels 28*a*, 28*b* may have similar characteristics and constructions as the floor panels, wall panels and/or roof panels. In particular, the door panels 28*a*, 28*b* are preferably constructed from blow-molded plastic and the door panels may include one or more reinforcing members. Additionally, the door panels 28*a*, 28*b* may include one or more depressions that may be sized and configured to increase the strength and/or structural integrity of the door panels. Further, one or both sides of the door panels 28*a*, 28*b* may include a pattern or design. Preferably, both sides of the door panels 28*a*, 28*b* include patterns or designs and the patterns are sized and configured so that a number of points of intersection are formed between the patterns and depressions can be disposed at these points of intersection. Significantly, as discussed above, locating one or more depressions at these points of intersection may minimize the size of the depressions and that may allow door panels 28*a*, 28*b* to be constructed with less plastic and/or lighter weight.

Figure 33:
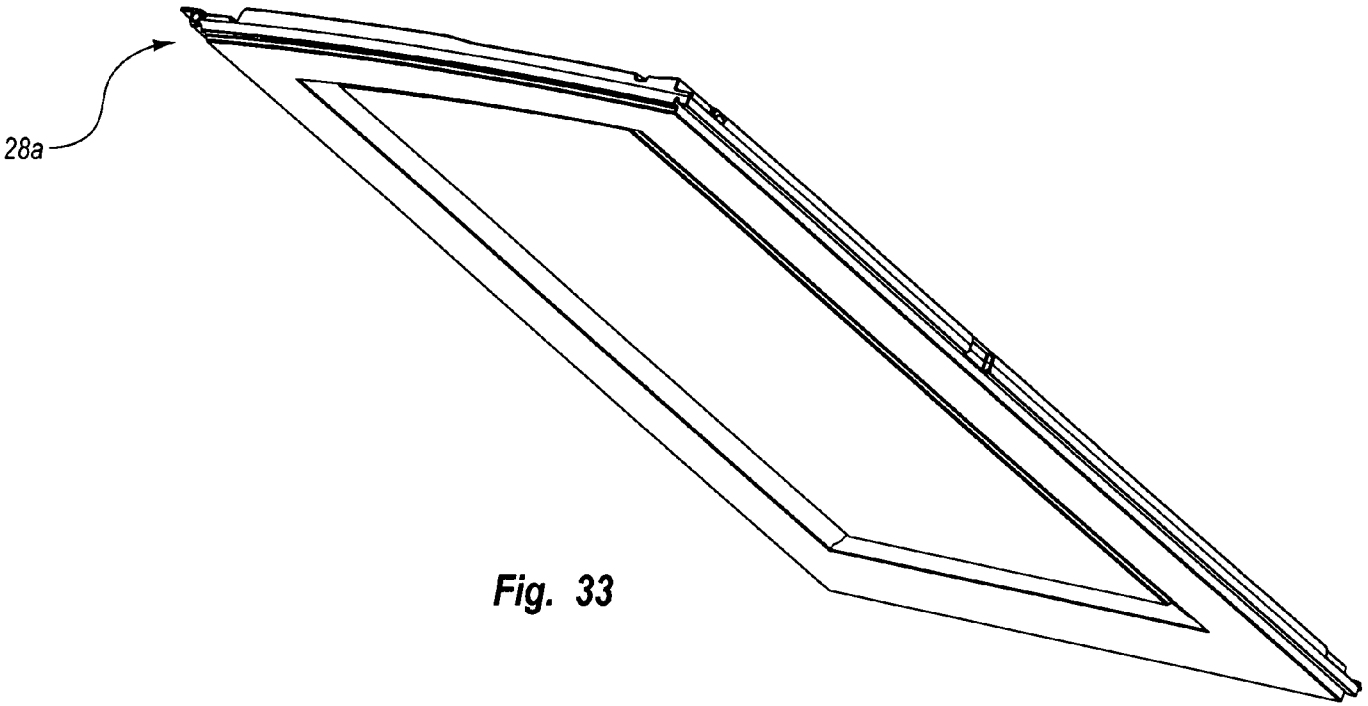
FIG. 33 is a perspective view of a portion of the shed shown in FIG. 1, illustrating an exemplary door panel.
Figure 34:
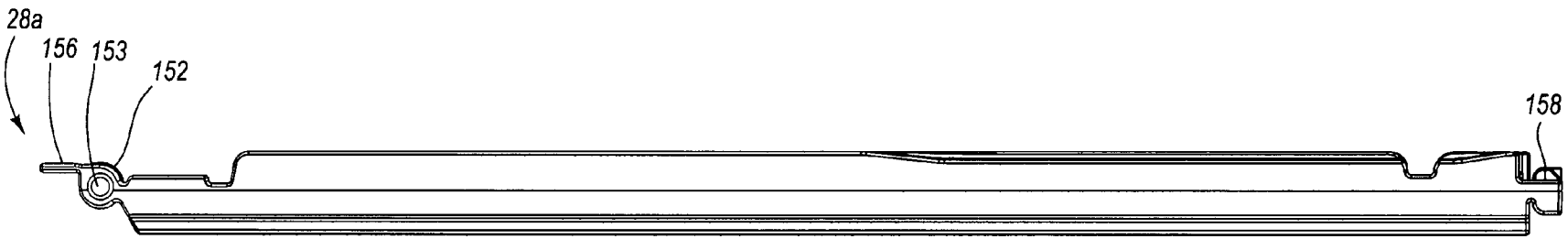
FIG. 34 is a top view of the door panel shown in FIG. 33.

As seen in FIGS. 33 and 34, the door panel 28*a* will now be discussed in greater detail. It will be appreciated that the door panel 28*b* preferably has a generally similar configuration and construction. The door panel 28*a* preferably has a generally rectangular configuration with a front side, a rear side, a top portion, a bottom portion, an outer portion and an inner portion. As shown in FIGS. 1 and 4, the top portion of the door panel 28*a*, however, may be curved to form an arched door. Consequently, the bottom center portion of the front gable 114 may have a complimentary curved configuration that corresponds to the top portion of the door panel 28*a*. One of ordinary skill in the art will appreciate that the door 28 and door panel 28*a* may have other suitable configurations, designs and arrangements depending, for upon, upon the intended aesthetics or uses of the shed 10.

As shown in FIGS. 33 and 34, the door panel 28*a* may include a hinge portion 152 that is sized and configured to allow the door 28 to open and close. The hinge portion 152 is preferably integrally formed with the door panel 28*a*, but it will be appreciated that the hinge portion can also be a separate component and/or separately constructed. The hinge portion 152 preferably includes an elongated receiving portion 153 that is sized and configured to receive a hinge member 154. The hinge member 154 is preferably a hollow or solid metal rod that has a length approximately equal to or slightly greater than the height of the door panel 28*a*. It will be appreciated that the hinge member 154 may also include one or more components and the hinge member could have other suitable shapes and configurations. Preferably, the hinge member 154 is pivotally connected to the shed 10 to allow the door panel 28*a* to be opened and closed. For example, the lower end of the hinge member 154 can be disposed in an aperture or recess formed in the top surface of the floor panel 138 and the upper end of the hinge member can be disposed in an aperture or recess formed in the bottom portion of the front gable 114. Thus, the door panel 28*a* can pivot about the hinge member 154 and/or the hinge member may be pivotally connected to the shed 10.

The door panel 28*a* may also include an outwardly extending flange or barrier 156. The flange 156 preferably extends outwardly from the hinge portion 152 and it is preferably an elongated thin strip of plastic that extends along the length of the hinge portion. Advantageously, the flange 156 may help prevent water or foreign objects from entering the shed 10. In particular, the flange 156 is preferably generally aligned with in the door panel 28*a* and when the door 28 is in the closed position, the flange is preferably generally flush with the inner surface of the corner panel 26*d*. The inner surface of the corner panel 26*d* may include a recess or indentation so that the flange 156 is generally parallel to the inner surface. Thus, when the door panel 28*a* is closed, the flange 156 may cover the opening or the seam disposed between the corner panel 26*d* and the door panel. Accordingly, the flange 156 may act as a seal to prevent water or other objects from undesirably entering the shed 10. Preferably, the flange 156 and the hinge portion 152 are integrally formed with the door panel 28*a* as part of a one-piece construction so that the connection is waterproof. It will be appreciated, however, that the flange 156 does not have to be a unitary part of the hinge portion 152 or the door 28. It will also be appreciated that the flange 156 may have other suitable shapes and configurations, and the flange is not required.

Advantageously, the hinge member 154 may help reinforce and strengthen the door panel 28*a*. In addition, as discussed above, the door panel 28*a* may include one or more reinforcing members. In particular, one side of the door panel 28*a* may be reinforced by the hinge member 154 and the other side may be reinforced by another reinforcing member (not shown). Desirably, the reinforcing member (not shown) is a metal strip that is disposed along the outer surface of the door panel 28*a*. Advantageously, if the reinforcing member (not shown) is disposed on the outer surface of the door panel 28*a*, it may create the appearance of a stronger and more rigid door. In addition, the exposed reinforcing member (not shown) may allow the door 28 to be more securely closed and the increased weight may create a door with a more rigid feel. As discussed above, the reinforcing member (not shown) preferably has different characteristics than the door panel 28*a* and the reinforcing member may be sized and configured to increase the strength and rigidity of the door panel. It will be appreciated that all or a portion of the reinforcing member (not shown) may also be disposed within the door panel 28*a* and the reinforcing member may have other suitable arrangements and configurations.

As shown in FIG. 34, the inner portion of the door panel 28*a* can include an outwardly extending protrusion 158. The protrusion 158 is preferably an elongated member that extends along at least a portion of the length of the door panel 28*a*. The protrusion 158 may be sized and configured to contact, engage or interlock with other structures. In particular, the protrusion 158 may include an enlarged head that forms part of an interlocking mechanism. It will be appreciated that the protrusion 158 may have other suitable shapes and configurations, and the protrusion is not required.

Figure 35:
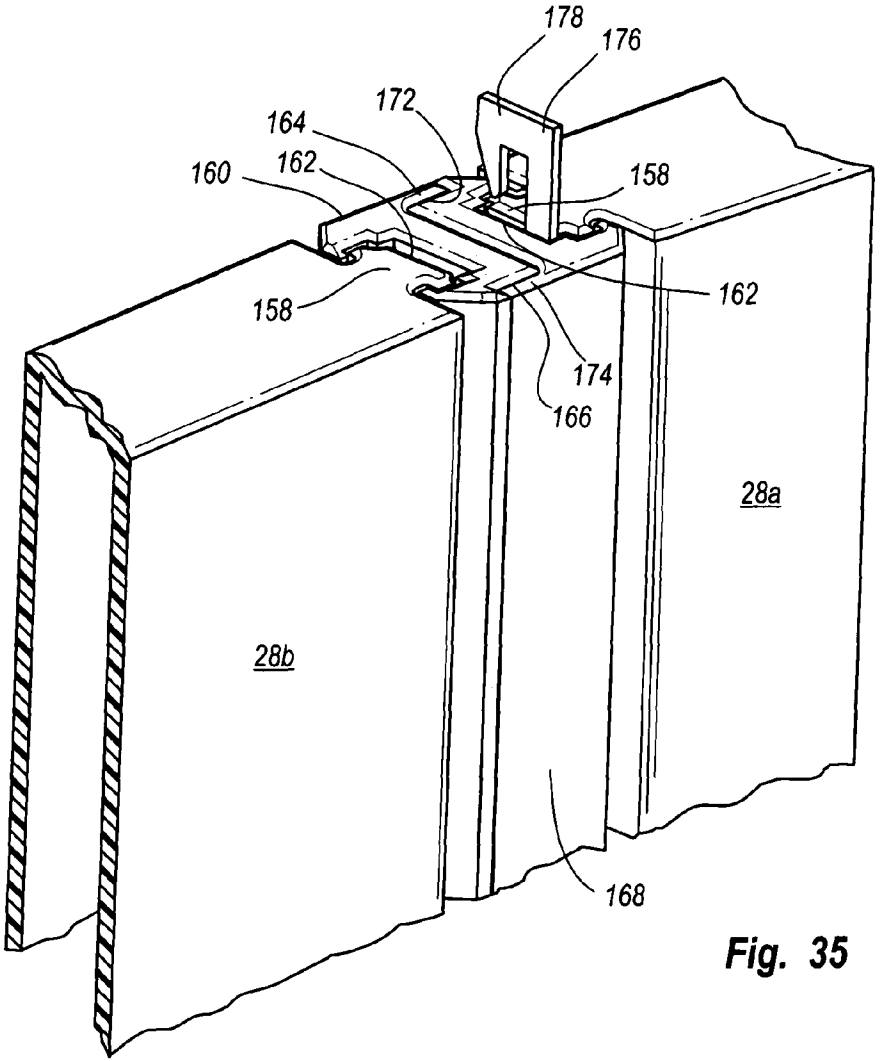
FIG. 35 is a perspective view of a portion of the shed shown in FIG. 1, illustrating an exemplary mechanism for securing the door in a closed position.
Figure 37:
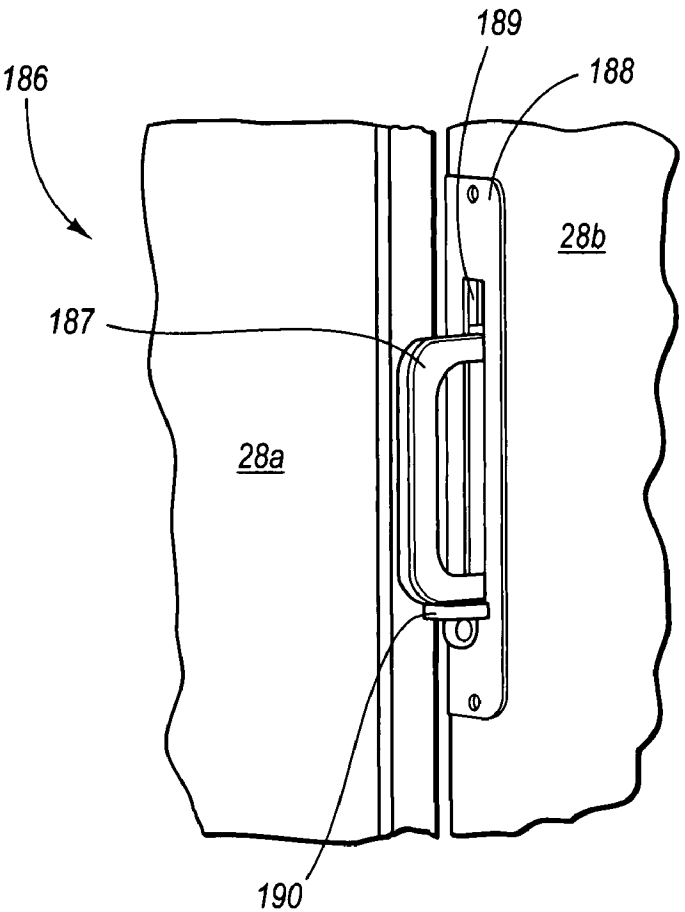
FIG. 37 perspective view of a portion of the shed shown in FIG. 1, illustrating an exemplary door handle.
Figure 36:
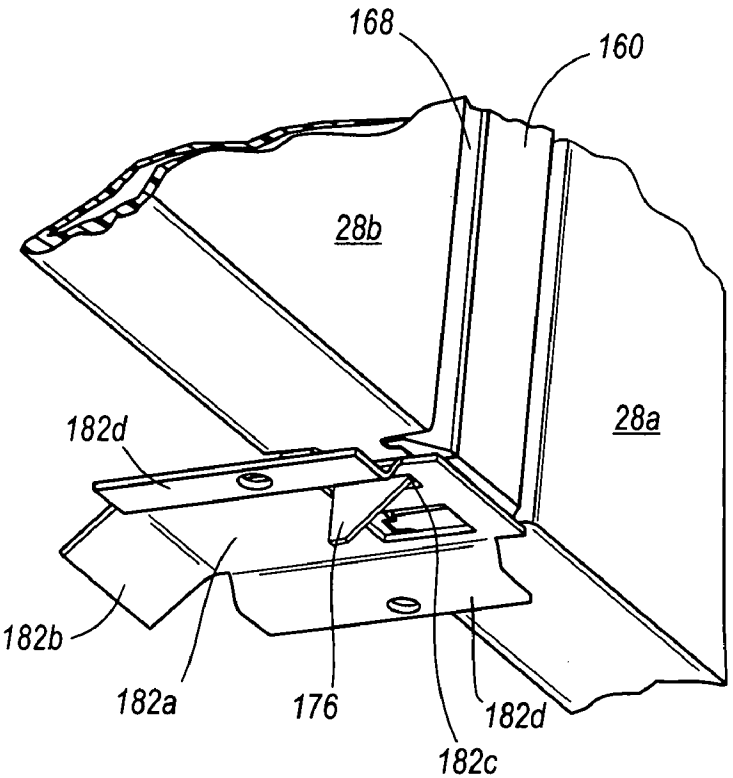
FIG. 36 is perspective view of a portion of the shed shown in FIG. 1, illustrating an exemplary mechanism for securing the door in a closed position.

The doors 28 may include a mechanism that allows the doors to be secured in the closed position and a handle that allows one or more of the doors to be more easily opened and closed. For example, as seen in FIGS. 35-37, a first frame 160 may be connected to the protrusion 158 on the door panel 28*a*. The first frame 160 may include a groove 162 that is sized and configured to interlock with the protrusion 158. The first frame 160 may also include an elongated protrusion 164. In addition, the first frame 160 may include an elongated recess or indentation 166. Preferably, the elongated protrusion 164 is generally aligned with the rear portion of the first frame 160 and the elongated recess is generally aligned with the front portion of the first frame.

As seen in FIGS. 35-37, the door panel 28*b* may include a second frame 168 that is sized and configured to be connected to the first frame 160. The second frame 168 may also include a groove 162 that is sized and configured to interlock with the protrusion 158 of the door panel 28*b*. The second frame 168 may also include an elongated recess or indentation 172. Additionally, the second frame 168 may include an elongated protrusion 174.

The first frame 160 and the second frame 168 preferably have matingly engageable surfaces. That is, the protrusion 164 formed on the first frame 160 is preferably sized and configured to be disposed in the recess 172 on the second frame 168. Similarly, the protrusion 174 on the second frame 168 is preferably sized and configured to be disposed in the recess 166 on the first frame 160. Significantly, the first frame 160 and the second frame 168 may be sized and configured to strengthen the inner portions of the door panels 28*a*, 28*b*. In addition, a reinforcing member may be partially or completely disposed in protrusion 164.

As shown in FIGS. 35 and 36, a latch may be used to secure the doors 28 in the closed position. The latch may include an elongated locking member 176, such as a metal bar, that is disposed between the protrusion 158 and the second frame 168 of the door panel 28*b*. Preferably, the locking member 176 has a length that is approximately equal to or greater than the length of the door panel 28*b*. A catch or securing portion 178 may be disposed at the upper end of the locking member 176. The catch or securing portion 178 preferably has a generally hook-shaped configuration that is sized and configured to help secure the door 28 in the closed position. The lower end of the locking member 176 is preferably sized and configured to be disposed in an opening or recess when the door 28 is in the closed position. In particular, as discussed in further detail below, the lower end of the locking member 176 may be tapered or angled to help position the end of the bar in the opening or recess. The locking member 176 is preferably constructed from steel and it preferably has a generally square or circular cross-section. It will be appreciated, however, that the locking member 176 may have other suitable configurations and arrangements, and the bar may be constructed from other suitable materials such as aluminum, plastics, composites and the like. Advantageously, the locking member 176 can also help reinforce the door 28 and/or increase the weight of the door so that it has a more solid feel.

As shown in FIG. 36, the latch may include a receiving member 180 that is connected to one of the end floor panels 138*a*. The receiving member 180 may include a body portion 182*a*, a ramp portion 182*b* that extends downwardly from the body portion, an aperture or recess 182*c* formed in the body portion and two edges 182*d* that extend downwardly and outwardly from the body portion. The receiving member 180 can be connected to the end floor panel 138*a* via the edges 182*d* and the receiving member is preferably positioned so that the lower end of the locking member 176 is disposed in the aperture or recess 182*c* when the door panel 28*b* is closed.

When the door 28 is being closed, the lower end of the locking member 176 may contact the ramp portion 182*b* of the receiving member 180 and the ramp portion causes the locking member to be raised. When the locking member 176 is raised, the securing portion 178 at the upper end of the metal bar is able to engage a locking portion, such as a metal bar or rod (not shown), disposed near the lower portion of the front gable 114. When the door 28 is fully closed, the lower end of the locking member 176 then falls into the aperture 182*c* and the securing portion 178 engages the locking portion. Thus, the upper and lower ends of the locking member 176 may be securely held in a fixed position when the door 28 is closed. Advantageously, the locking member 176 may prevent inadvertent opening of the doors 28.

To open the door 28, the locking member 176 is lifted upward to disengage the securing portion 178 from the locking portion and the lower end of the bar is lifted from the aperture or recess 182*c*. The door 28 can then be opened and the locking member 176 may slide along the ramp portion 182*b* of the receiving member 180. Advantageously, when the locking member 176 is not lifted upwardly, the securing portion 178 may engage a top portion of the door panel 28.

A handle assembly 186 may be used to assist in opening and closing the doors 28. For example, as seen in FIG. 37, the handle assembly 186 can be generally disposed on the door panel 28*b*, and the door panel 28*b* can include a recess or opening so that at least a portion of the locking member 176 may be accessed. This may allow the handle assembly 186 to be connected to the locking member 176. In greater detail, the handle assembly 186 may include a handle member 187 and a panel 188, which can be disposed proximate the recess or opening. The panel 188 may be used to seal off the space formed by the recess or opening in the door panel 28*b*. The panel 188 may also include a slot 189 and a locking portion 190 that extends outwardly from the panel. As shown in FIG. 37, the locking portion 190 may receive at least a portion of handle member 187, which may be secured using, for example a lock. As shown in the accompanying figures, the handle member 187 may be at least partially disposed in the slot 189, and the movement of the handle member may control the movement of the locking member 176. In particular, upward movement of the handle member 187 may also cause the locking member 176 to move upwardly and downward movement of the handle member may cause the locking member to move downwardly. Thus, handle member 187 may be used to move the locking member 176, which may facilitate opening and closing of the door 28. In addition, the handle member 187 may be moved between a locked position in which it secures the door 28 in a locked position and an unlocked position in which the door can be opened or closed.

It will be appreciated that the door, handle and locking mechanism may have other suitable shapes, configurations and arrangements. In addition, the door, handle and locking mechanism may have other features.

Packaging

Advantageously, the various components of the shed 10 may be sized and configured to be compactly packaged in one or more shipping boxes or other containers. For example, many of the components may have generally similar dimensions to facilitate packaging. In addition, some of the components may include one or more cavities or recesses in which other components of the shed 10 may be disposed. In particular, one or more of the panels may include an outwardly extending lip and the lip may help define a cavity or recess in which other components may be disposed. A number of the components may also be sized and configured to permit the components to be packaged in substantially uniform layers. For instance, many of the components may have substantially the same height and/or thickness to facilitate packaging of the shed 10.

As discussed above, various components may also include one or more living hinges that allow the components to be stored or packed in a generally flat or planar configuration. Significantly, this may minimize the size of the required packaging. In addition, the relatively small size of the packaging may allow the shed 10 to be more easily transported and stored. The relatively small size packaging may also facilitate the consumer transporting and moving the shed 10, such as from the store to the person's home or office In particular, the shed 10 is preferably sized and configured to be packaged within two packages. One of the packages may include the wall panels 24*a-h* and the corner panels 26*a-d*. The other packaging may include all of the other components of the shed 10. Advantageously, if the shed 10 has a width of approximately 8 feet (2.4 meters), length of approximately 10 feet (3 meters) and height of approximately 8 feet (2.4 meters), then it may be packaged within a first package that is about 72 inches (1.8 meters) by about 31 inches (0.8 meters) by about 12 inches (0.3 meters) and a second package that is about 94 inches (2.38 meters) by about 31 inches (0.8 meters) by about 12 inches (0.3 meters). In addition, the total weight of the shed, including the packaging, as approximately 450 pounds (204 kilograms).

In greater detail, the shed 10 may have dimensions of approximately 94 inches in width (2.38 meters), 118 inches (3 meters) in length and a height of 96 inches (2.4 meters). This may allow the shed to have an interior width of approximately 90 inches (2.3 meters), length of approximately 114 inches (2.9 meters), a minimum height of approximately 70 inches (1.77 meters) and a maximum height of approximately 94 inches (2.38 meters). This may create a shed 10 with about 71.3 square feet (6.62 square meters) and 486.9 cubic feet (13.79 cubic meters). As discussed above, the shed 10 may be packaged within a first package that is about 72 inches (1.8 meters) by about 31 inches (0.8 meters) by about 12 inches (0.3 meters) and a second package that is about 94 inches (2.38 meters) by about 31 inches (0.8 meters) by about 12 inches (0.3 meters). Accordingly, the packaging efficiency of the shed 10 having the above dimensions is about 11.79 (which the ratio of the shed volume to the packaging volume).

As discussed above, the shed 10 is preferably packaged into two packages. The first package includes the wall panels 24*a-h* and the corner panels 26*a-d*. The wall panels 24*a-h* and the corner panels 26*a-d* preferably have generally the same dimensions so that, during packaging, the corner panels and wall panels can be stacked on top of each other. For example, the wall panels 24 are preferably about 72 inches (1.8 meters) in length, about 30 inches (0.76 meters) in width and about 0.75 inches (1.9 centimeters) thick; and the corner panels 24 are about 72 inches (1.8 meters) in length, about 30 inches (0.76 meters) in width and about 0.75 inches (1.9 centimeters) thick. Because the thickness of the wall panels 24 and the corner panels 26 has been reduced to about 0.75 inches (1.9 centimeters), the size of the packaging to be minimized.

The other components of the shed are preferably disposed in the second package. Advantageously, the other components are disposed in a number of layers, which may facilitate packaging and assembly of the shed 10. One of ordinary skill in the art will recognize that the order and sequencing of the layers may be varied. Accordingly, while an exemplary embodiment of placing the components is described in detail below, the shed 10 may also be packaged in other suitable arrangements and configurations.

Figure 38:
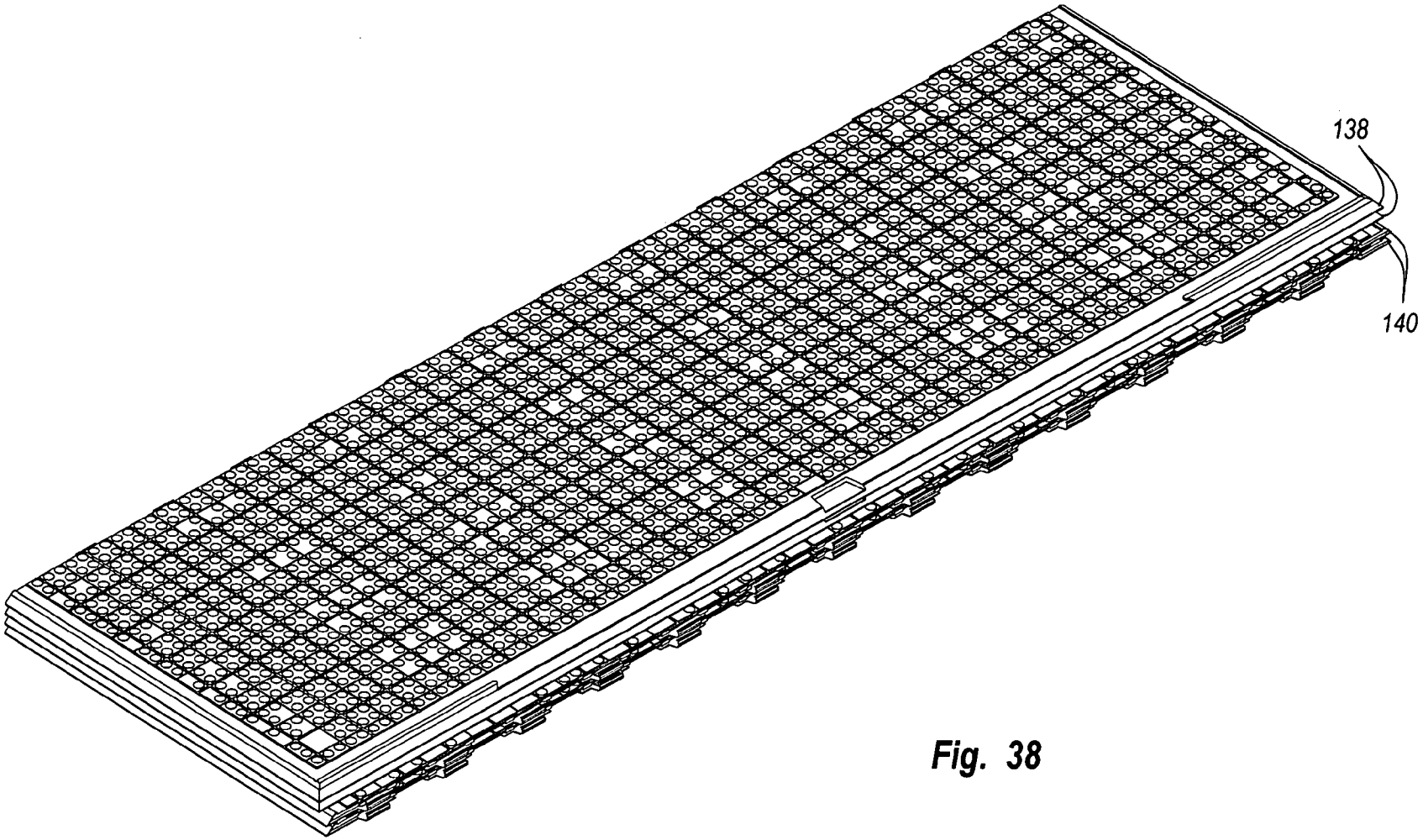
FIGS. 38-46 are perspective views illustrating exemplary arrangements for packaging various components of the shed shown in FIG. 1 within a container.
Figure 39:
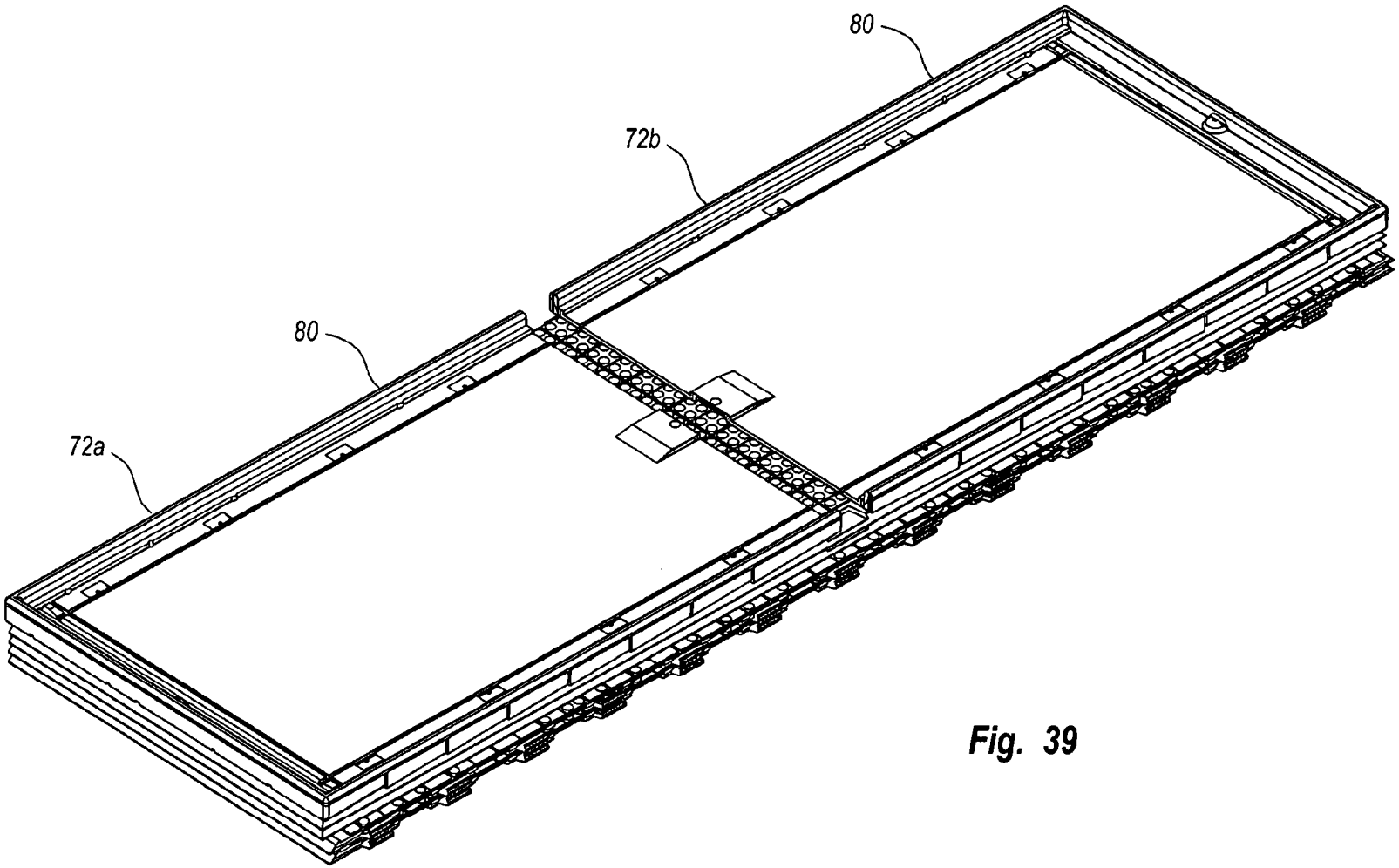
Figure 40:
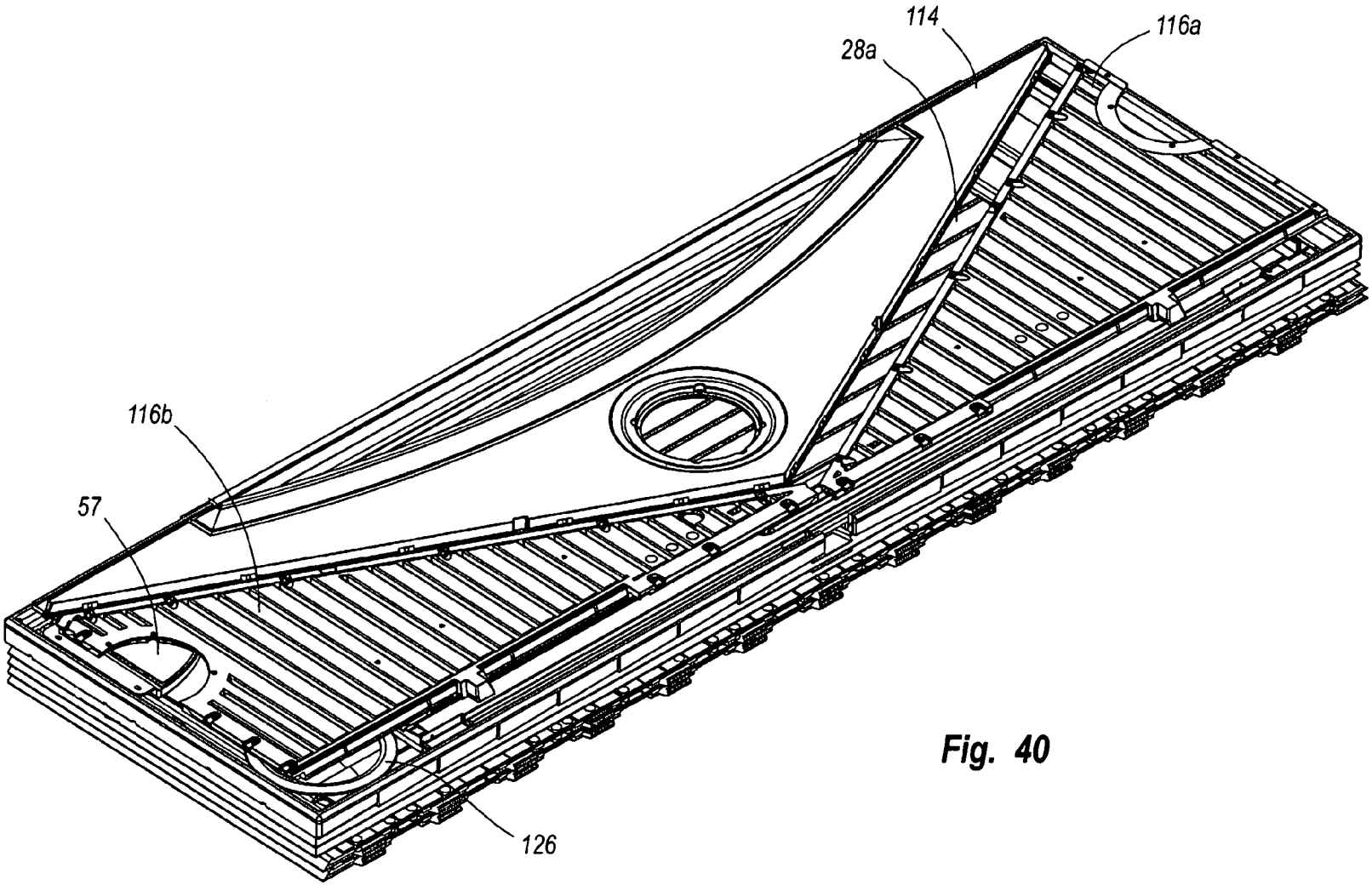
Figure 41:
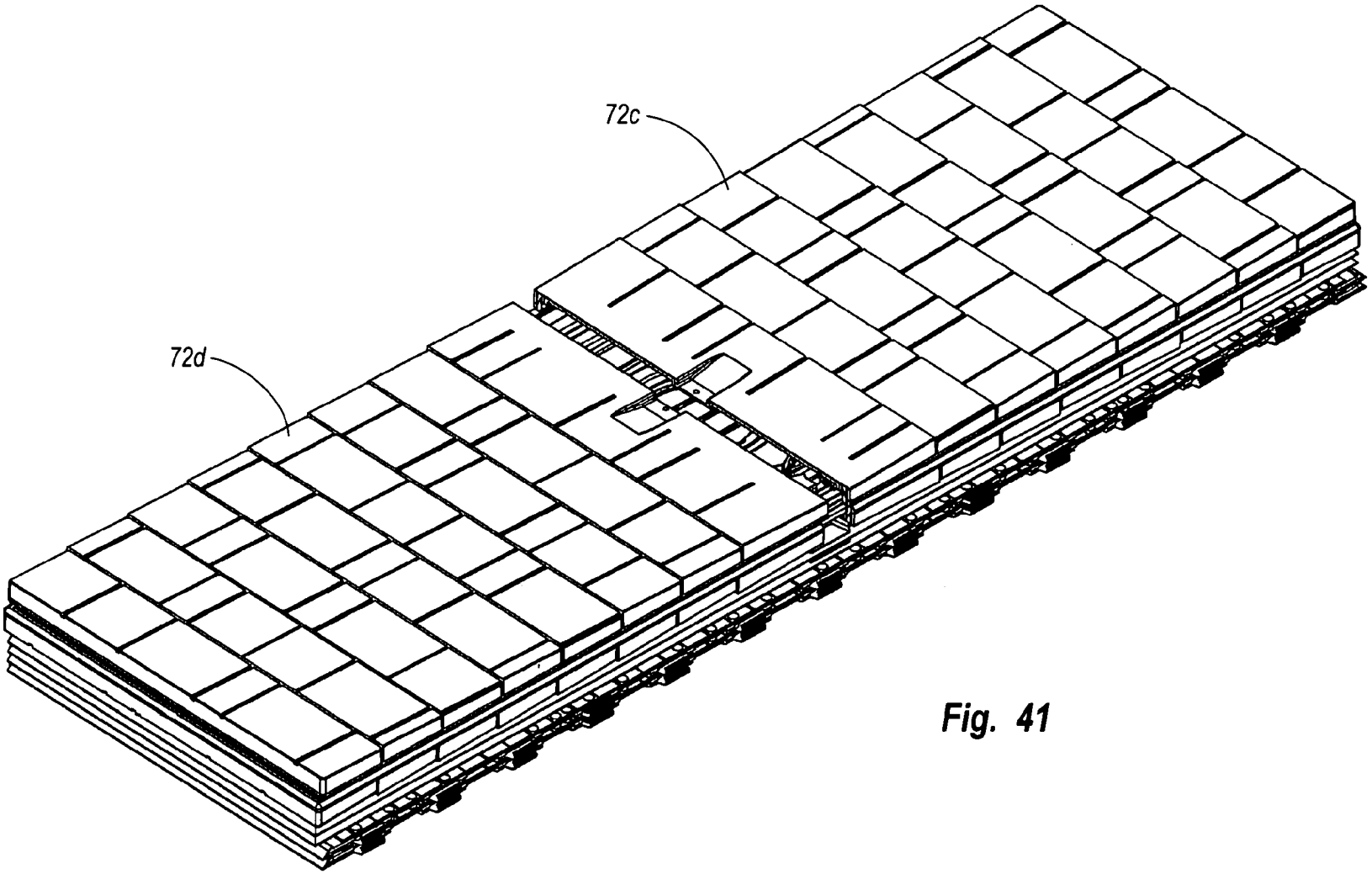

For example, as seen in FIG. 38, the second package may include the four floor panels 138, 140 stacked in a horizontal position. As seen in FIG. 39, two lower roof panels 72*a*, 72*b* are then positioned next to each other and stacked on the floor panels 138, 140. As discussed above, the lower roof panels 72*a*, 72*b* preferably include a lip 80 disposed on three sides. The sides of the lower roof panels 72*a*, 72*b* without the lip 80 are preferably placed facing each other to form at least a portion of a cavity or storage area. Advantageously, various components may be stored within the cavity and that may further minimize the size and volume of the packaging. For example, as shown in FIG. 40, a door panel 28*a*, the corner shelf 57, the vent 126 and the front gable 114 may be placed in the storage area formed by lower roof panels 72*a*, 72*b*. The two pieces of the rear gable 116 may then be placed in generally the same layer and adjacent to the front gable 114. Importantly, this allows the gables 114, 116 to be positioned in a generally rectangular configuration. Such a generally rectangular configuration may also be used to more efficiently manufacture the gables 114, 116. For example, the gables 114, 116 may be molded as a layer in a generally rectangular configuration using a blow molding or other process, which may advantageously help reduce the number and/or size of the molds used to manufacture the gables 114, 116. As shown in FIG. 41, another set of the lower roof panels 72*c*, 72*d* are then stacked on top of the gables 114, 116 and the lips 80 preferably face downwardly to generally enclose the components positioned between the lower roof panels 72*a-d*. That is, the bottom portions of the lips 80 of the lower roof panels 72*a-d* are generally positioned adjacent to each other to form the cavity that may receive at least the door panel 28*a*, the corner shelf 57, the vent 126, the front gable 114 and the rear gable 116. Significantly, this configuration may help minimize the size and volume of the packaging.

Figure 42:
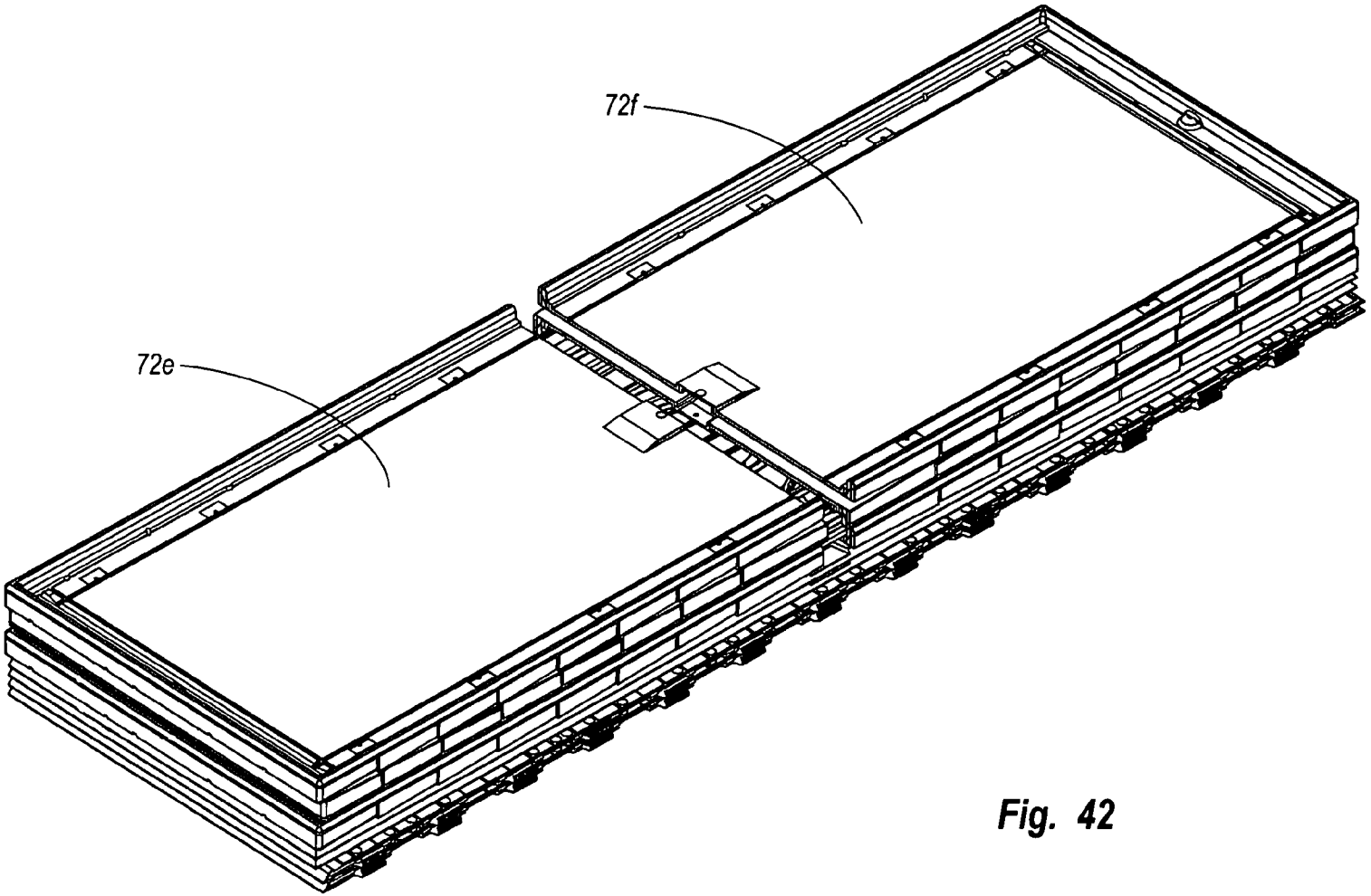
Figure 43:
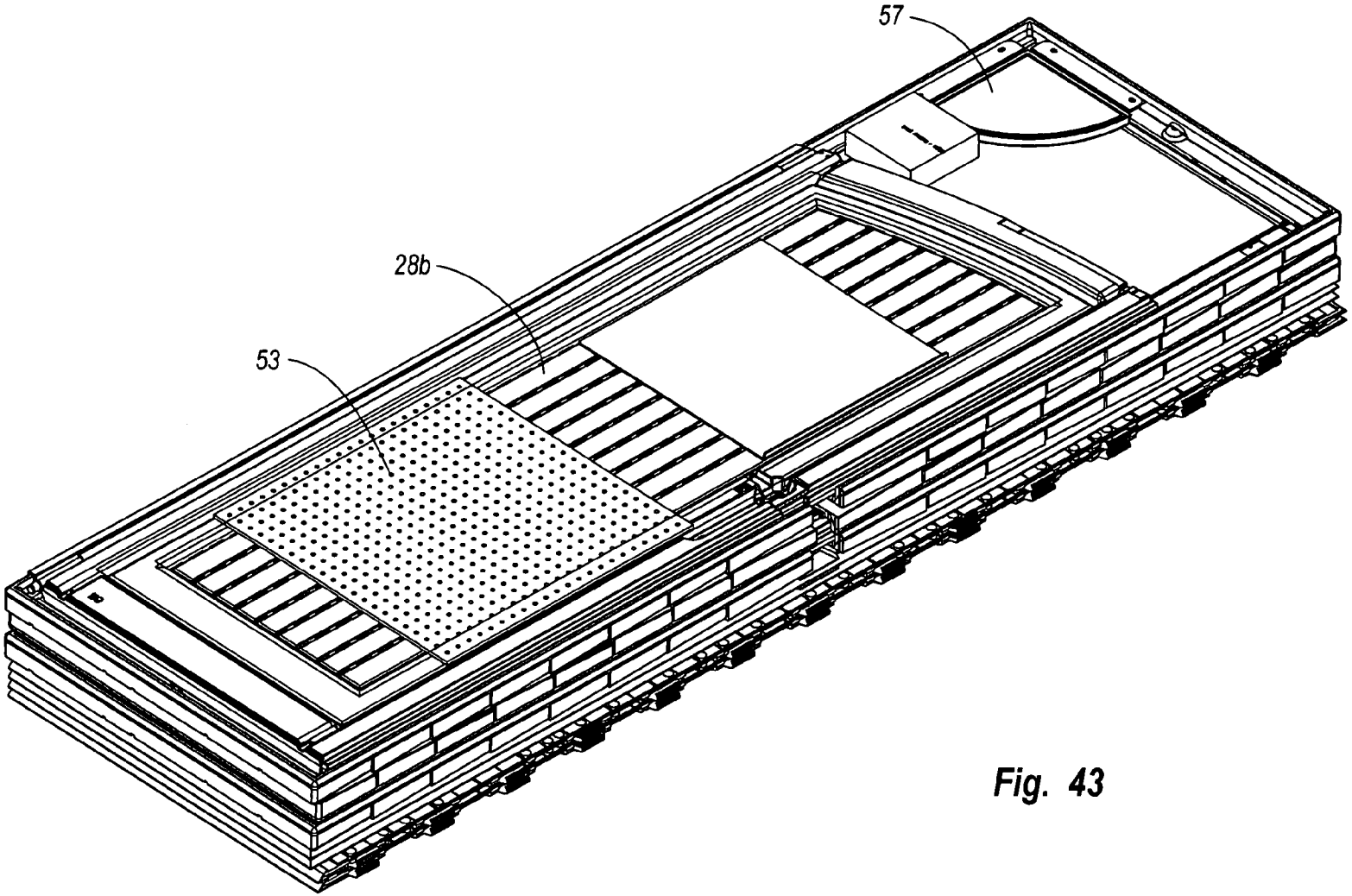

As shown in FIG. 42, a third layer of the lower roof panels 72*e*, 72*f* are preferably positioned next to each other and stacked on the floor panels 138, 140. As discussed above, the lower roof panels 72*e*, 74*f* preferably include a lip 80 disposed on three sides and the sides of the lower roof panels without the lip 80 are preferably placed facing each other to form at least a portion of a cavity or storage area. Significantly, this may create another cavity or storage area in which various components may be stored. For example, as shown in FIG. 43, the other door panel 28*b*, another corner shelf 57, the vent 136, a light (which is preferably battery powered), the first door handle, the second door handle, the door handle lever, the locking mechanism for the door, the door latch, the door latch cover plate, the deadbolt from the door, one or more pegboard attachments and one or more pieces of pegboard may be placed inside the storage area. One of ordinary skill in the art will appreciate that these and other components may be arranged differently within the packaging depending, for example, upon the intended size and configuration of the packaging.

Figure 45:
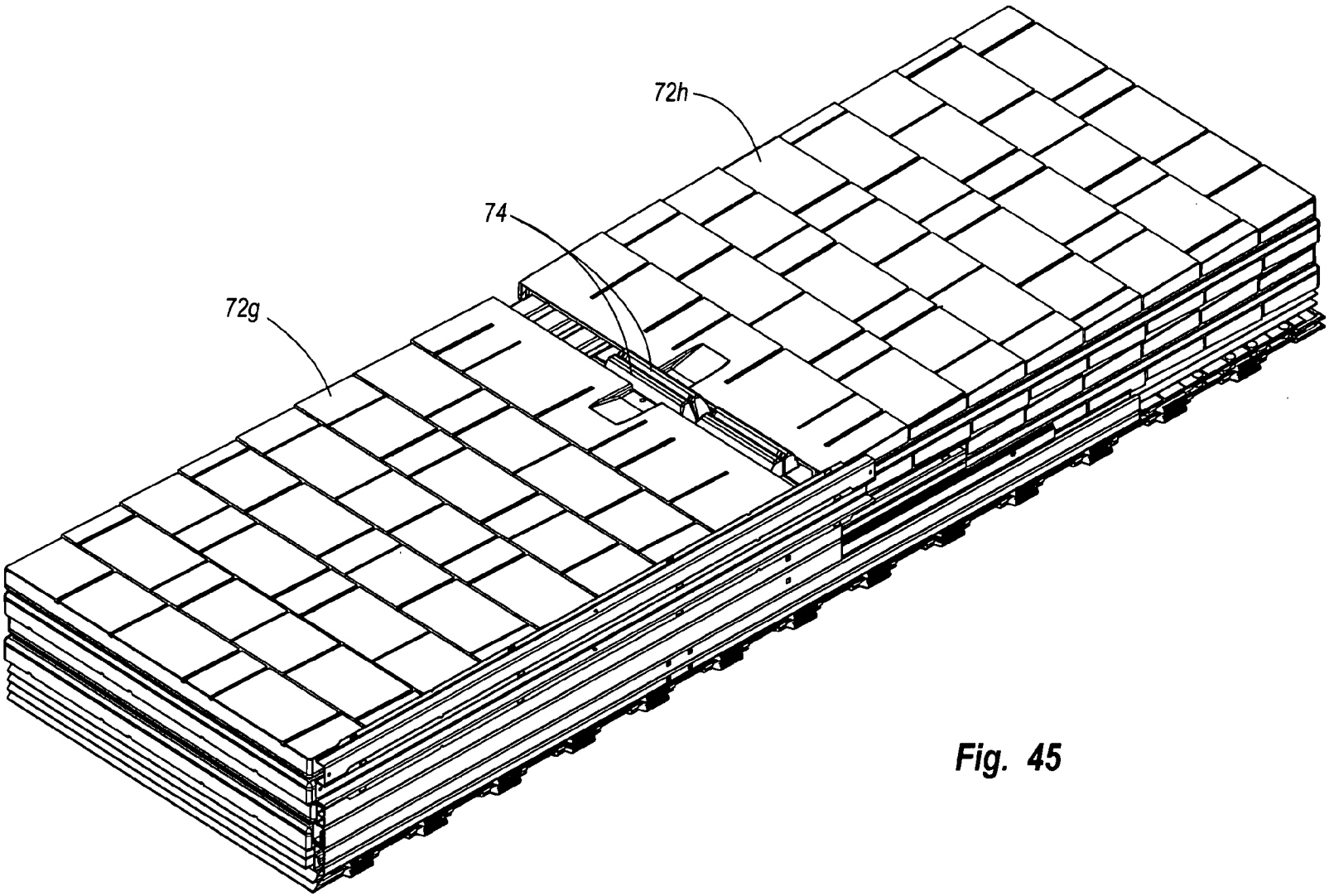

FIG. 44 illustrates that additional components may be stacked on these components. For example, the end roof cap portions 74*a*, 74*b*, the intermediate roof cap portions 76*a*, 76*b*, and the support beams 66 may be stacked on top of the other components. Also note that the extensions of the cap portions 74, 76 may be coupled to help provide a more secure package. As shown in FIG. 45, a fourth layer of the lower roof panels 72*g*, 72*h* may be stacked on or above these components. Preferably the lip 80 of the lower roof panels 72*g*, 72*h* extends downwardly towards the lip of the lower roof panels

72*e*, 72*f* to create the storage area and generally enclose the components positioned between the lower roof panels 72*e-h*. That is, the bottom portions of the lips 80 of the lower roof panels 72*e-h* are generally positioned adjacent to each other to form the cavity that may receive the door panel 28*b*, the other corner shelf 57, the vent 136 and various components of the roof. Advantageously, this cavity or storage area may also include one or more hardware bags that may include items such as fasteners. Also, as shown in FIG. 45, the lower roof panels 72*g* and 72*h* may be spaced apart a distance to form a gap with at least a portion of the end roof cap portions 74 (such as the lips of the end roof cap portions) extending between the gap, which may help minimize the size and volume of the packaging.

Figure 46:
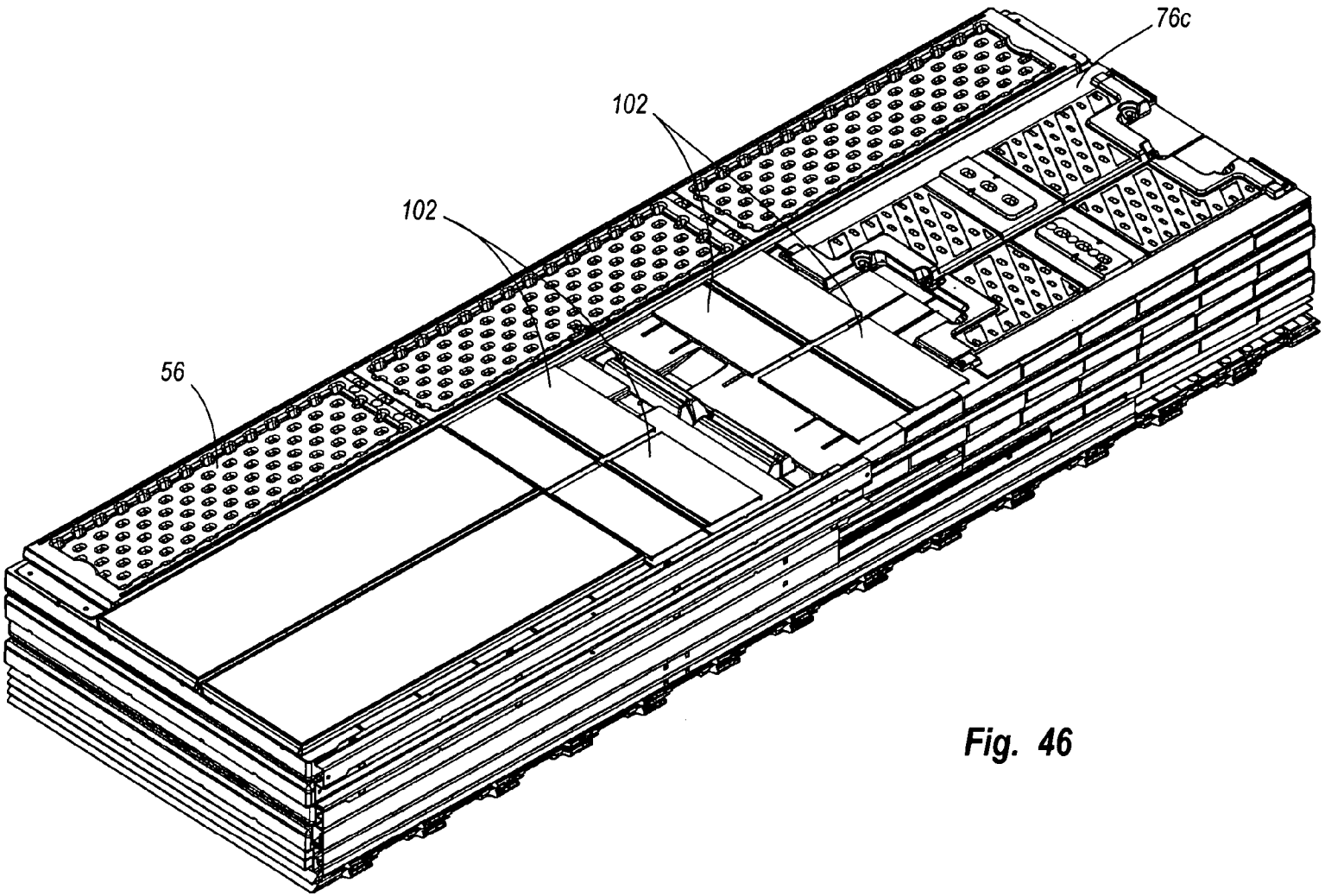

As shown in FIG. 46, the rear shelf 56 may be stacked on the lower roof panels 72*e*, 72*f* and the third intermediate roof cap portion 76*c* may also be stacked on the lower roof panels. In addition, the skylights 102 may be stacked on the lower roof panels 72*e*, 72*f*. As shown in the accompanying figures and discussed above, various portions of the roof (such as the front roof cap member, the center roof cap members and the rear roof cap member) preferably include a living hinge that is sized and configured to permit the roof cap members to lay substantially flat for shipping and packaging, and also to be folded into an angled configuration for constructing the shed. In addition, the front roof cap member, the center roof cap members and the rear roof cap member preferably include one or more skylight receiving portions. Advantageously, one or more hardware bags may be positioned within the skylight receiving portions.

FIG. 46 also shown that one or more skylights, shelves, door edges, door hinges, shelf supports, roof trusses, roof channels and/or components of the door or latch assembly may be stacked in a compact manner or layer. Significantly, arranging the components of the shed 10 in this configuration may significantly minimize the size and volume of the packaging. It will be appreciated that the shed 10 may also be packaged in other suitable arrangements and configurations. For example, the shed 10 may be packaged as disclosed in Assignee's co-pending U.S. patent application Ser. No. 11/091,849 entitled PACKAGING SYSTEM FOR A MODULAR ENCLOSURE, filed Mar. 28, 2005, which is incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A door assembly for an enclosure primarily constructed from plastic, the enclosure including a floor, a roof and a plurality of walls primarily constructed from plastic, the door assembly for the enclosure comprising:

a door constructed from plastic, the door including a front surface, a rear surface, a first side, a second side and a height;

a hinge member receiving portion disposed along the first side of the door, the hinge member receiving portion comprising an opening extending the entire height of the door, the hinge member receiving portion including a generally circular opening in a lower portion of the door and an upper portion of the door, the hinge member receiving portion being generally disposed between a plane aligned with the front surface of the door and a plane aligned with the rear surface of the door;

a metal hinge member disposed within the hinge member receiving portion, the hinge member comprising an elongated member with a generally circular configuration including a lower end that is inserted into an opening in the floor and an upper end that is inserted into an opening in the roof to pivotally connect the door to the enclosure;

a reinforcing member attachment portion disposed along the second side of the door, the reinforcing member attachment portion generally disposed between the plane aligned with the front surface of the door and the plane aligned with the rear surface of the door, the reinforcing member attachment portion comprising:

a first groove formed in the door;

a first surface forming an outer perimeter of the door; and a second surface forming an outer perimeter of the door, the second surface disposed generally perpendicular to the first surface; and a metal reinforcing member attached to the reinforcing member attachment portion, the reinforcing member comprising:

a first portion that contacts the first surface of the reinforcing member attachment portion;

a second portion that contacts the second surface of the reinforcing member attachment portion; and a first inwardly extending flange that contacts and is at least partially disposed within the first groove of the reinforcing member attachment portion.

2. The door assembly as in claim 1, wherein the reinforcing member attachment portion further comprises a second groove formed in the door; and wherein the metal reinforcing member further comprising a second inwardly extending flange that contacts and is at least partially disposed within the second groove of the reinforcing member attachment portion.

3. The door assembly as in claim 1, wherein the reinforcing member has a generally U-shaped configuration.

4. The door assembly as in claim 1, wherein the first groove of the reinforcing member attachment portion is formed in the front surface of the door; and wherein a second groove of the reinforcing member attachment portion is formed in the rear surface of the door;

wherein the first groove and the second groove are generally aligned on opposing sides of the door.

5. The door assembly as in claim 1, wherein the only portion of the hinge member that is exposed is the upper end and the lower end;

wherein a body of the hinge member between the upper end and the lower end is enclosed within the hinge member receiving portion and is not exposed; and wherein the reinforcing member is exposed along the second side of the door.

6. The door assembly as in claim 1, further comprising a third surface of the reinforcement member attachment portion; and further comprising a third portion of the reinforcing member;

wherein the first portion, the second portion and the third portion of the reinforcing member enclose the first surface, the second surface and the third surface of the reinforcing member attachment portion.

7. The door assembly as in claim 1, wherein the reinforcing member has a generally U-shaped configuration with a first outer surface generally aligned with the front surface of the door and a second outer surface generally aligned with the rear surface of the door.

8. The door assembly as in claim 1, wherein the reinforcing member has a generally U-shaped configuration with the first inwardly extending flange disposed on one side of the reinforcing member; and wherein a second inwardly extending flange is disposed on an opposing side of the reinforcing member.

9. The door assembly as in claim 1, wherein the hinge member and the reinforcing member are spaced apart by a generally constant distance;

wherein the hinge member and the reinforcing member are disposed in a parallel configuration;

wherein the hinge member is almost entirely disposed within the door except for the upper end and the lower end; and wherein the reinforcing member is almost entirely exposed along the second side of the door except for the flange disposed within the groove.

10. The door assembly as in claim 1, wherein the door, the hinge member receiving portion and the reinforcing member attachment portion are constructed from plastic and integrally formed as part of a unitary, one-piece construction.

11. The door assembly as in claim 1, wherein the hinge member receiving portion is formed on the first side of the door and the reinforcing member attachment portion is formed on the second side of the door.

12. The door assembly as in claim 1, wherein the first portion of the reinforcing member engages the first surface of the reinforcing member attachment portion;

wherein the second portion of the reinforcing member engages the second surface of the reinforcing member attachment portion; and wherein the first flange engages the first groove of the reinforcing member attachment portion.

13. The door assembly as in claim 12, further comprising a third surface of the reinforcing member attachment portion and a third portion of the reinforcing member; and further comprising a second groove of the reinforcing member attachment portion and a second flange of the reinforcing member;

wherein the third portion of the reinforcing member engages the third surface of the reinforcing member attachment portion; and wherein the second flange engages the second groove of the reinforcing member attachment portion.

14. The door assembly as in claim 1, wherein the reinforcing member attachment portion and the reinforcing member have a symmetrical configuration about a central axis; and wherein the reinforcing member encloses at least three sides of the reinforcing member attachment portion.

15. The door assembly as in claim 1, further comprising a flange extending outwardly from the hinge member receiving portion, the flange being sized and configured to prevent water from unintentionally entering the enclosure.

16. The door assembly as in claim 1, further comprising a flange outwardly extending from the hinge member receiving portion, the flange comprising a thin strip of plastic that is integrally formed with the hinge member receiving portion and the door as part of a unitary, one-piece construction, the flange including a generally planar outer surface that is disposed parallel to the front surface and the rear surface of the door, the flange being sized and configured to cover at least a portion of a seam between the door and an adjacent part of the enclosure when the door is in a closed position.

17. The door assembly as in claim 16, wherein the generally planar outer surface of the flange is generally aligned with and disposed coplanar with the front surface of the door.

18. The door assembly as in claim 16, wherein the flange has a length that is approximately equal to the height of the door.

19. The door assembly as in claim 16, wherein the flange has a width that is approximately equal to a width of the hinge member receiving portion.

20. The door assembly as in claim 1, further comprising a flange outwardly extending from the hinge member receiving portion, the flange comprising a thin strip of plastic that is integrally formed with the hinge member receiving portion and the door as part of a unitary, one-piece construction, the flange including a generally planar outer surface that is disposed parallel to the front surface and the rear surface of the door, the flange being sized and configured to cover at least a portion of a seam between the door and an adjacent part of the enclosure when the door is in a closed position.

21. A door assembly for an enclosure, the door assembly comprising:

a door constructed from molded plastic, a hinge member receiving portion formed on a first side of the door, the hinge member receiving portion comprising a generally circular opening that extends from a lower portion of the door to an upper portion of the door;

a metal, generally cylindrical hinge member disposed within the hinge member receiving portion, a lower end of the hinge member and an upper end of the hinge member pivotally connecting the door to the enclosure;

a reinforcing member attachment portion disposed along a second side of the door, the reinforcing member attachment portion generally disposed between a plane aligned with a front surface of the door and a plane aligned with a rear surface of the door, the reinforcing member attachment portion comprising:

a first groove formed in the front surface of the door;

a second groove formed in the rear surface of the door;

a first surface disposed proximate the first groove;

a second surface disposed proximate the second groove; and a third surface disposed between the first surface and the second surface; and a metal reinforcing member attached to the reinforcing member attachment portion, the reinforcing member comprising:

a first inwardly extending flange that is at least partially disposed within the first groove of the reinforcing member attachment portion;

a second inwardly extending flange that is at least partially disposed within the second groove of the reinforcing member attachment portion a first portion that contacts the first surface of the reinforcing member attachment portion;

a second portion that contacts the second surface of the reinforcing member attachment portion; and a third portion that contacts the third surface of the reinforcing member attachment portion.

22. The door assembly as in claim 21, wherein the reinforcing member has a generally U-shaped configuration.

23. The door assembly as in claim 21, wherein the first groove and the second groove are generally aligned on opposing sides of the door.

24. The door assembly as in claim 21, wherein the only portion of the hinge member that is exposed is an upper end and a lower end;

wherein a body of the hinge member between the upper end and the lower end is enclosed within the hinge member receiving portion and is not exposed; and wherein the reinforcing member is exposed along the second side of the door.

25. The door assembly as in claim 21, wherein the first portion, the second portion and the third portion of the reinforcing member enclose the first surface, the second surface and the third surface of the reinforcing member attachment portion.

26. The door assembly as in claim 21, wherein the reinforcing member has a generally U-shaped configuration with a first outer surface generally aligned with a front surface of the door and a second outer surface generally aligned with a rear surface of the door.

27. The door assembly as in claim 21, wherein the hinge member and the reinforcing member are spaced apart by a generally constant distance on opposing sides of the door;

wherein the hinge member and the reinforcing member are disposed in a parallel configuration;

wherein the hinge member is almost entirely disposed within a first side of the door except for an upper end and a lower end; and wherein the reinforcing member is almost entirely exposed along a second side of the door except for the first flange disposed within the first groove and the second flange disposed within the second groove.

28. The door assembly as in claim 21, wherein the door, the hinge member receiving portion and the reinforcing member attachment portion are constructed from plastic and integrally formed as part of a unitary, one-piece construction.

29. The door assembly as in claim 21, wherein the reinforcing member attachment portion and the reinforcing member have a symmetrical configuration about a central axis; and wherein the reinforcing member encloses at least three sides of the reinforcing member attachment portion.

30. The door assembly as in claim 21, further comprising a flange extending outwardly from the hinge member receiving portion, the flange being sized and configured to prevent water from unintentionally entering the enclosure, a generally planar outer surface of the flange being generally aligned with and disposed coplanar with a front surface of the door.

* * * * *

UNITED STATES PATENT AND TRADEMARK OFFICE

CERTIFICATE OF CORRECTION

PATENT NO. : 7,770,334 B2
APPLICATION NO. : 11/091620
DATED : August 10, 2010
INVENTOR(S) : Mower et al.

It is certified that error appears in the above-identified patent and that said Letters Patent is hereby corrected as shown below:

Column 2
Line 45, change “constructed” to --construct--

Column 3
Line 1, change “scourage m” to --shed from the--

Column 4
Line 34, change “increasing” to --increase--

Column 5
Line 61, change “assembly” to --assemble--

Column 6
Line 34, after “components” insert --may be--
Line 38, change “by” to --be--
Line 54, change “assembly” to --assemble--

Column 10
Line 67, change “limits” to --limit--

Column 11
Line 50, after “exemplary” remove [a]

Column 12
Line 34, after “FIG. 37” insert --is a--

Column 13
Line 52, change “overhand” to --overhang--

Signed and Sealed this
Eighth Day of February, 2011

David J. Kappos

David J. Kappos
*Director of the United States Patent and Trademark Office*

Column 14
Line 24, after “size of” insert --the shed.--

Column 15
Line 22, after “that” insert --the--
Line 44, remove [thirty inches]

Column 16
Line 18, remove [thirty inches]

Column 17
Line 4, change “walls” to --wall--
Line 66, change “complimentary” to --complementary--

Column 18
Line 32, change “is” to --are--
Line 56, change “shed,” to --sheds,--

Column 23
Line 3, change “construed” to --constructed--

Column 24
Line 18, change “of shelf fits snugly within inside” to --of the shelf fits snugly within the inside--
Line 21, change “also one” to --also include one--
Line 22, change “member” to --members--
Line 33, change “also one” to --also include one--
Line 34, change “member” to --members--

Column 26
Line 42, change “system. bracket” to --system. A bracket--
Line 67, change “of thicker” to --of a thicker--

Column 27
Line 9, change “One or ordinary” to --One of ordinary--
Line 10, change “appreciated” to --appreciate--

Column 29
Line 47, after “portion” insert --of--
Line 62, remove [a]

Column 30
Line 44, after “of” insert --the--
Line 57, change “101*b*” to --100*b*--

Column 31
Line 45, change “preferable” to --preferably--

Column 32
Line 24, change “includes” to --include--
Line 61, change “used” to --use--

Column 33
Line 38, change “also other” to --also include other--
Line 62, remove the second instance of [as the]

Column 34
Line 66, change “patter” to --pattern--

Column 35
Line 13, change “of bottom” to --of the bottom--

Column 36
Line 34, change “bisects” to --bisect--
Line 47, change “assembly” to --assemble--

Column 37
Line 51, change “complimentary” to --complementary--

Column 38
Lines 20-21, change “with in” to --with the--

Column 41
Line 16, change “office” to --office.--
Line 30, change “as” to --is--
Line 47, after “which” insert --is--
Line 61, change “packaging to” to --packaging can--

Column 43
Line 31, change “shown” to --shows--

Column 46
Line 50, change “portion” to --portion;--